US009483029B2

(12) United States Patent
Iida

(10) Patent No.: US 9,483,029 B2
(45) Date of Patent: Nov. 1, 2016

(54) TIMEPIECE AND ELECTRONIC TIMEPIECE

(71) Applicant: Seiko Epson Corporation, Tokyo (JP)

(72) Inventor: Kenji Iida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/632,027

(22) Filed: Feb. 26, 2015

(65) Prior Publication Data

US 2015/0253739 A1 Sep. 10, 2015

(30) Foreign Application Priority Data

| | | |
|---|---|---|
| Mar. 6, 2014 | (JP) | 2014-043600 |
| Mar. 6, 2014 | (JP) | 2014-043601 |
| Mar. 6, 2014 | (JP) | 2014-043602 |
| Mar. 25, 2014 | (JP) | 2014-062290 |
| Mar. 25, 2014 | (JP) | 2014-062291 |

(51) Int. Cl.
*G04G 9/00* (2006.01)
*G04R 20/04* (2013.01)

(52) U.S. Cl.
CPC ..... *G04G 9/00* (2013.01); *G04G 9/0076* (2013.01); *G04R 20/04* (2013.01)

(58) Field of Classification Search
CPC .... G04B 19/08; G04B 19/087; G04B 19/06; G04B 19/04; G04B 21/04; G04B 9/00; G04B 9/0076; G04B 20/04
See application file for complete search history.

(56) References Cited

U.S. PATENT DOCUMENTS

| | | | | |
|---|---|---|---|---|
| 5,237,544 | A * | 8/1993 | Sase | G04G 9/0076 368/21 |
| 8,897,097 | B2 * | 11/2014 | Baba | G01S 19/26 342/357.74 |
| 2006/0140056 | A1 | 6/2006 | Lizzi | |
| 2009/0305657 | A1 | 12/2009 | Someya | |
| 2010/0074059 | A1 | 3/2010 | Hasumi et al. | |
| 2011/0051561 | A1 | 3/2011 | Fujisawa | |
| 2013/0003506 | A1 | 1/2013 | Kato et al. | |
| 2013/0051186 | A1 * | 2/2013 | Honda | G04R 20/04 368/47 |
| 2013/0051188 | A1 * | 2/2013 | Akiyama | G04R 20/04 368/47 |
| 2013/0051198 | A1 * | 2/2013 | Sato | G04B 19/087 368/235 |
| 2013/0052977 | A1 * | 2/2013 | Akiyama | G04R 20/02 455/344 |
| 2013/0077450 | A1 * | 3/2013 | Fleury | G04C 10/04 368/80 |
| 2014/0016440 | A1 * | 1/2014 | Kato | G04R 20/10 368/47 |

(Continued)

FOREIGN PATENT DOCUMENTS

| | | |
|---|---|---|
| JP | 62-130376 | 6/1987 |
| JP | 08005756 | 1/1996 |
| JP | 2009-175044 | 8/2009 |

OTHER PUBLICATIONS

"GoodsPress Tokuma Shoten, Jul. 10, 2013, pp. 75-81".

*Primary Examiner* — Sean Kayes

(57) ABSTRACT

An electronic timepiece includes a measured time display region, a reception state display region, and one indicating hand that indicates the measured time display region and the reception state display region. In addition, a scale indicating measured time measured by using a time measurement function is disposed in the measured time display region, and a scale indicating a reception state of a satellite signal is disposed in the reception state display region. The one indicating hand indicates the scale in the measured time display region when the time measurement function is executed, and indicates the scale in the reception state display region when the reception function is executed.

5 Claims, 23 Drawing Sheets

(56) References Cited

U.S. PATENT DOCUMENTS

2014/0086021 A1* 3/2014 Baba ..... G04R 20/04 368/47
2015/0139374 A1* 5/2015 Kato ..... G04R 20/04 375/354
2015/0146503 A1* 5/2015 Nakanishi ..... G04G 9/0076 368/21
2015/0168924 A1* 6/2015 Kato ..... G04R 20/04 368/47
2015/0192904 A1* 7/2015 Kato ..... G04R 20/06 368/47

* cited by examiner

10a 50
64
63
34
31
61
62
30
32
33
71a
22
70a
15a
80a
81a
40
21
11a
23
81b
80b

TIMEPIECE AND ELECTRONIC TIMEPIECE

BACKGROUND

1. Technical Field

The present invention relates to a timepiece and an electronic timepiece which include multiple functions.

2. Related Art

In timepieces having a chronograph and a water depth gauge, a timepiece is known which displays a current mode using a region indicated by one mode hand (refer to JP-A-8-5756).

In JP-A-8-5756, if a first press button is pressed during a time mode for displaying the normal time, the time mode is switched over to a water depth measurement mode. Then, a second function hand serving as the mode hand moves to a DIV zone so that a first function hand indicates a water depth ranging from 0 m to 50 m.

If the first press button is pressed when 0 m is displayed in the water depth measurement mode, the water depth measurement mode is switched over to a chronograph mode.

In the chronograph mode, if a second press button is pressed, the chronograph starts. The first function hand performs a hand movement as a second hand of the chronograph, and the second function hand performs a hand movement as a minute hand of the chronograph. Then, if the second press button is pressed again, the chronograph stops. If the second press button is operated in the stopped state, the chronograph is brought into a reset state. If the first press button is pressed in the reset state, the chronograph mode is cancelled so as to be switched over to the time mode.

In the related art, an electronic timepiece is known which calculates position information of the current location using satellite signals so as to display a time zone of the current location (area in which a common standard time is used) or a time difference between the standard time used in the time zone and the Coordinated Universal Time (UTC). For example, JP-A-2009-175044 discloses a wrist timepiece which includes a dial for displaying a map and multiple indicating hands, and which creates an intersection point on the map using the multiple indicating hands so as to indicate the current location. In addition, "Goods Press, July 2013", Tokuma Shoten Publishing Co., Ltd, Jul. 10, 2013, pp. 75 to 81 discloses a wrist timepiece which displays 39 time zones on an outer periphery of a dial and indicates the time zone of the current location using the indicating hand. These wrist timepieces include a reception unit which receives the satellite signals from a navigation satellite such as a Global Positioning System (GPS), and which sets the time zone and displays local time by receiving signals from four navigation satellites and obtaining the position information and time information of the current location.

In the timepiece disclosed in JP-A-8-5756, during the water depth measurement mode, the second function hand serving as the mode hand moves to the DIV zone, and the first function hand indicates the water depth. For this reason, if a user merely views the second function hand, the user can recognize only that the current mode is the water depth measurement mode. In order to recognize that the current depth is in a range of 0 m to 50 m, the user needs to view the first function hand. That is, in JP-A-8-5756, if the user merely views a position indicated by one indicating hand, the user cannot recognize a mode in execution and a state thereof (for example, water depth), thereby degrading usability. Since two indicating hands are driven, there is a problem of increased power consumption.

In the timepiece disclosed in JP-A-8-5756, in order to select and execute a chronograph function, the user needs to select a mode using the first press button, and then to perform a start operation or a stop operation for a chronograph by pressing the second press button. For this reason, two operations such as mode selection and function start are required, thereby causing a problem of degraded usability. In addition, a button for executing the water depth measurement mode and a button for executing the chronograph mode are not separately disposed. Display related to the water depth measurement mode and display related to the chronograph mode have no relationship with the position of each button. Consequently, the user is less likely to understand which button is to be pressed in order to execute the function. An erroneous operation is likely to be performed in that the user unintentionally selects a mode which is different from a mode to be executed, thereby causing a problem of degraded usability.

The electronic timepiece using the satellite signals which is disclosed in JP-A-2009-175044 and "Goods Press, July 2013", Tokuma Shoten Publishing Co., Ltd, Jul. 10, 2013, pp. 75 to 81 has multiple functions. However, there is a need for a further additional function. For example, the chronograph function is additionally needed. However, if all of these functions are to be displayed on the electronic timepiece of a wrist timepiece type, there is a risk that visibility may be degraded due to limited display space. In addition, since the wrist timepiece can be considered to be jewelry, aesthetic design thereof is less likely to be compatible with display of multiple functions.

The electronic timepiece which is disclosed in JP-A-2009-175044 and "Goods Press, July 2013", Tokuma Shoten Publishing Co., Ltd, Jul. 10, 2013, pp. 75 to 81 and which includes a world time function for displaying the local time does not include the chronograph function (stopwatch function) for integrating and displaying the time. Therefore, in order to measure the time in a time-different country or the time for competitions in multiple time zones, it is necessary to use two types of measurement instruments such as the electronic timepiece including the world time function and the stopwatch.

SUMMARY

An advantage of some aspects of the invention is to provide a timepiece and an electronic timepiece which solves at least a part of the problems described above.

Application Example 1

A timepiece according to this application example includes a measured time display region that displays information related to a time measurement function, the measured time display region having a time scale corresponding to time measurements of the time measurement function, a signal reception state display region that displays information related to a satellite signal reception function, the signal reception state display region having a reception state scale corresponding to signal reception states of the satellite signal reception function, and one indicating hand that indicates a specific time on the time scale of the measured time display region, and a specific reception state on the reception state scale of the signal reception state display region. The one indicating hand indicates the specific time on the time scale when the time measurement function is executed, and indicates the specific reception state on the reception state scale when the satellite signal reception function is executed.

According to this application example, the one indicating hand indicates the scale in the measured time display region when the time measurement function is executed, and indicates the scale in the reception state display region when the reception function is executed. Accordingly, a user can grasp the function currently being executed and a state thereof by merely viewing the position of each scale indicated by one indicating hand. Therefore, as compared to the timepiece disclosed in JP-A-8-5756 which displays the function currently being executed and the state thereof by using two different indicating hands, the user can more easily recognize the executed function within multiple functions and the state thereof. Since driving only one indicating hand is sufficient enough for the timepiece, power consumption can be reduced.

The user can easily grasp which function is executed between the measurement time function and the reception function by merely viewing the region indicated by one indicating hand, thereby enabling the user to easily confirm whether or not the intended function has been executed. Therefore, it is possible to improve usability.

Application Example 2

A timepiece according to this application example includes a measured time display region that displays information related to a time measurement function, the measured time display region having a time scale corresponding to time measurements of the time measurement function, a voltage state display region that displays information related to a power supply voltage detection function, the voltage state display region having a voltage state scale corresponding to voltage state detections of the power supply voltage detection function, and one indicating hand that indicates a specific time on the time scale of the measured time display region, and a specific voltage state on the voltage state scale of the voltage state display region. The one indicating hand indicates the specific time on the time scale when the time measurement function is executed, and indicates the specific voltage state on the voltage state scale when the power supply voltage detection function is executed.

According to this application example, one indicating hand indicates the scale in the measured time display region when the time measurement function is executed, and indicates the scale in the voltage state display region when the power supply voltage detection function is executed. Accordingly, a user can grasp the function currently being executed and the state thereof by merely viewing the position of each scale indicated by one indicating hand. Therefore, as compared to the timepiece disclosed in JP-A-8-5756 which displays the function currently being executed and the state thereof by using two different indicating hands, the user can easily recognize the executed function within multiple functions and the state thereof. Since driving only one indicating hand is sufficient enough for the timepiece, power consumption can be reduced.

The user can easily grasp which function is executed between the measurement time function and the power supply voltage detection function by merely viewing the region indicated by one indicating hand, thereby enabling the user to easily confirm whether or not the intended function has been executed. Therefore, it is possible to improve usability.

Application Example 3

A timepiece according to this application example includes a measured time display region that displays information related to a time measurement function, the measured time display region having a time scale corresponding to time measurements of the time measurement function, a signal reception state display region that displays information related to a satellite signal reception function, the signal reception state display region having a reception state scale corresponding to signal reception states of the satellite signal reception function, a voltage state display region that displays information related to a power supply voltage detection function, the voltage state display region having a voltage state scale corresponding to voltage state detections of the power supply voltage detection function, and one indicating hand that indicates a specific time on the time scale of the measured time display region, a specific reception state on the reception state scale of the signal reception state display region, and a specific voltage state on the voltage state scale of the voltage state display region. The one indicating hand indicates the specific time on the time scale when the time measurement function is executed, indicates the specific reception state on the scale i when the reception function is executed, and indicates the specific voltage state on the voltage state scale when the power supply voltage detection function is executed.

According to this application example, one indicating hand indicates the scale in the measured time display region when the time measurement function is executed, indicates the scale in the reception state display region when the reception function is executed, and indicates the scale in the voltage state display region when the power supply voltage detection function is executed. Accordingly, a user can grasp the function currently being executed and a state thereof by merely viewing the position of each scale indicated by one indicating hand. Therefore, as compared to the timepiece disclosed in JP-A-8-5756 which displays the function currently being executed and the state thereof by using two different indicating hands, the user can more easily recognize the executed function within multiple functions and the state thereof. Since driving only one indicating hand is sufficient enough for the timepiece, power consumption can be reduced.

The user can easily grasp which function is being executed out of the measurement time function, the reception function, and the power supply voltage detection function by merely viewing the region indicated by one indicating hand, thereby enabling the user to easily confirm whether or not the intended function has been executed. Therefore, it is possible to improve usability.

It is preferable that the timepiece according to the application example described above also includes an annular display region, the measured time display region is arranged in the right half region of the annular display region in a plan view, and the region other than the measured time display region is arranged in the left half region of the annular display region in a plan view.

According to this configuration, the measured time display region is arranged in the right half region of the annular display region, and the region other than the measured time display region is arranged in the left half region of the annular display region. Accordingly, a user can clearly distinguish the measured time display region and the region other than the measured time display region from each other. Therefore, since the measured time display region is arranged in the right half region of the display region, if one indicating hand indicates the right half region, the user can immediately recognize that the time measurement function is being executed. Therefore, it is possible to improve usability.

Since the display region other than the measured time display region is disposed in the left half region (not disposed in the right half region), the measured time display region can be disposed in the overall right half region. Accordingly, the user can easily recognize the scale of the time measured by using the time measurement function. In this regard, it is also possible to improve usability.

Application Example 4

A timepiece according to this application example includes a first display region that displays first information related to a first function; a second display region that displays second information related to a second function; a first operation unit that is arranged at a position closer to the first display region than to the second display region, and that performs an operation related to the first function; a second operation unit that is arranged at a position closer to the second display region than to the first display region, and that performs an operation related to the second function; and an indicating hand that indicates specific first information on the first display region when the first function is executed, and indicates specific second information on the second display region when the second function is executed.

According to this application example, the first operation unit for executing the first function and the second operation unit for executing the second function are separately disposed. Accordingly, operating the first operation unit enables the first function to be directly executed, and operating the second operation unit enables the second function to be directly executed. Therefore, as compared to the timepiece disclosed in JP-A-8-5756 which selects the first function and the second function according to the number of times to press one button, it is possible to improve operability when each function is executed.

Each operation unit is arranged at a position close to the display region for performing the display related to the corresponding function. Accordingly, a user can intuitively grasp the fact that it is advantageous to operate the first operation unit when the function in the first display region is to be executed and that it is advantageous to operate the second operation unit when the function in the second display region is to be executed. Therefore, it is possible to improve usability.

Furthermore, the user can easily grasp the function currently being executed by merely viewing the region indicated by the indicating hand, thereby enabling the user to easily confirm whether or not the intended function is being executed. Therefore, the user can handle a multi-function timepiece with better operability, and thus, it is possible to improve usability.

Application Example 5

In the timepiece according to the application example described above, it is preferable that: the first function is a time measurement function executed based on an operation of the first operation unit; the first display region is a measured time display region having a time scale corresponding to time measurements of the time measurement function; the specific first information is a specific time measurement; and the indicating hand indicates the specific time measurement on the time scale when the first function is executed.

According to this application example, the scale indicating the measured time measured by using the time measurement function is disposed in the first display region. Accordingly, a user can easily recognize that the time measurement function is being executed, if the user operates the first operation unit disposed at the position close to the first display region. If the indicating hand indicates the first display region, the user can easily recognize that the function currently being executed is the time measurement function. In addition, the user can recognize the measured time by viewing the position of the scale which is indicated by the indicating hand.

That is, according to this application example, the indicating hand functions as a mode hand for indicating the time measurement function, which is the first function, by indicating the first display region, and additionally functions as an indicator hand for displaying the measured time measured by indicating the scale in the first display region. Therefore, if the user confirms only the indication of one indicating hand, the user can grasp that the time measurement function such as a chronograph function and a timer function has been executed, and can grasp the measured time thereof. Therefore, it is possible to improve usability.

Application Example 6

In the timepiece according to the application example described above, it is preferable that: the second operation unit includes a signal reception unit that receives a satellite signal; the second function is a satellite signal reception function executed based on an operation of the second operation unit; the second display region is a reception state display region having a reception state scale corresponding to reception states of the satellite signal reception function; the specific second information is a specific reception state; and the indicating hand indicates the specific reception state on the time scale when the second function is executed.

According to this application example, the scale indicating the reception state of the satellite signal is disposed in the second display region. Accordingly, a user can easily recognize that a satellite signal reception function is being executed, if the user operates the second operation unit disposed at the position close to the second display region. If the indicating hand indicates the second display region, the user can easily recognize that the function currently being executed represents the satellite signal reception function. In addition, the user can recognize the reception mode of the satellite signal or the reception state such as a reception signal level by viewing the position of the scale which is indicated by the indicating hand.

That is, according to this application example, the indicating hand functions as a mode hand for indicating the reception function which is the second function by indicating the second display region, and additionally functions as a reception mode indicating hand which indicates whether the reception function during execution represents a position measurement mode for calculating and obtaining a current position or a time measurement mode for acquiring current time by indicating the scale of the second display region, or functions as an indicator hand for displaying a signal level of the satellite signal during the reception. Therefore, if the user confirms only the indication of one indicating hand, the user can grasp that the reception function has been executed, and can grasp a reception mode in execution or the reception state such as the signal level, and thus, it is possible to improve usability.

Application Example 7

In the timepiece according to the application example described above it is preferable that the timepiece further includes a timepiece case and an annular display region on the timepiece case in a plan view, wherein: the first display region is arranged in a right half region of the annular display region in the plan view; the second display region is arranged in a left half region of the annular display region in the plan view; the first operation unit is arranged on the right side of the timepiece case in the plan view; and the second operation unit is arranged on the left side of the timepiece case in the plan view.

According to this application example, the first display region and the first operation unit are arranged on the right side of the display region and the timepiece case, and the second display region and the second operation unit are arranged on the left side of the display region and the timepiece case. Accordingly, each display region and each operation unit can be associated with each other. Therefore, a user can easily recognize that if the user operates the first operation unit arranged on the right side of the timepiece case, the first function is being executed, and that if the user operates the second operation unit arranged on the left side, the second function is being executed. Accordingly, it is possible to improve usability.

In the timepiece according to the application example described above, it is preferable that the timepiece further includes a dial having a small window, the annular display region is disposed in the small window, and the first operation unit and the second operation unit respectively include multiple buttons.

According to this configuration, the annular display region is disposed in the small window disposed in the dial. Accordingly, the indicating hand indicating the current time can be configured to include a center hand in which the center of the dial serves as a rotation axis. Therefore, a user can easily recognize the current time, and can recognize the function currently being executed by viewing the small window, when the first function or the second function is being executed.

Furthermore, if each operation unit is configured to include the multiple buttons, the user can perform multiple operations such as execution, suspension, and cancellation of each function by using the multiple buttons. Therefore, it is possible to improve the operability of each operation unit, that is, usability.

In the timepiece according to the application example described above, it is preferable that the timepiece further includes a third display region for performing display related to a third function, the indicating hand indicates the first display region when the first function is executed, the indicating hand indicates the second display region when the second function is executed, and the indicating hand indicates the third display region when the third function is executed.

Here, an example of the third function to be displayed in the third display region can include a voltage state display function of a secondary battery disposed as the power supply of the timepiece.

According to this configuration, the third display region is arranged in a region which is different from the first display region and the second display region. Accordingly, the user confirms which display region is indicated by one indicating hand, thereby enabling the user to easily confirm which function is being executed among the first to third functions. Therefore, it is possible to improve usability. In particular, if the third function is configured to be a function for displaying a voltage level of the secondary battery at approximately three stages, the user can confirm the residual capacity of the secondary battery, thereby enabling the user to easily determine whether or not charging is required.

Application Example 8

An electronic timepiece according to this application example includes: a dial; a world time function that receives an external signal and displays local time; and a chronograph function that determines an elapsed time starting from a user-specified time, and displays the elapsed time. The dial includes multiple information display units for displaying multiple information items including information related to at least any one of the world time function and the chronograph function.

According to this application example, the electronic timepiece is a wrist timepiece that is provided with multiple functions including the world time function which receives the external signal, calculates position information and time information of the current location, and displays the local time, and the chronograph function which displays an integrated minute of the time. The dial includes the multiple information display units for displaying the multiple information items related to at least anyone of the world time function and the chronograph function. In this manner, multiple information items can be displayed by improving aesthetic appearance and visibility of the electronic timepiece. Therefore, it is possible to provide the electronic timepiece in which aesthetic design is compatible with multiple function display.

In the electronic timepiece according to the application example described above, it is preferable that the external signal is a satellite signal.

According to this configuration, the electronic timepiece includes a function which receives the satellite signal transmitted from a navigation satellite as the external signal. In this manner, it is possible to obtain accurate position information and time information all over the world.

It is preferable that the electronic timepiece according to the application example described above includes a secondary battery that accumulates electric power.

According to this configuration, the electronic timepiece includes the secondary battery which accumulates the electric power for driving the electronic timepiece. The electronic timepiece can be continuously driven by charging the secondary battery with the electric power from the inside or the outside of the electronic timepiece.

Application Example 9

In the electronic timepiece according to the application example described above, it is preferable that: the electronic timepiece include a secondary battery that accumulates electric power; one of the multiple information display units displays multiple information items including elapsed time related to the chronograph function and a charge level of the secondary battery.

According to this application example, the electronic timepiece includes an information display unit for displaying multiple information items including the integrated hour display showing "time" (hour, minute, and second) integrated using the chronograph function and the charged capacity display indicating the residual capacity of the electric power accumulated in the secondary battery. In this manner, it is possible to visibly arrange the integrated hour display and the charged capacity display in limited space.

Application Example 10

In the electronic timepiece according to the application example described above, it is preferable that one of the multiple information display units is segmented into multiple sub-displays to display multiple information items, including an integrated hour sub-display to display elapsed time and a summer time sub-display to display a daylights saving time indicator related to the world time function.

According to this application example, the electronic timepiece includes an information display unit for displaying multiple information items including the integrated hour display showing "time" (hour, minute, and second) integrated using the chronograph function and the summer time display showing whether the summer time set using the world time function is ON or OFF. In this manner, it is possible to visibly arrange the integrated hour display and the summer time display in a limited space.

Application Example 11

In the electronic timepiece according to the application example described above, it is preferable that the external signal is a satellite signal, and one of the multiple information display units is segmented into multiple sub-displays to display multiple information items, including an integrated hour sub-display to display elapsed time and a reception prohibition sub-display to display a signal reception state of the satellite signal.

According to this application example, the electronic timepiece includes the an information display unit for displaying the multiple information items including the integrated hour display showing "time" (hour, minute, and second) integrated using the chronograph function and the reception prohibition display for displaying that the reception of the satellite signal is set to OFF using the world time function or for setting the reception of the satellite signal to OFF. In this manner, it is possible to visibly arrange the integrated hour display and the reception prohibition display in limited space.

Application Example 12

In the electronic timepiece according to the application example described above, it is preferable that the external signal is a satellite signal, and one of the information display units is segmented into multiple sub-displays to display multiple information items, including an integrated hour sub-display to display elapsed time related to the chronograph function and a reception mode sub-display to display a reception mode of the satellite signal.

According to this application example, the electronic timepiece includes an information display unit for displaying the multiple information items including the integrated hour display showing "time" (hour, minute, and second) integrated using the chronograph function and the reception mode display for displaying the reception mode of the satellite signal which is received immediately before using the world time function. In the reception mode display, it is possible to understand whether information obtained from the satellite signal is only the time information or both the time information and the position information. In this manner, it is possible to visibly arrange the integrated hour display and the reception mode display in limited space.

Application Example 13

In the electronic timepiece according to the application example described above, it is preferable that the external signal is a satellite signal, and one of the multiple information display units is segmented into multiple sub-displays to display multiple information items, including a captured satellite number sub-display for showing a number of navigation satellites from which the satellite signal can be received and a reception result sub-display for showing a reception result of the satellite signal.

According to this application example, the electronic timepiece includes an information display unit for displaying the multiple information items including the captured satellite number display for showing the number of navigation satellites from which the satellite signal can be received using the world time function and the reception result display for showing the reception result when the satellite signal is received using the world time function. In this manner, it is possible to visibly arrange the captured satellite number display and the reception result display in limited space.

Application Example 14

In the electronic timepiece according to the application example described above, it is preferable that the external signal is a satellite signal, and that one of the information display units is segmented into multiple sub-displays to display multiple information items, including a captured satellite number sub-display and a time-second sub-display for showing seconds information of the local time.

According to this application example, the electronic timepiece includes the information display unit for displaying the multiple information items including the captured satellite number display for showing the number of navigation satellites from which the satellite signal can be received using the world time function and time-second display showing the "second" of the local time (hour, minute, and second) received using the world time function. In this manner, it is possible to visibly arrange the captured satellite number display and the time-second display in limited space.

Application Example 15

In the electronic timepiece according to the application example described above, it is preferable that the external signal is a satellite signal, and that one of the information display units is segmented into multiple sub-displays to display multiple information items, including a time-second sub-display to display seconds information of the local time, and a reception result sub-display to display a reception result of the satellite signal.

According to this application example, the electronic timepiece includes the information display unit for combinedly displaying the multiple information items including the time-second display showing the "second" of the local time (hour, minute, and second) received using the world time function and the reception result display showing the reception result when the satellite signal is received using the world time function. In this manner, it is possible to visibly arrange the time-second display and the reception result display in limited space.

Application Example 16

In the electronic timepiece according to the application example described above, it is preferable that one of the multiple information display units is an integrated minute display to display in minutes time information related to the chronograph function.

According to this application example, in the electronic timepiece, the dial includes information display unit for displaying the multiple information items, and the second small timepiece which include the integrated hour display showing the "minute" of the time (hour, minute, and second) integrated using the chronograph function. In this manner, it is possible to visibly display multiple information items on the dial.

In the electronic timepiece according to the application example described above, it is preferable that the dial includes the second small timepiece, and a calendar display.

According to this configuration, in the electronic timepiece, the dial the information display unit for displaying the multiple information items, the second small timepiece which includes the integrated hour display showing the "minute" of the time (hour, minute, and second) integrated using the chronograph function, and the calendar display showing information such as the calendar date (date, month, and year) and the day. In this manner, it is possible to visibly display multiple information items on the dial.

In the electronic timepiece according to the application example described above, it is preferable that at least one of multiple sub-displays is disposed at a position overlapping a straight line connecting the position of 3 o'clock and the position of 9 o'clock on the dial.

According to this configuration, in the electronic timepiece, at least one of the first small timepiece and the second small timepiece is arranged at the position overlapping the straight line connecting the position of 3 o'clock and the position of 9 o'clock when one round of the scale disposed on the outer periphery of the dial is shown as 12 hours. In this manner, the small timepiece can be arranged at a well-balanced position in terms of design.

In the electronic timepiece according to the application example described above, it is preferable that at least one of the multiple first small timepieces and the second small timepiece is disposed at a position overlapping a straight line connecting the position of 12 o'clock and the position of 6 o'clock on the dial.

According to this configuration, in the electronic timepiece, at least one of the first small timepiece and the second small timepiece is arranged at the position overlapping the straight line connecting the position of 12 o'clock and the position of 6 o'clock when one round of the scale disposed on the outer periphery of the dial is shown as 12 hours. In this manner, the small timepiece can be arranged at a well-balanced position in terms of design.

In the electronic timepiece according to the application example described above, it is preferable that the calendar display is disposed in the direction of 4 o'clock from the center of the dial.

According to this configuration, in the electronic timepiece, the calendar display is arranged in the direction of 4 o'clock along the straight line connecting the center when one round of the scale disposed on the outer periphery of the dial is shown as 12 hours and the position of 4 o'clock. In this manner, without causing the calendar display to be mixed with the other information display, the calendar display can be arranged at a well-balanced position in terms of design. In addition, it is possible to improve visibility of the calendar display when a user wears the electronic timepiece on the left arm.

Application Example 17

An electronic timepiece according to this application example includes: a dial; a world time function that displays a local time by calculating positioning information and time information of a current location based on an external signal; and a chronograph function that determines an elapsed time starting from a user-specified time and displays the elapsed time. The dial includes a time display unit for displaying the local time and a chronograph display unit for displaying minute information of the elapsed time.

According to this application example, the electronic timepiece includes the world time function that displays the local time by receiving the external signal and calculating the position information and the time information of the current location, and the chronograph function that displays the integrated minute of the time. For example, in some cases, a country with a different time zone or a competition for competing the required time across a territorial boundary needs a record of the accurate local time at the start point and the end point of the competition and the required time. Even in this case, the electronic timepiece according to the application example displays the local time using the world time function, and displays the required time using the chronograph function. Accordingly, without using multiple measurement instruments, it is possible to measure both of these. Therefore, it is possible to provide the electronic timepiece including the world time function and the chronograph function which can obtain the local time and the required time using one measurement instrument.

In the electronic timepiece according to the application example described above, it is preferable that the external signal is a satellite signal.

According to this configuration, the electronic timepiece includes a function which receives the satellite signal transmitted from a navigation satellite as the external signal. In this manner, it is possible to provide the electronic timepiece including the world time function and the chronograph function which can obtain accurate position information and time information all over the world.

It is preferable that the electronic timepiece according to the application example described above includes a secondary battery which accumulates electric power.

According to this configuration, the electronic timepiece includes the secondary battery which accumulates the electric power for driving the electronic timepiece. The electronic timepiece including the world time function and the chronograph function can be continuously driven by charging the secondary battery with the electric power from the inside or the outside of the electronic timepiece.

In the electronic timepiece according to the application example described above, it is preferable that the integration display unit displays at least one of a summer time display related to the world time function, a charged capacity display of the secondary battery, a reception prohibition display of the satellite signal, a reception mode display of the satellite signal, a reception result display of the satellite signal, a captured satellite number display showing the number of navigation satellites from which the satellite signal can be received, a time-second display of the local time, a time-minute display of the local time, a time-hour display of the local time, a date display, and a calendar display.

According to this configuration, the integration display unit which displays anyone of the "hour", the "minute", and the "second" of the time integrated using the chronograph function displays at least one of the charged capacity display for displaying the residual capacity of the electric power accumulated in the secondary battery, the reception prohibition display of the satellite signal, the reception mode display for displaying the reception mode of the satellite signal received immediately before, the reception result display for displaying the reception result when the satellite signal is received, the captured satellite number display for displaying the number of navigation satellites from which the satellite signal can be received, the time-second display of the local time, the time-minute display of the local time, the time-hour display of the local time, the date display for displaying the current date, and the calendar display for displaying the current day. In this manner, it is possible to visibly arrange multiple display items related to the world time function and the chronograph function in a limited space. Therefore, it is possible to provide the electronic timepiece including the world time function and the chronograph function.

Application Example 18

In the electronic timepiece according to the application example described above, it is preferable that the dial includes the integration display unit.

According to this application example, in the electronic timepiece, the dial includes the integration display unit which displays anyone of the "hour", the "minute", and the "second" of the time integrated using the chronograph function. In this manner, without causing the integration display unit to be mixed with the other information display, it is possible to visibly arrange the integration display unit. Therefore, it is possible to provide the electronic timepiece including the world time function and the chronograph function.

Application Example 19

In the electronic timepiece according to the application example described above, it is preferable that it further include a secondary battery that accumulates electric power, and that the external signal is a satellite signal received with a satellite signal reception function. Further preferably, a composite display unit is segmented into the chronograph display unit and at least one of a summer time sub-display to display daylights saving time related to the world time function, a charged capacity sub-display to display a charge level of the secondary battery, a reception prohibition sub-display to display a reception state of the satellite signal reception function, a reception mode sub-display to display an operational mode of the satellite signal reception function, a reception result sub-display to display reception results of the satellite signal reception function, a captured satellite number sub-display showing a number of satellites from which the satellite signal can be received, a time-second sub-display to display a seconds component of the local time, a time-minute sub-display to display minute information of the local time, a time-hour sub-display to display hour information of the local time, a date sub-display to display date information, and a calendar sub-display to display calendar information.

According to this application example, the dial of the electronic timepiece includes the integration display unit for displaying any one of the "hour", the "minute", and the "second" of the time integrated using the chronograph function, and includes at least one of the summer time display showing whether the summer time display is ON or OFF, the charged capacity display for displaying the residual capacity of the electric power accumulated in the secondary battery, the reception prohibition display of the satellite signal, the reception mode display for displaying the reception mode of the satellite signal received immediately before, the reception result display for displaying the reception result when the satellite signal is received, the captured satellite number display for displaying the number of navigation satellites from which the satellite signal can be received, the time-second display of the local time, the time-minute display of the local time, the time-hour display of the local time, the day display for displaying the current day, and the calendar display for displaying the current date. In this manner, it is possible to arrange multiple display items related to the world time function and the chronograph function in a limited space by allowing aesthetic appearance to be compatible with visibility. Therefore, it is possible to provide the electronic timepiece including the world time function and the chronograph function.

In the electronic timepiece according to the application example described above, it is preferable that the segmented display be provided at a position overlapping a straight line connecting the position of 3 o'clock and the position of 9 o'clock on the dial.

According to this configuration, in the electronic timepiece, the segmented display is arranged at the position overlapping the straight line connecting the position of 3 o'clock and the position of 9 o'clock when one round of the scale disposed on the outer periphery of the dial is shown as 12 hours. In this manner, the segmented display can be arranged at a well-balanced position in terms of design. Therefore, it is possible to provide the electronic timepiece which includes the world time function and the chronograph function and whose design is improved.

In the electronic timepiece according to the application example described above, it is preferable that the segmented display is provided at a position overlapping a straight line connecting the position of 12 o'clock and the position of 6 o'clock on the dial.

According to this configuration, in the electronic timepiece, the segmented display is arranged at the position overlapping the straight line connecting the position of 12 o'clock and the position of 6 o'clock when one round of the scale disposed on the outer periphery of the dial is shown as 12 hours.

In this manner, the segmented display can be arranged at a well-balanced position in terms of design. Therefore, it is possible to provide the electronic timepiece which includes the world time function and the chronograph function and whose design is improved.

It is preferable that the electronic timepiece according to the application example described above has a summer time setting function.

According to this configuration, the electronic timepiece includes the function of setting the summer time using the summer time display. In this manner, it is possible to accurately display the local time in a country or a territory which adopts the summertime system. Therefore, it is possible to provide the electronic timepiece including the world time function and the chronograph function which display the local time including a time difference during the summer time.

In the electronic timepiece according to the application example described above, it is preferable that information showing the month and the date is displayed on a calendar display unit.

According to this configuration, the electronic timepiece includes the calendar display unit which displays the information including the "month" and the "date" in the Christian era. This enables a user to easily recognize and record the date and the local time. In addition, based on the record, a user can understand whether or not the displayed local time includes a time difference caused by the summer time. Therefore, it is possible to provide the electric timepiece including the calendar display for displaying the information including the "month" and the "date" in the Christian era, the world time function, and the chronograph function.

The electronic timepiece includes the dial, the segmented display disposed on the dial, and the world time function which calculates position information and time information of the current location based on the satellite signal transmitted from the satellite and displays the local time. The segmented display includes at least two display items of a captured satellite number display for displaying the number of the captured satellites, a reception result display of the satellite signal, and a time-second display for displaying the second of the local time.

According to this configuration, the electronic timepiece is a wrist timepiece which includes multiple functions including the world time function for calculating the position information and the time information of the current location by receiving the satellite signal transmitted from the satellite and for displaying the local time. The dial of the electronic timepiece includes a circular or arcuate segmented display which visibly displays the multiple functions included in the electronic timepiece. In the electronic timepiece, the segmented display can include at least two display items of the captured satellite number display for displaying the number of the captured satellites, the reception result display of the satellite signal, and the time-second display for displaying the second of the local time. In the electronic timepiece, the multiple functions are displayed using the segmented display. In this manner, it is possible to allow visibility of the display to be compatible with aesthetic appearance obtained by design using the segmented display. Therefore, it is possible to provide the electronic timepiece which can display the multiple functions by improving the visibility and the aesthetic appearance thereof.

It is preferable that the electronic timepiece described above includes the chronograph function which integrates and displays the time, and the segmented display includes integration display of the time.

According to this configuration, the electronic timepiece is a wrist timepiece which includes multiple functions including the world time function and the chronograph function (stopwatch function) for integrating and displaying the time. In the electronic timepiece, the segmented display can include at least two display items among the captured satellite number display, the reception result display, and the time-second display, and includes the integration display of the time. In the electronic timepiece, the multiple functions are displayed using the segmented display. In this manner, it is possible to allow visibility of the display to be compatible with aesthetic appearance obtained by design using the segmented display. Therefore, it is possible to provide the electronic timepiece which can display the multiple functions by improving the visibility and the aesthetic appearance thereof.

In the electronic timepiece described above, it is preferable that the timepiece includes a secondary battery which accumulates electric power, and the segmented display includes at least one of the summer time display, the reception mode display of the satellite signal, the charged capacity display of the secondary battery, and the date display.

According to this configuration, the electronic timepiece is a wrist timepiece including the secondary battery which accumulates electric power supplied from the inside or the outside of the electronic timepiece, and the world time function. In the electronic timepiece, the segmented display can include at least two display items among the captured satellite number display, the reception result display, and the time-second display, and at least one of the summer time display, the reception mode display, the charged capacity display, and the date display. In addition, in the electronic timepiece including the world time function and the chronograph function, the segmented display can include at least two display items among the captured satellite number display, the reception result display, and the time-second display, and at least one of the summer time display, the reception mode display, the charged capacity display, and the date display, and can include the integration display. In the electronic timepiece, the multiple functions are displayed using the segmented display. In this manner, it is possible to allow visibility of the display to be compatible with aesthetic appearance obtained by design using the segmented display. Therefore, it is possible to provide the electronic timepiece which can display the multiple functions by improving the visibility and the aesthetic appearance.

In the electronic timepiece described above, it is preferable that the segmented display is disposed at a position overlapping a straight line connecting the center of the dial and the position of 9 o'clock.

According to this configuration, the electronic timepiece is provided with the segmented display at the position overlapping the straight line connecting the center of the dial and the position of 9 o'clock when the outer periphery of the dial is shown as 12 hours. In general, since a user wears the electronic timepiece of the wrist timepiece type on the left arm, visibility is good in the direction of 3 o'clock in the straight line visually connecting the position of 12 o'clock and the position of 6 o'clock on the dial. While the electronic timepiece is normally used, the segmented display including display of less frequently used functions is arranged at the position overlapping the straight line connecting the center of the dial and the position of 9 o'clock. In this manner, it is possible to arrange the display of very frequently used functions such as the time display and the calendar display in the direction of 3 o'clock in the straight line connecting the position of 12 o'clock and the position of 6 o'clock on the dial. Accordingly, the electronic timepiece can be arranged so that the display of the very frequently used functions is very visible. Therefore, it is possible to provide the electronic timepiece which can display multiple functions while the visibility of very frequently used information display is maintained.

The electronic timepiece includes the dial, the segmented display disposed on the dial, and the world time function which calculates position information and time information of the current location based on the satellite signal transmitted from the satellite and displays the local time. The segmented display includes a captured satellite number display for displaying the number of the captured satellites. The captured satellite number display is provided with numbers from "zero" to "eleven" which divide the outer periphery of the segmented display into twelve sections.

According to this configuration, the electronic timepiece is a wrist timepiece that includes multiple functions including the world time function which displays the local time by receiving the satellite signal transmitted from the satellite and calculating the position information and the time information of the current location. The dial of the electronic timepiece includes a circular or arcuate segmented display which visibly displays the multiple functions included in the electronic timepiece. The captured satellite number display for displaying the number of the captured satellites is disposed on the outer periphery of the segmented display. The captured satellite number display is provided with numbers from "zero" to "eleven" which divide the outer periphery of the segmented display into twelve sections. The electronic timepiece can display the number of the captured satellites using the numbers provided on the outer periphery of the segmented display. Accordingly, it is possible to provide display of the other functions on the inner periphery of the segmented display. In the electronic timepiece, the multiple functions are displayed using the segmented display. In this manner, it is possible to allow visibility of the display to be compatible with aesthetic appearance of the timepiece which is obtained by design using the segmented display. Therefore, it is possible to provide the electronic timepiece which can display the multiple functions by improving the visibility and the aesthetic appearance thereof.

In the electronic timepiece described above, it is preferable that the segmented display includes at least one of the reception result display of the satellite signal and the time-second display for displaying the second of the local time.

According to this configuration, in the electronic timepiece, the segmented display can include at least one display including at least one display item of the captured satellite number display, the reception result display of the satellite signal, and the time-second display for displaying the second of the local time. In the electronic timepiece, the multiple functions are displayed using the segmented display. In this manner, it is possible to allow visibility of the display to be compatible with aesthetic appearance of the timepiece which is obtained by design using the segmented display. Therefore, it is possible to provide the electronic timepiece which can display the multiple functions by improving the visibility and the aesthetic appearance thereof.

In the electronic timepiece described above, it is preferable that the timepiece further includes a chronograph function which integrates and displays time, and the segmented display includes integration display of the time.

According to this configuration, the electronic timepiece is a wrist timepiece including multiple functions including the world time function and the chronograph function (stopwatch function) which integrates and displays the time. In the electronic timepiece, the segmented display can include at least one display item among the captured satellite number display, the reception result display, and the time-second display, and can include the integration display of the time. In the electronic timepiece, the multiple functions are displayed using the segmented display. In this manner, it is possible to improve visibility of the display and aesthetic appearance of the timepiece which is obtained by design using the segmented display. Therefore, it is possible to provide the electronic timepiece which can display the multiple functions by allowing the visibility and the aesthetic appearance to be compatible with each other.

In the electronic timepiece described above, it is preferable that the timepiece further includes a secondary battery which accumulates electric power, and the segmented display includes at least one display item among the summer time display, the reception mode display of the satellite signal, the charged capacity display of the secondary battery, and the date display.

According to this configuration, the electronic timepiece is a wrist timepiece including the secondary battery which accumulates the electric power supplied from the inside or the outside of the electronic timepiece, and the world time function. In the electronic timepiece, the segmented display can include at least one display item among the captured satellite number display, the reception result display, and the time-second display, and can include at least one display item among the summer time display, the reception mode display of the satellite signal, the charged capacity display of the secondary battery, and the date display. In addition, in the electronic timepiece including the chronograph function, the segmented display can include at least one display item among the captured satellite number display, the reception result display, and the time-second display, and can include at least one display item among the summer time display, the reception mode display, the charged capacity display, and the date display, and can include the integration display. In the electronic timepiece, the multiple functions are displayed using the segmented display. In this manner, it is possible to improve visibility of the display and aesthetic appearance of the timepiece which is obtained by design using the segmented display. Therefore, it is possible to provide the electronic timepiece which can display the multiple functions by allowing the visibility and the aesthetic appearance to be compatible with each other.

In the electronic timepiece described above, it is preferable that the segmented display is disposed at a position overlapping a straight line connecting the center of the dial and the position of 9 o'clock.

According to this configuration, the electronic timepiece is provided with the segmented display at the position overlapping the straight line connecting the center of the dial and the position of 9 o'clock when the outer periphery of the dial is shown as 12 hours. In general, since a user wears the electronic timepiece of the wrist timepiece type on the left arm, visibility is good in the direction of 3 o'clock in the straight line visually connecting the position of 12 o'clock and the position of 6 o'clock on the dial. While the electronic timepiece is normally used, the segmented display including display of less frequently used functions is arranged at the position overlapping the straight line connecting the center of the dial and the position of 9 o'clock. In this manner, it is possible to arrange display of very frequently used functions such as the time display and the calendar display in the direction of 3 o'clock in the straight line connecting the position of 12 o'clock and the position of 6 o'clock on the dial. The electronic timepiece can be arranged so that the display of the very frequently used functions is very visible. Therefore, it is possible to provide the electronic timepiece which can display multiple functions while the visibility of very frequently used information display is maintained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, specific embodiments of the invention will be described with reference to the drawings. Additionally, Japanese Patent Application Nos. 2014-62290, filed Mar. 25, 2014; 2014-62291, filed Mar. 25, 2014; 2014-43600, filed Mar. 6, 2014; 2014-43601, filed Mar. 6, 2014; and 2014-43602, filed Mar. 6, 2014 are herein expressly incorporated by reference in their entirety.

First Embodiment

Schematic Configuration of GPS Including Electronic Timepiece

Figure 1:
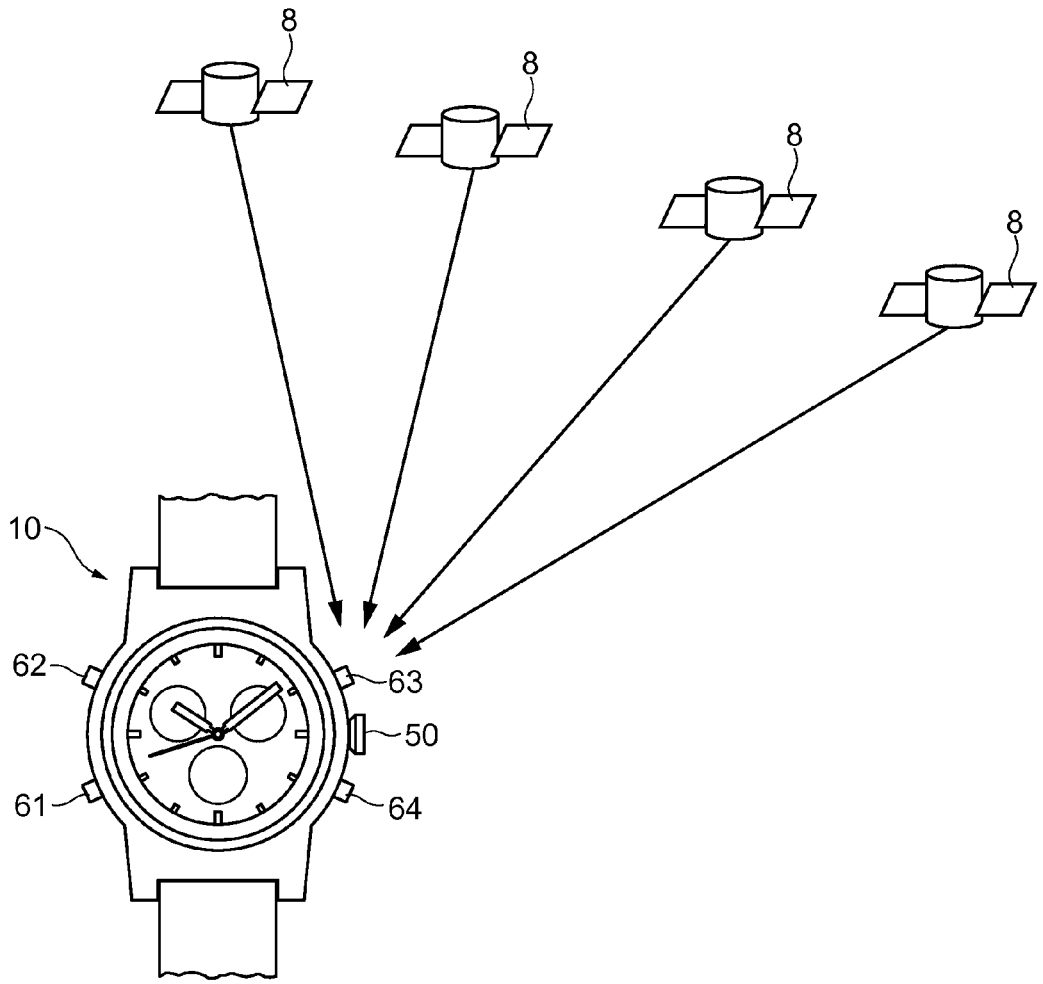
FIG. 1 is a schematic view illustrating an electronic timepiece according to a first embodiment of the invention.

FIG. 1 is a schematic view illustrating an electronic timepiece 10 according to a first embodiment of the invention. First, an overview of GPS in which the electronic timepiece 10 obtains position information and time information of the current location using a radio wave as an external signal will be described.

The electronic timepiece 10 is a wrist timepiece which receives the radio wave (satellite signal) from a GPS satellite 8 and corrects the internal time, and displays time on a surface (hereinafter, referred to as a front surface) opposite to an arm contacting side surface (hereinafter, referred to as a rear surface). The GPS satellite 8 is a navigation satellite following the predetermined orbit of the earth in space, and transmits a superimposed navigation message to the ground on the earth using the radio wave (L1 wave) of 1.57542 GHz. In the following description, the radio wave of 1.57542 GHz in which the navigation message is superimposed is referred to as a satellite signal. The satellite signal is a circularly polarized wave of a right handed polarized wave.

Currently, approximately 31 GPS satellites 8 (in FIG. 1, only four are illustrated) are present. In order to identify which GPS satellite 8 transmits the satellite signal, each GPS satellite 8 superimposes a unique pattern of a 1023 chip (cycle of 1 ms) which is called a Coarse/Acquisition code (C/A code) onto the satellite signal. The C/A code is configured so that each chip is either +1 or −1, and appears as a random pattern. Therefore, it is possible to detect the C/A code superimposed onto the satellite signal by correlating the satellite signal with each C/A code.

The GPS satellite 8 includes an atomic clock mounted thereon, and the satellite signal includes very accurate GPS time information measured by the atomic clock. In addition, a control segment on the ground measures a minor time difference of the atomic clock mounted on each GPS satellite 8, and the satellite signal includes a time correction parameter for correcting the time difference. The electronic timepiece 10 receives the satellite signal transmitted from one of the GPS satellites 8, and adopts accurate time obtained by using the GPS time information contained therein and the time correction parameter (time information) as internal time.

The satellite signal also includes orbit information indicating a position of the orbit of the GPS satellite 8. The electronic timepiece 10 can perform positioning calculation by using the GPS time information and the orbit information. The positioning calculation is performed on the assumption that the internal time of the electronic timepiece 10 includes a certain degree of error.

That is, the time error also becomes unknown in addition to parameters x, y, and z for identifying a three-dimensional position of the electronic timepiece 10. Therefore, the electronic timepiece 10 generally receives the satellite signals respectively transmitted from four or more GPS satellites 8, and performs the positioning calculation using the GPS time information contained therein and the orbit information so as to obtain position information of the current location.

Schematic Configuration of Electronic Timepiece

Figure 2:
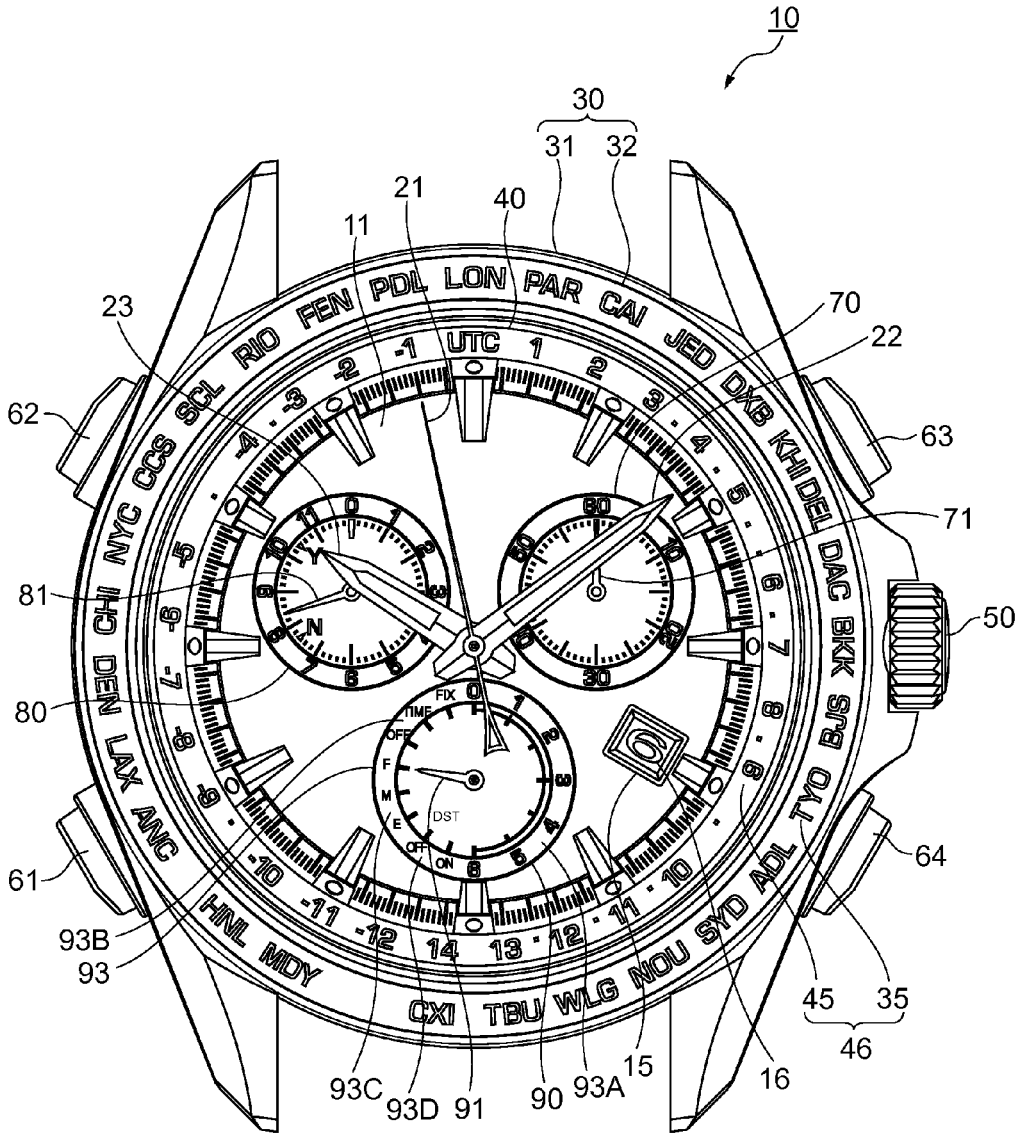
FIG. 2 is a plan view when the electronic timepiece according to the first embodiment is viewed from a front surface side.
Figure 3:
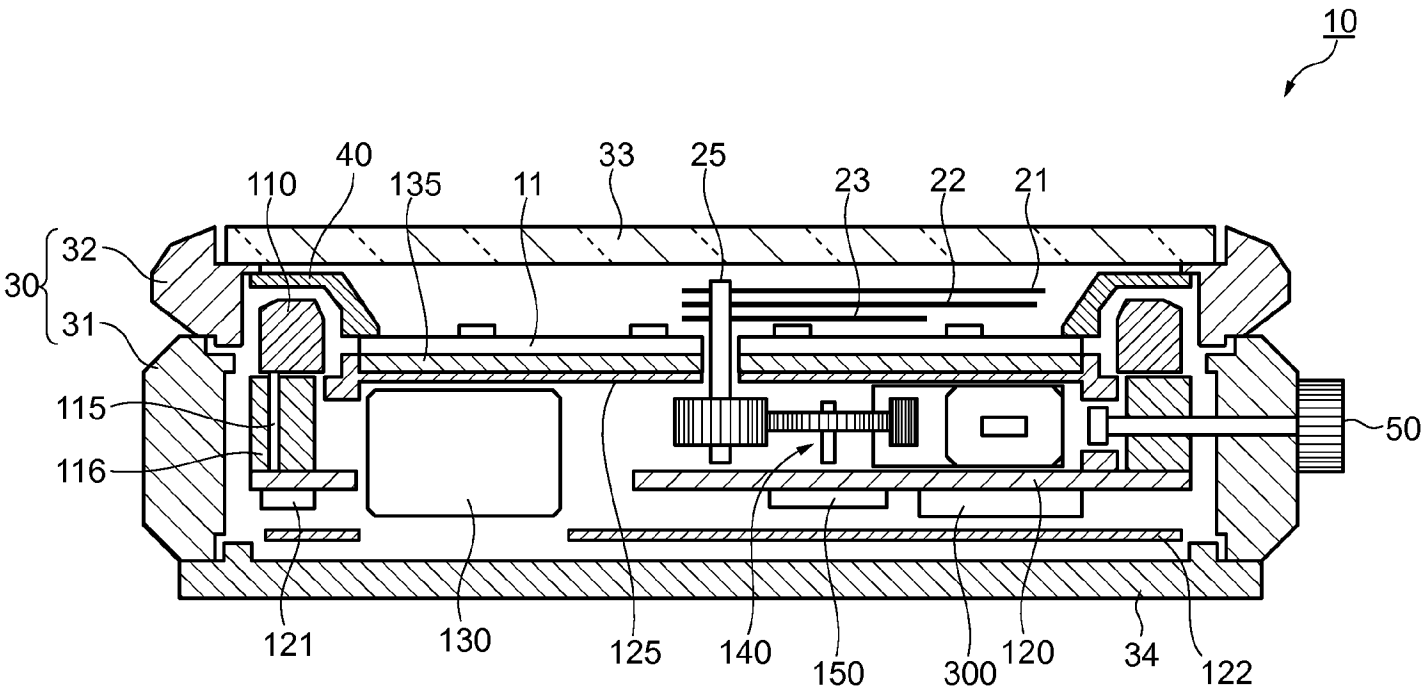
FIG. 3 is a cross-sectional view illustrating the electronic timepiece according to the first embodiment.

FIG. 2 is a plan view when the electronic timepiece is viewed from a front surface side, and FIG. 3 is a partial cross-sectional view illustrating a schematic configuration of the electronic timepiece. Although details will be described later, the electronic timepiece 10 according to the present embodiment includes a first function unit which executes a chronograph function serving as a time measurement function (first function) and a second function unit which executes a reception function of the satellite signal (second function).

As illustrated in FIGS. 2 and 3, the electronic timepiece 10 includes an exterior case 30, a cover glass 33, and a case back 34. The exterior case 30 is configured so that a bezel 32 formed of ceramic is fitted to a cylindrical case 31 formed of metal. A disc-shaped dial 11 serving as a time display portion is arranged on an inner peripheral side of the bezel 32 via an annular dial ring 40 formed of plastic.

The dial 11 includes indicating hands 21, 22, and 23. In addition, the dial 11 includes a circular first small window 70 and an indicating hand 71 in the direction of 2 o'clock from the center, a second small circular window 80 and an indicating hand 81 in the direction of 10 o'clock from the center, a third small circular window 90 (corresponding to a small window according to the invention) and an indicating hand (corresponding to an indicating hand according to the invention) in the direction of 6 o'clock from the center, and a small rectangular calendar window 15 in the direction of 4 o'clock from the center. The dial 11, the indicating hands 21, 22, and 23, the first small window 70, the second small window 80, the third small window 90, and the small calendar window 15 are visible through the cover glass 33.

A calendar indicator (date indicator) 16 is arranged on a rear surface side of the dial 11, and the calendar indicator 16 is visible through the small calendar window 15.

The respective small windows 70, 80, and 90 are not limited to these positions, and may be disposed at different respective positions.

A side surface of the exterior case 30 includes an A-button 61 at the position in the direction of 8 o'clock from the center of the dial 11, a B-button 62 at the position in the direction of 10 o'clock from the center of the dial 11, a C-button 63 at the position in the direction of 2 o'clock from the center of the dial 11, a D-button 64 at the position in the direction of 4 o'clock from the center of the dial 11, and a crown 50 at the position in the direction of 3 o'clock from the center of the dial 11. The A-button 61, the B-button 62, the C-button 63, the D-button 64, and the crown 50 are operated so as to output an operation signal in response to the operation.

In the embodiment, the C-button 63 and the D-button 64 serve as a first operation unit 157A which performs an operation related to the first function (chronograph function), and the A-button 61 and the B-button 62 serve as a second operation unit 157B which performs an operation related to the second function (reception function of the satellite signal).

The A-button 61 and the B-button 62 are disposed on a left side surface of the exterior case 30 which is located at a position close to a reception state display region 93B (region having a scale for indicating a reception state) of a scale display unit 93 of the third small window 90 (to be described later), and the C-button 63 and the D-button 64 are disposed on a right side surface of the exterior case 30 which is located at a position close to a measured time display region 93A (region having a scale of a chronograph) of the scale display unit 93.

Therefore, the first operation unit 157A (the C-button 63 and the D-button 64) is arranged at the position close to the measured time display region 93A from the reception state display region 93B, that is, on the measured time display region 93A side. In addition, the second operation unit 157B (the A-button 61 and the B-button 62) is arranged at the position close to the reception state display region 93B from the measured time display region 93A, that is, on the reception state display region 93B side.

As illustrated in FIG. 3, the electronic timepiece 10 has two openings in the metallic exterior case 30. The opening on the front surface side is closed by the cover glass 33 via the bezel 32, and the opening on the rear surface side is closed by the metallic case back 34.

An inner side of the exterior case 30 includes the dial ring 40 attached to an inner periphery of the bezel 32, the light transmitting dial 11, an indicating hand axle 25 penetrating the dial 11, the indicating hands 21, 22, 23, 71, 81, and 91 which turn around the indicating hand axle 25, the calendar indicator 16, and a drive mechanism 140 which drives the indicating hands 21, 22, 23, 71, 81, and 91 and the calendar indicator 16.

The indicating hand axle 25 passes through the center of the exterior case 30 in a plan view, and is disposed along the central axis extending in the forward and rearward direction.

The dial ring 40 includes a flat plate section in which an outer peripheral end comes into contact with an inner peripheral surface of the bezel 32 and one surface is parallel to the cover glass 33, and a tilting section which tilts to the dial 11 side so that an inner peripheral end comes into contact with the dial 11. The dial ring 40 has an annular shape in a plan view, and has a bowl shape in a cross-sectional view, and a doughnut-shaped accommodation space is formed by the flat plate section and the tilting section of the dial ring 40 and the inner peripheral surface of the bezel 32. An annular antenna body 110 is accommodated inside the accommodation space.

This antenna body 110 is formed in such a way that an annular dielectric is used as a base material and a metallic antenna pattern is printed thereon by means of plating or silver paste. The antenna body 110 is arranged on the outer periphery of the dial 11, and is covered with the dial ring 40 arranged on the inner peripheral surface side of the bezel 32 and further formed of plastic and the cover glass 33. Accordingly, favorable reception can be ensured. The dielectric can be formed by mixing a dielectric material such as titanium oxide used at high frequency into a resin. In this manner, in cooperation with wavelength shortening of the dielectric, the antenna can be further miniaturized.

The dial 11 is a circular plate member which displays the time inside the exterior case 30, is formed of a light transmitting material such as plastic, includes the indicating hands 21, 22, and 23 between the cover glass 33 and the dial 11, and is arranged inside the dial ring 40.

A solar panel 135 for performing photovoltaic power generation is provided between the dial 11 and a main plate 125 to which a drive mechanism 140 is attached. The solar panel 135 is a circular flat plate in which multiple solar cells (photovoltaic elements) converting light energy into electrical energy (electric power) are connected in series. In addition, the solar panel 135 also has a sunlight detection function. The dial 11, the solar panel 135, and the main plate 125 respectively have a hole through which the indicating hand axle 25, and each indicating hand axle (not illustrated) of the indicating hand 71 of the first small window 70, the indicating hand 81 of the second small window 80, and the indicating hand 91 of the third small window 90, and have an opening for the small calendar window 15.

The drive mechanism 140 is attached to the main plate 125, and is covered with a circuit board 120 from the rear surface side. The drive mechanism 140 includes a step motor and a train wheel such as a gear, and the step motor rotates the indicating hand axle 25 via the train wheel, thereby driving each indicating hand configuring a display device 141. The drive mechanism 140 includes first to sixth drive mechanisms.

That is, the first drive mechanism drives the indicating hand (minute hand) 22 and the indicating hand (hour hand) 23 which respectively indicate the "minute" and the "hour" of an internal timepiece (current time). In addition, the indicating hand 21, the indicating hand 71 of the first small window 70, the indicating hand 81 of the second small window 80, and the indicating hand 91 of the third small window 90 which are illustrated in FIG. 2 are also driven by the same mechanism (not illustrated). That is, the second drive mechanism drives the indicating hand (chronograph second hand) 21 which indicates the "second" of the chronograph function. The third drive mechanism drives the indicating hand (chronograph minute hand) 71 which indicates the "minute" of the chronograph function. The fourth drive mechanism drives the indicating hand (small second hand) 81 which indicates the "second" of the internal timepiece. The fifth drive mechanism drives the indicating hand (chronograph hour hand) 91 which indicates the "hour" of the chronograph function. The sixth drive mechanism drives the calendar indicator 16 which is visible through the small calendar window 15.

The circuit board 120 includes a reception unit (GPS module) 121 serving as reception means of the invention and a control device 300. The case back 34 side (rear surface side) on which the reception unit 121 and the control device 300 of the circuit board 120 are disposed includes a circuit holder 122 for covering these circuit components. In addition, a secondary battery 130 such as a lithium ion battery is disposed between the main plate 125 and the case back 34, and is charged with electric power generated by the solar panel 135.

The circuit holder 122 has an opening for accommodating the secondary battery 130 inside the exterior case 30. In addition, a main plate support ring 116 formed annularly is arranged between the circuit board 120 and the antenna body 110.

The electric power is supplied to the antenna body 110 through a power supply point, and an antenna connection pin 115 is connected to the power supply point. The antenna connection pin 115 is a metallic pin-shaped connector, which is arranged so as to penetrate the main plate support ring 116, and is in contact with the circuit board 120. In this manner, the circuit board 120 and the antenna body 110 inside the accommodation space are connected to each other using the antenna connection pin 115.

Display Mechanism of Electronic Timepiece

As illustrated in FIG. 2, a scale which divides the outer periphery into 60 portions and further a one-fifth scale which divides the scale into five portions are marked on the outermost periphery of the dial 11. Using these scales, the indicating hand 21 indicates the "second" of the chronograph function, the indicating hand 22 indicates the "minute" of the internal timepiece, and the indicating hand 23 indicates the "hour" of the internal timepiece. The chronograph function can be used by operating the C-button 63 and the D-button 64.

A scale which divides the outer periphery into 60 portions and ten-digit numbers from "10" to "60" are marked on the outer periphery of the circular first small window 70 which is disposed in the dial 11. The indicating hand 71 indicates the "minute" of the chronograph function using the scale.

A scale which divides the outer periphery into 60 portions and numbers from "0" to "11" are marked on the outer periphery of the second small circular window 80 which is disposed in the dial 11. The indicating hand 81 indicates the "second" of the internal timepiece using the scale.

A letter "Y" is marked at the position of 52 seconds in the second small window 80, and a letter "N" is marked at the position of 38 seconds. These letters correspond to display indicating a reception result which is disposed in the small window of the invention, and indicate an acquisition result of various information items based on the satellite signal received from the satellite (Y: reception (acquisition) successful, N: reception (acquisition) in failure) and setting for automatic reception of the satellite signal (Y: automatic reception ON, N: automatic reception OFF). If a user operates the B-button 62 and thus the mode is shifted to a display mode of the reception result, the indicating hand 81 indicates either "Y" or "N", and displays the acquisition result of the satellite signal. In addition, the user operates the A-button 61 and the B-button 62 so as to align the indicating hand 81 with "Y" or "N". In this manner, it is possible to set ON/OFF of the automatic reception of the satellite signal.

The second small window 80 is located in the left half region of the dial 11. Accordingly, even when the wide indicating hands 22 and 23 are located so as to overlap the second small window 80, the letters "Y" and "N" are arranged near the outer edge in the left half region of the second small window 80 so as to easily be able to recognize the letters "Y" and "N".

In the embodiment, the mark "Y" is disposed at the position of 52 seconds, and the mark "N" is disposed at the position of 38 seconds, but the positions are not limited thereto. Depending on the position for disposing the small window including the reception result display, it is preferable to dispose the marks "Y" and "N" at an easily visible position. For example, when the second small window 80 is located in the right half region of the dial 11, the letters "Y" and "N" may be arranged near the outer edge of the right half region of the second small window 80.

Description will be made with regard to a scale display unit 93 which is disposed in the dial 11 and is an annular display region displayed on the outer periphery of the circular third small window 90. In the following description of the range of the outer periphery, although a "direction of n o'clock" (n is an arbitrary natural number) will be used, this direction represents a direction when the circular outer periphery is viewed from the center of the third small window 90.

A scale which divides a measured time display region 93A into six portions and numbers from "zero" to "six" is marked in a region from the direction of 0 o'clock (12 o'clock) to the direction of 6 o'clock of the third small window 90 in the scale display unit 93 (hereinafter, referred to as the measured time display region (first display region) 93A). That is, the measured time display region 93A of the scale display unit 93 is disposed on the right side based on a virtual line connecting 0 o'clock (12 o'clock) and 6 o'clock in the scale display unit 93. The third small window 90 is disposed on a side at the position of 6 o'clock in the dial 11. Accordingly, the virtual line connecting 12 o'clock and 6 o'clock in the timepiece overlaps the virtual line connecting 0 o'clock and 6 o'clock in the scale display unit 93. Therefore, the measured time display region 93A is disposed on the right side based on the virtual line connecting 12 o'clock and 6 o'clock in the time piece. The indicating hand 91 indicates the "time" of the chronograph function serving as the first function (time measurement function) by using the scale of the measured time display region 93A. The chronograph function enables the time to be measured for 59 seconds, 59 minutes and five hours by using the indicating hands 21, 71, and 91.

Alphabet letters "DST" and "ON and OFF" are marked in a region in the direction from 6 o'clock to 7 o'clock in the third small window 90 in the scale display unit 93 (hereinafter, referred to as a summer time display region (fourth display region) 93D). Daylight saving time (DST) means summertime. The alphabet letters "ON and OFF" represent setting for the summer time (DST: summer time ON, O: summer time OFF). A user operates the crown 50 and the B-button 62 so as to align the indicating hand 91 with "ON" or "OFF". In this manner, it is possible to set the summer time to ON or OFF in the electronic timepiece 10.

That is, the summer time display region 93D is disposed on the lower side of a voltage state display region 93C in the left half region of the scale display unit 93 (to be described later).

Letters "E", "M", and "F" (scales) are marked along the circumference in a region in a direction from 7 o'clock to 9 o'clock in the third small window 90 in the scale display unit 93 (hereinafter, referred to as the voltage state display region (third display region) 93C). Here, the scale "F" is an abbreviation of "Full", the scale "M" is an abbreviation of "Middle", and the scale "E" is an abbreviation of "Empty". These letters represent a power indicator of the secondary battery 130 serving as a power supply, and the indicating hand 91 indicates any one of "E", "M" and "F" in response to the battery residual capacity.

As illustrated in FIG. 2, among "E", "M", and "F" in the voltage state display region 93C, display "E" in which the voltage state of the secondary battery is lowest is arranged in the direction of approximately 7 o'clock, display "F" in which the voltage state of the secondary battery 130 is highest is arranged in the direction of approximately 9 o'clock, and display "M" is arranged therebetween. That is, in the voltage state display region 93C, as the indicating hand 91 progressively moves clockwise, the respective letters are arrayed side by side in the order of "E, M, and F" so that the voltage state becomes higher.

Display related to a satellite signal reception function serving as the second function is shown in a region in the direction from 10 o'clock to 12 o'clock in the third small window 90 in the scale display unit 93 (hereinafter, referred to as a reception state display region (second display region) 93B). That is, the word "OFF" is marked in the reception state display region 93B in the direction of 10 o'clock. The letters display a flight mode (reception prohibition mode). During takeoff and landing of aircraft, reception of the satellite signal is prohibited by Aviation Law. In addition, the word "TIME" and the word "FIX" are marked in the reception state display region 93B. These letters represent a reception mode of the satellite signal. The word "TIME" indicates a time measurement mode for receiving GPS time information and correcting the internal time, and the word "FIX" indicates a positioning mode for receiving the GPS time information and orbit information and calculating position information.

As illustrated in FIG. 2, respective symbols in the reception state display region 93B, the mark "OFF" for not receiving the satellite signal is arranged in the direction of approximately 10 o'clock in the reception state display region 93B, the mark "FIX" representing that the time period for receiving the satellite signal is longest (e.g. the satellite reception operation is longest due receiving both timing and position information) is arranged in the direction of approximately 11 o'clock in the reception state display region 93B, and the mark "TIME" representing that the time period for receiving the satellite signal is relatively short (e.g. the TIME operation, which receives only time correction information, is shorter than the FIX reception operation, which receives both time correction and position information) is arranged therebetween. That is, in the reception state display region 93B, as the indicating hand 91 progressively moves clockwise, the respective letters are arrayed side by side in the order of "OFF, TIME, and FIX" so that the time period for receiving the satellite signal (e.g. the time required for the corresponding satellite reception operations) becomes longer.

As described above, the reception state display region 93B of the scale display unit 93 is disposed on the left side based on the virtual line connecting 12 o'clock and 6 o'clock in the timepiece (virtual line connecting 0 o'clock and 6 o'clock in the scale display unit 93). That is, in the embodiment, the measured time display region 93A is disposed on the right side of the above-described virtual line, and the voltage state display region 93C, the summer time display region 93D, and the reception state display region 93B which are regions other than the measured time display region 93A are disposed on the left side. In addition, the reception state display region 93B and the summer time display region 93D are disposed on the left side of the above-described virtual line so as to interpose the voltage state display region 93C.

The small calendar window 15 is disposed in an opening section which is rectangularly open in the dial 11, and numbers of the date indicator are visible through the opening section. The numbers represent the "date" in the date, the month, and the year.

Here, a relationship between the Universal Time Coordinated (UTC), a time difference, the standard time, and a time zone will be described.

The time zone represents a territory which uses a local standard time common throughout the territory, and currently, 40 time zones are represented. Unless otherwise specified, the term "stand time" will hereinafter refer to the local standard time of given territory (i.e. corresponding to any of the 40 represented time zones). The respective time zones are distinguished from each other by the time difference between a given standard time and the UTC. For example, Japan belongs to a time zone of plus nine hours, which identifies its standard time as being nine hours ahead of the UTC. The standard time used in the respective time zones can be obtained using the UTC and the time difference between the UTC and the standard time.

As described above, the scale divided into 60 portions and indicating the minute and the second is engraved on the dial 11. Time difference information 45, which shows the time difference between the Universal Time Coordinated (UTC) and the standard time of different territories, is marked along the scale by using numbers, and symbols other than the numbers, in the dial ring 40 surrounding the outer peripheral section of the dial 11. The time difference information 45 specified in numbers represents a time difference as an integer whole (e.g. in whole hours), and the time difference information 45 given in symbols represents a time difference other than an integer whole (e.g. in fractions of an hour). The time difference between the internal time indicated by the indicating hands 22, 23, and 81 and the UTC can be confirmed using the time difference information 45 indicated by the indicating hand 21 through the operation of the crown 50.

In the bezel 32 disposed around the dial ring 40, city information 35 showing a representative city name in a given time zone (whose standard time is defined by the corresponding time difference information 45 marked in the dial ring 40) is marked together with the corresponding time difference information 45. Here, the marks of the time difference information 45 and the city information 35 are referred to as time zone display 46. In the embodiment, the time zone display 46 is preferably marked so that the number of display items is equal to the number of time zones used all over the world.

Electrical Mechanism of Electronic Timepiece

Figure 4:
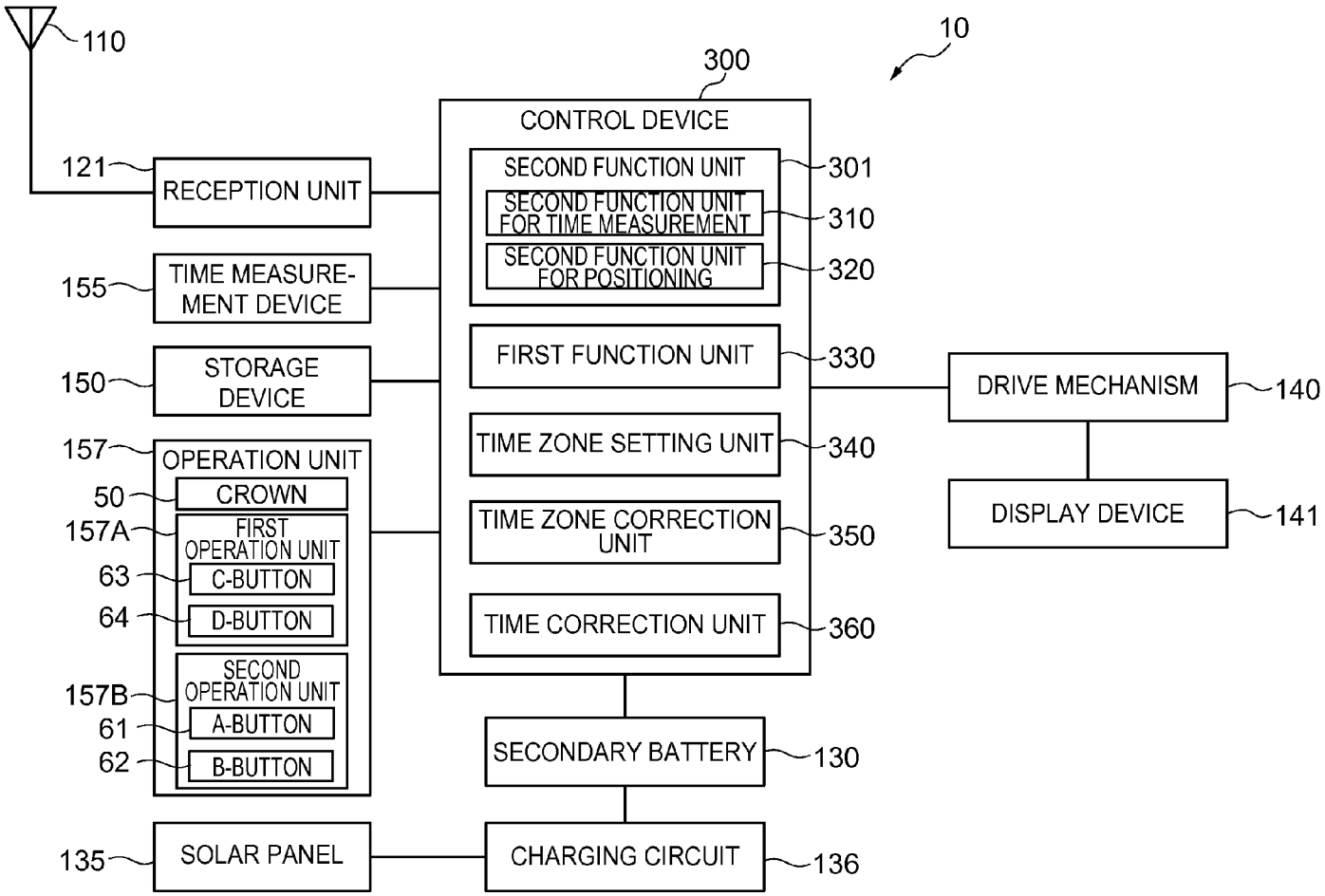
FIG. 4 is a control block diagram of the electronic timepiece according to the first embodiment.

FIG. 4 is an electrical control block diagram of the electronic timepiece.

As illustrated in FIG. 4, the electronic timepiece 10 includes a control device 300 configured to include a central processing unit (CPU, not shown), a storage device 150 configured to include a random access memory (RAM, not shown) and/or a read only memory (ROM, not shown), a reception unit (GPS module) 121, an operation unit 157, a drive mechanism. 140, and a peripheral device of a time measurement device 155. These respective devices transmit and receive data via a database. The operation unit 157 includes the crown 50, the C-button 63 and the D-button 64 which serve as the first operation unit 157A, and the A-button 61 and the B-button 62 which serve as the second operation unit 157B. The rechargeable secondary battery 130 (refer also to FIG. 3) serving as a power supply is incorporated in the electronic timepiece 10. The secondary battery 130 is charged with electric power supplied from the solar panel 135 via a charging circuit 136.

The reception unit 121 is connected to the antenna body 110, performs processing on the satellite signal received via the antenna body 110, and acquires GPS time information and/or position information. The antenna body 110 receives a radio wave of the satellite signal which is transmitted from multiple GPS satellites 8 (refer to FIG. 1) following the predetermined orbit of the earth in space and which passes through the cover glass 33 and the dial ring 40 illustrated in FIG. 2.

Then, similar to a general GPS device, the reception unit 121 (refer to FIG. 3), which includes a radio frequency (RF) unit which receives the satellite signal transmitted from the GPS satellite 8 (refer to FIG. 1), converts the satellite signal into a digital signal, a baseband unit (BB unit) performs correlation determination of the received signal so as to demodulate a navigation message, and an information acquisition unit acquires the GPS time information or the position information (positioning information) from the navigation message (satellite signal) demodulated in the BB unit and outputs the information. Therefore, the reception unit 121 configures the reception means.

The RF unit includes a band pass filter, a PLL circuit, an IF filter, a voltage controlled oscillator (VCO), an A/D converter (ADC), a mixer, a low noise amplifier (LNA), and an IF amplifier. The satellite signal extracted from the band pass filter is amplified by the LNA. Thereafter, the satellite signal is mixed with a signal of the VCO by the mixer, and is down-converted into a signal with an intermediate frequency (IF). The IF mixed by the mixer passes through the IF amplifier and the IF filter, and is converted into a digital signal by the ADC.

The BB unit includes a local code generator which generates a local code formed of a C/A code the same as that used when the GPS satellite 8 transmits the satellite signal, and a correlation unit which calculates a correlation value between the local code and the received signal output from the RF unit. Then, if the correlation value calculated by the correlation unit is equal to or greater than a predetermined threshold value, the C/A code used in the received satellite signal and the generated local code become coincident with each other, thereby enabling the satellite signal to be captured (synchronized). Therefore, the received satellite signal is subjected to correlation processing using the local code, thereby enabling the navigation message to be demodulated.

The information acquisition unit acquires the GPS time information and/or the position information from the navigation message demodulated by the BB unit. The navigation message includes preamble data and time of the week (TOW, also referred to as "Z count") of a HOW word, and each piece of sub-frame data. The sub-frame data is configured to include a sub-frame 1 to a sub-frame 5. For example, each sub-frame includes data such as satellite correction data including week number data or satellite health state data, the ephemeris (detailed orbit information for each GPS satellite 8), and the almanac (schematic orbit information of all GPS satellites 8). Therefore, the information acquisition unit extracts a predetermined data item from the received navigation message. In this manner, it is possible to acquire the GPS time information or navigation information.

The sub-frames 4 and 5 include the orbit information for all satellites (almanac) or ionosphere correction information. Since these information items include many data items, the information items are divided in units of pages and are accommodated in the sub-frame. That is, the data items transmitted by the sub-frames 4 and 5 are respectively divided into pages 1 to 25, and content of the different page per each frame is sequentially transmitted. In order to transmit the content of all of the pages, 25 frames are needed. Accordingly, in order to receive all of the information items of the navigation message, a time period of 12 minutes and 30 seconds is needed. Leap second information (leap second update information) is stored in the page 18 of the sub-frame 4. If the page 18 of the sub-frame 4 is received, it is possible to acquire the leap second information.

Time Measurement Device

The time measurement device 155 includes a quartz crystal vibrator driven with the electric power accumulated in the secondary battery 130, and updates time data using a reference signal, based on an oscillation signal of the quartz crystal vibrator.

Storage Device

As described above, the storage device 150 of the electronic timepiece 10 includes the ROM and the RAM. The ROM stores a program executed in the control device 300 or time zone information. The time zone information is data for managing the position information (latitude and longitude) of a territory (time zone) which uses the standard time in common, and the time difference from the UTC.

The control device 300 uses the RAM of the storage device 150 as a work region, and causes a program stored in the ROM to be executed, thereby performing various types of calculation, control, and time measurement. For example, the time measurement is performed by counting the number of pulses of a reference signal transmitted from an oscillation circuit (not illustrated).

The control device 300 corrects the internal timepiece, based on the time information calculated using the GPS time information and time correction parameters, the position information (latitude and longitude) of the current location which is calculated using the GPS time information and the orbit information, and the time zone information stored in the ROM. The control device 300 performs control for driving the drive mechanism. 140 so that the internal time is displayed. In this manner, the internal time is displayed on the electronic timepiece 10 by the indicating hands 22, 23, and 81 (refer to FIG. 2).

The storage device 150 does not store the orbit information of a position information satellite (almanac and ephemeris). The electronic timepiece 10 is a wrist timepiece. Thus, the capacity of the storage device 150 is limited, and additionally the capacity of the secondary battery 130 is also limited. Consequently, the reason for not storing the orbit information is that it is difficult to perform long-time reception in order to acquire the orbit information. Therefore, the reception processing of the electronic timepiece 10 is performed in cold start conditions without orbit information.

Control Device

The control device 300 is configured to include the CPU for controlling the electronic timepiece 10. The control device 300 includes a second function unit 301, a first function unit (chronograph unit) 330, a time zone setting unit 340, a time zone correction unit 350, and a time correction unit 360. In addition, the second function unit 301 serves as a reception function unit for executing the reception function of the satellite signal, and includes a second function unit for time measurement 310 and a second function unit for positioning 320.

Second Function Unit (Second Function Unit for Time Measurement)

The second function unit for time measurement 310 is configured to include a time measurement unit which operates the reception unit 121 so as to perform the reception processing in a time measurement mode. In the embodiment, the second function unit for time measurement 310 performs the reception processing in the time measurement mode by using automatic reception processing and manual reception processing.

The automatic reception processing is classified into two types of scheduled automatic reception processing and light automatic reception processing. That is, the second function unit for time measurement 310 operates the reception unit 121 so as to perform the scheduled automatic reception processing in the time measurement mode, when measured internal time data shows the scheduled reception time stored in the storage device 150.

The second function unit for time measurement 310 operates the reception unit 121 so as to perform the light automatic reception processing in the time measurement mode, when a generated voltage or a generated current of the solar panel 135 has a setting value or greater, or if it is determined that sunlight illuminates the solar panel 135 outdoors. The number of times of operating the reception unit 121 in a power generating state of the solar panel 135 may be limited to once a day, for example.

Furthermore, when a user presses the B-button 62 of the second operation unit 157B for a first setting time period (three seconds or more and less than six seconds) and performs a forced reception operation, the second function unit for time measurement 310 operates the reception unit 121 so as to perform the manual reception processing in the time measurement mode.

The second function unit for time measurement 310 acquires the time information by causing the reception unit 121 to capture at least one GPS satellite 8 and to receive the satellite signal transmitted from the GPS satellite 8. Then, when the time information is successfully acquired, the time correction unit 360 updates the current time display using the acquired time information.

Second Function Unit (Second Function Unit for Positioning)

The second function unit for positioning 320 operates the reception unit 121 so as to perform the reception processing in a positioning mode, when a user presses the B-button 62 of the second operation unit 157B for a second setting time period (6 seconds or more). Therefore, the B-button 62 serves as a reception button for instructing the performance of the reception processing in the time measurement mode and the positioning mode.

If the reception processing starts in the positioning mode, the second function unit for positioning 320 causes the reception unit 121 to capture at least three, and preferably four or more GPS satellites 8, to acquire the time information by receiving the satellite signal transmitted from the respective GPS satellites 8, and further, to acquire and calculate the position information.

Then, when the position information is successfully acquired, the control device 300 acquires and sets the time zone data (time difference information), based on the acquired position information (latitude and longitude).

For example, Japanese Standard Time (JST) is nine hours ahead of the UTC (i.e. UTC+9). Accordingly, if the position information acquired in the positioning mode corresponds to Japan, the control device 300 sets the time difference information (+ nine hours) as Japanese Standard Time. Therefore, the time indicated by the indicating hands 22, 23, and 81 is the time obtained by adding the time zone data (i.e. the difference information) to the UTC.

First Function Unit

The first function unit 330 executes the chronograph function in the embodiment. If the C-button 63 of the first operation unit 157A is pressed in a time display mode, the first function unit 330 is executed to start the chronograph. In addition, if the C-button 63 is pressed again, the chronograph stops. If the D-button 64 of the first operation unit 157A is pressed in a stopped state, the chronograph is reset so as to return to the time display mode. Therefore, the C-button and the D-button 64 serve as a function button for instructing execution of the first function unit 330, and serve as the first operation unit 157A for performing the operation related to the first function.

Time Zone Setting Unit

When the position information is successfully acquired by the second function unit for positioning 320, the time zone setting unit 340 sets the time zone data based on the acquired position information (latitude and longitude). Specifically, the time zone setting unit 340 selects and acquires the time zone data (time zone information, that is, time difference information) which is corresponding to the position information from a time zone data stored in the storage device 150, and sets the information as the time zone data.

Time Zone Correction Unit

The time zone correction unit 350 corrects the time indicated by the indicating hands 22, 23, and 81 using the time zone data, if the time zone setting unit 340 sets the time zone information.

Time Correction Unit

When the time information is successfully acquired by the reception processing of the second function unit for time measurement 310 or the second function unit for positioning 320, the time correction unit 360 causes the drive mechanism 140 to move the indicating hands 21, 22, and 23 so as to update the time display, based on the acquired time information.

Control of Electronic Timepiece

Next, control processing of the electronic timepiece 10 will be described with reference to the flowcharts in FIGS. 5 to 9.

Normal Time Display Mode

Figure 5:
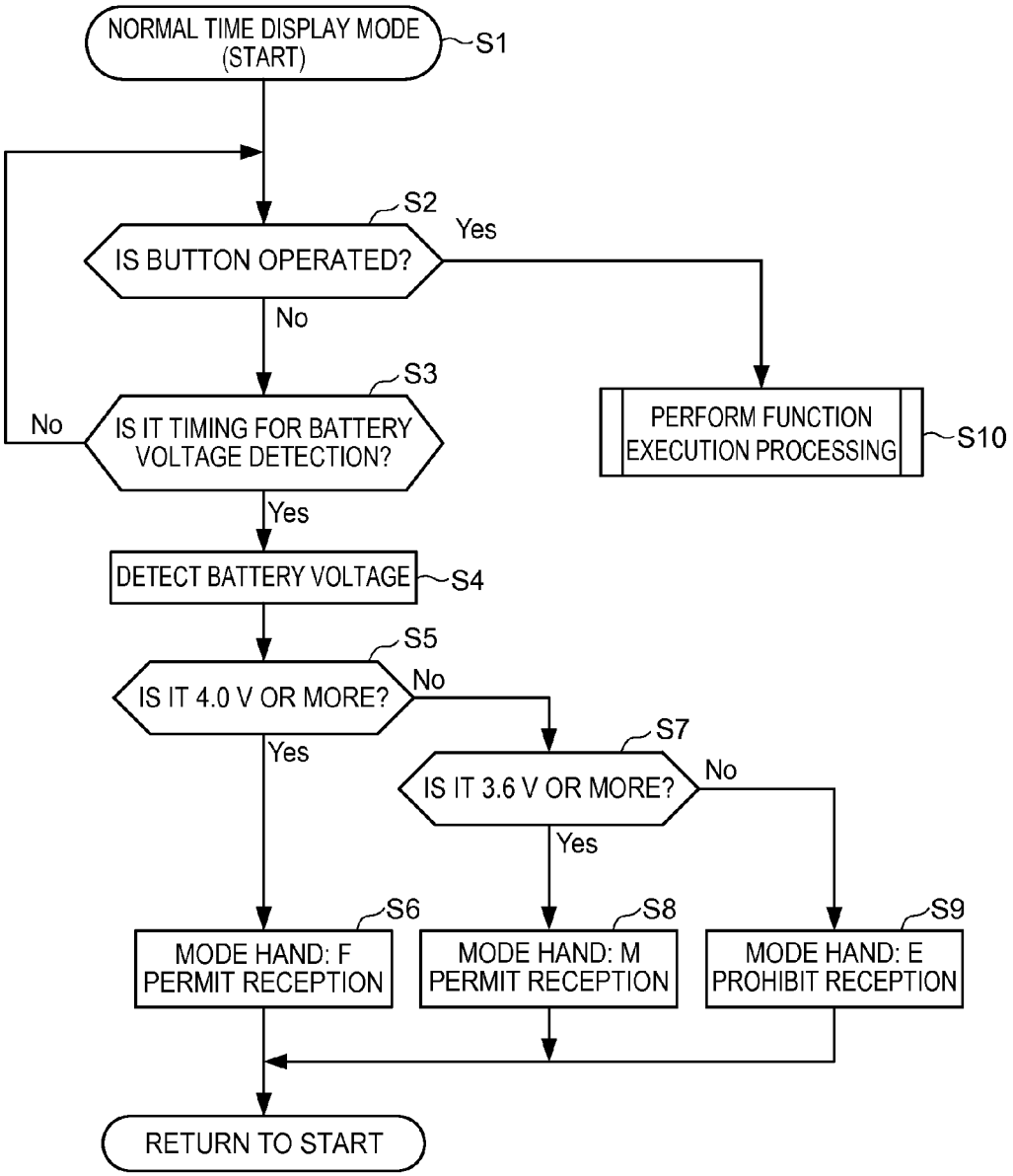
FIG. 5 is a flowchart illustrating a process in a normal time display mode of the electronic timepiece according to the first embodiment.

FIG. 5 is the flowchart illustrating a process in a normal time display mode S1 which displays normal time (current time) in the electronic timepiece 10. In the normal time display mode, the normal time measured by the time measurement device 155 is indicated by the indicating hand (hour hand) 23, the indicating hand (minute hand) 22, and the indicating hand (small second hand) 81. In addition, the date is displayed as the numbers of the date indicator which are displayed on the small calendar window 15. In addition, in the normal time display mode, the power supply voltage detection function of the secondary battery 130 serving as a power supply is executed.

In the normal time display mode, the control device 300 determines whether or not the button is operated (S2). If it is determined as No in S2, the control device 300 determines whether or not it is the timing for the battery voltage detection (S3). The timing for the battery voltage detection is set to be performed at an interval of one minute in the embodiment. If it is determined as No in S3, the control device 300 returns to S2 and continues to perform the processing.

If it is determined as Yes in S3, the control device 300 executing the power supply voltage detection function performs the battery voltage detection processing (S4).

Next, the control device 300 determines whether or not the battery voltage (battery residual capacity) detected in S4 is equal to a first threshold value (for example, 4.0 V) or greater (S5).

If it is determined as Yes in S5, the control device 300 causes the indicating hand (mode hand) 91 to move to a position indicating "F" of the voltage state display region 93C in the scale display unit 93 of the third small window 90, and sets the mode to a reception permission mode (S6).

If it is determined as No in S5, the control device 300 determines whether or not the battery voltage detected in S4 is equal to a second threshold value (for example, 3.6 V) or greater (S7).

If it is determined as Yes in S7, that is, when the detected battery voltage is 3.6 V or more and less than 4.0 V, the control device 300 causes the indicating hand (mode hand) 91 to move to a position indicating "M" in the voltage state display region 93C within the scale display unit 93 of the third small window 90, and sets the mode to the reception permission mode (S8).

If it is determined as No in S7, that is, when the detected battery voltage is less than 3.6 V (also including a case where the battery voltage cannot be detected), the control device 300 causes the indicating hand (mode hand) 91 to move to a position indicating "E" in the voltage state display region 93C within the scale display unit 93 of the third small window 90, and sets the mode to a reception prohibition mode (S9).

Therefore, a user can easily determine whether or not the battery residual capacity of the secondary battery 130 is sufficient (case of "F"), whether or not the battery residual capacity remains at approximately half (case of "M"), or whether or not the battery residual capacity remains at almost zero and the reception is not possible (case of "E").

Then, after the processing in S6, S8, and S9 is performed, the control device 300 returns to the start of S1 in the normal time display mode. That is, when the normal time display mode is selected (when the power supply voltage detection function is executed), the indicating hand 91 indicates any one symbol of "E, M, and F" of the voltage state display region 93C of the scale display unit 93.

Figure 6:
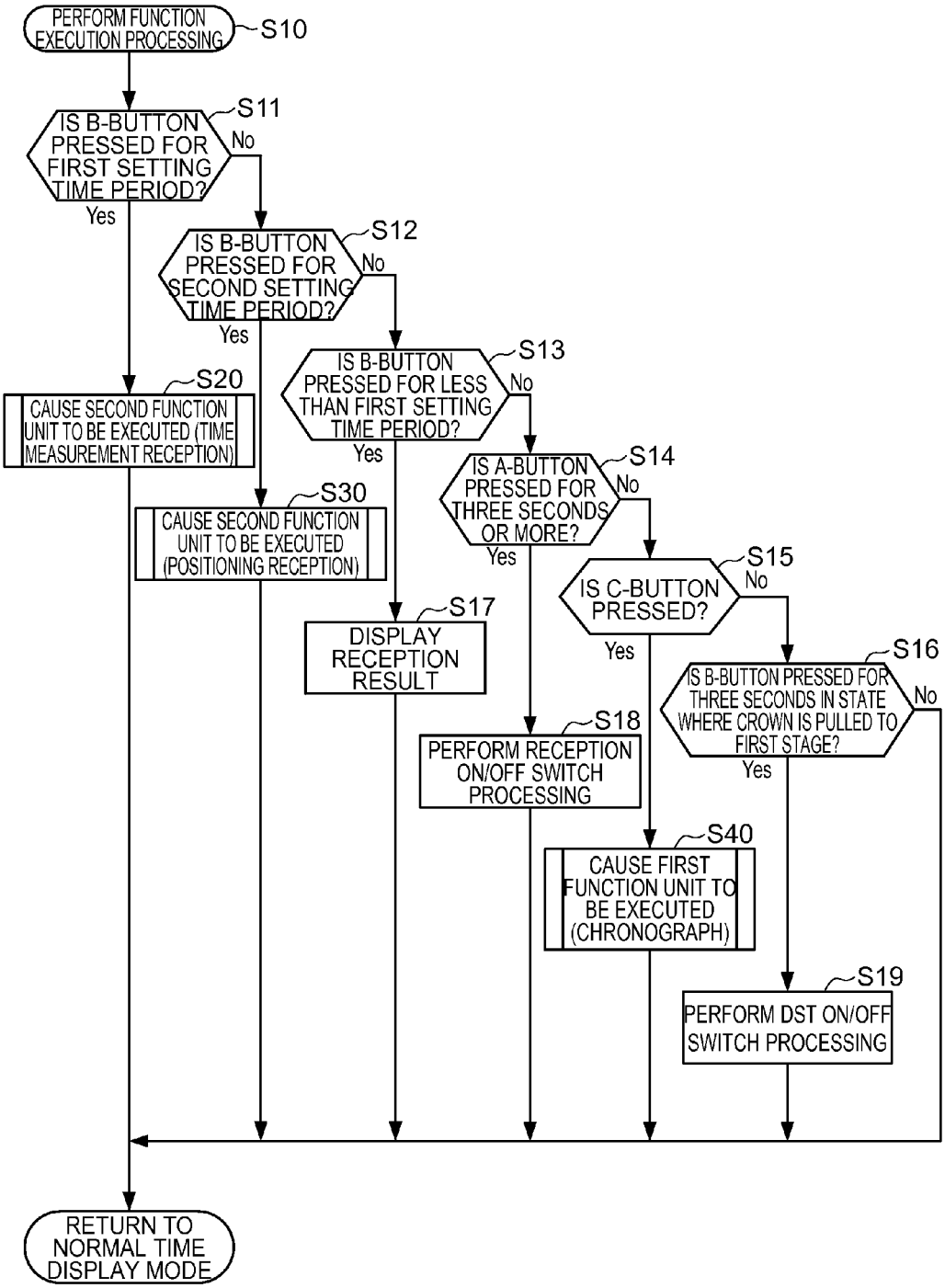
FIG. 6 is a flowchart illustrating an execution procedure in a function execution process illustrated in FIG. 5.

When it is determined that the button is operated in S2 (Yes in S2), the control device 300 performs the function execution processing S10 illustrated in FIG. 6.

Function Execution Processing

If the function execution processing S10 is performed, the control device 300 determines how any button among the A-button 61, the B-button 62, the C-button 63, and the D-button 64 is operated.

Specifically, when the B-button 62 of the second operation unit 157B executing the function related to the reception is operated, the control device 300 determines whether or not the B-button 62 is pressed for the first setting time period (for example, three seconds or more and less than six seconds) (S11). If it is determined as No in S11, the control device 300 determines whether or not the B-button 62 is pressed for the second setting time period (for example, six seconds or more) (S12). If it is determined as No in S12, the control device 300 determines whether or not the B-button 62 is pressed for less than the first setting time period (for example, less than three seconds) (S13).

If it is determined as No in S13, the control device 300 determines whether or not the A-button 61 of the second operation unit 157B is pressed for a predetermined time period (for example, three seconds or more) (S14). If it is determined as No in S14, the control device 300 determines whether or not the C-button 63 of the first operation unit 157A is pressed (S15). If it is determined as No in S15, the control device 300 determines whether or not the B-button 62 of the second operation unit 157B is pressed for a predetermined time period (for example, three seconds or more) in a state where the crown is pulled from a zero stage to a first stage (one stage pulled state) (S16).

In contrast, if it is determined as Yes in S11, the control device 300 causes the second function unit for time measurement 310 to be executed (S20). If it is determined as Yes in S12, the control device 300 causes the second function unit for positioning 320 to be executed (S30). If it is determined as Yes in S13, the control device 300 performs the reception result display processing (S17). However, if the reception prohibition is set in S9, the processing in S20 and S30 is prohibited.

If it is determined as Yes in S14, the control device 300 performs the reception permission (ON) and prohibition (OFF) switch processing (S18). If it is determined as Yes in S15, the control device 300 causes the first function unit 330 to be executed (S40). If it is determined as Yes in S16, the control device 300 performs the summer time (DST) ON/OFF switch processing (S19).

Then, the control device 300 returns to the normal time display mode S1 in FIG. 5, if the respective processing procedures S20, S30, S17, S18, S40, and S19 are performed, and if it is determined as No in S16.

Hereinafter, the respective processing procedures S20, S30, S17, S18, S40, and S19 will be described.

Execution Processing of Second Function Unit for Time Measurement

Figure 7:
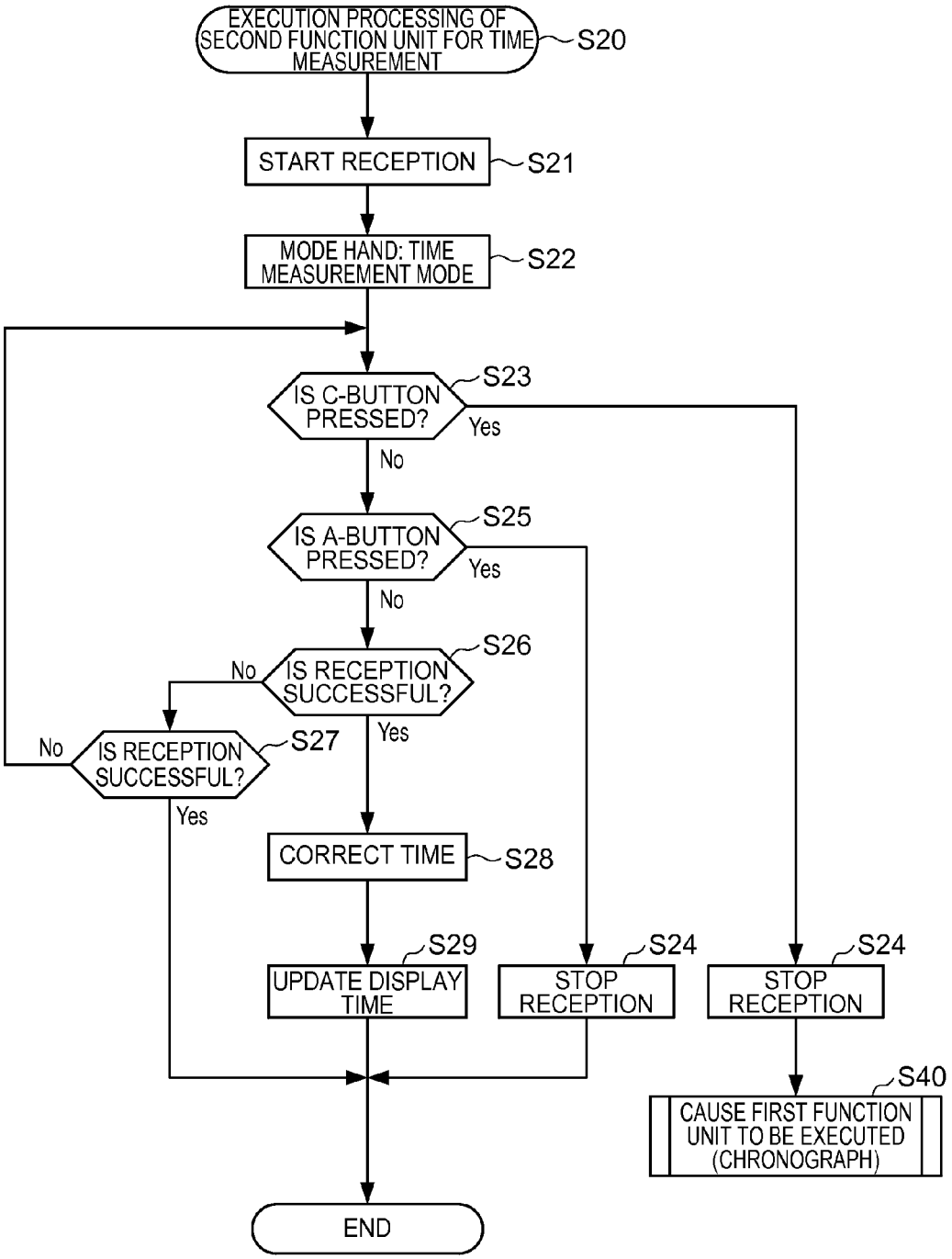
FIG. 7 is a flowchart illustrating an execution procedure in a first function unit execution process illustrated in FIG. 6.

FIG. 7 is a flowchart illustrating the execution processing S20 of the second function unit for time measurement (time measurement reception processing).

If the B-button 62 of the second operation unit 157B is pressed for the first setting time period and the execution processing S20 of the second function unit for time measurement 310 starts, as illustrated in FIG. 7, the second function unit for time measurement 310 starts the reception in the time measurement mode (S21). In addition, the second function unit for time measurement 310 causes the indicating hand (mode hand) 91 to move to a position indicating the time measurement mode, that is, a position indicating "TIME" displayed in the reception state display region 93B of the scale display unit 93 (S22).

The second function unit for time measurement 310 determines whether or not the C-button 63 of the first operation unit 157 is pressed (S23). If it is determined as Yes in S23, the second function unit for time measurement 310 stops the reception (S24), and starts the execution processing S40 of the first function unit 330.

That is, in the embodiment, if the start button (C-button 63) having the chronograph function is pressed during the reception, the control device 300 stops the reception, and starts the chronograph. The execution processing S40 of the first function unit 330 will be described in detail later.

If it is determined as No in S23, the second function unit for time measurement 310 determines whether or not the A-button 61 of the second operation unit 157B is pressed (S25). If it is determined as Yes in S25, the second function unit for time measurement 310 stops the reception (S24), and ends the execution processing S20 of the second function unit for time measurement. That is, in the embodiment, if the A-button 61 is pressed during the reception in the time measurement mode, the second function unit for time measurement 310 cancels and stops the reception processing. Therefore, the A-button 61 serves as the second operation unit 157B performing the operation related to the second function, and serves as a button for instructing to stop the execution of the second function unit for time measurement 310.

Then, if it is determined as No in S25, the second function unit for time measurement 310 determines whether or not the reception in the time measurement mode is successful (S26). If it is determined as No in S26, the second function unit for time measurement 310 determines whether or not a predetermined reception time period (for example, 30 seconds) has elapsed (S27). If it is determined as No in S27, the second function unit for time measurement 310 returns to S23, and continues the processing.

In contrast, if it is determined as Yes in S27, that is, when the reception of the satellite signal is not successful even when 30 seconds have elapsed, the second function unit for time measurement 310 determines that the electronic timepiece 10 is arranged under an environment where the satellite signal cannot be received, and ends the execution processing S20 of the second function unit for time measurement.

If the reception is successful and it is determined as Yes in S26, the second function unit for time measurement 310 performs time correction processing by using the acquired time information (S28), and updates the display time (current time) indicated by the indicating hands 22, 23, and 81 (S29). The current time is the time at a place corresponding to the time zone set by the previous positioning reception or by a user operating the crown 50. The current time generally represents the local time of the current location where the user wearing the electronic timepiece 10 is staying.

If it is determined as Yes in S27, that is, when the reception is in failure and when display time updating is completed in S29, and if it is determined as Yes in S25, that is, when the instruction is made to stop the reception, the second function unit for time measurement 310 ends the execution processing S20 of the second function unit for time measurement, and returns to the normal time display mode S1, as illustrated in FIGS. 5 and 6.

Execution Processing of Second Function Unit for Positioning

Figure 8:
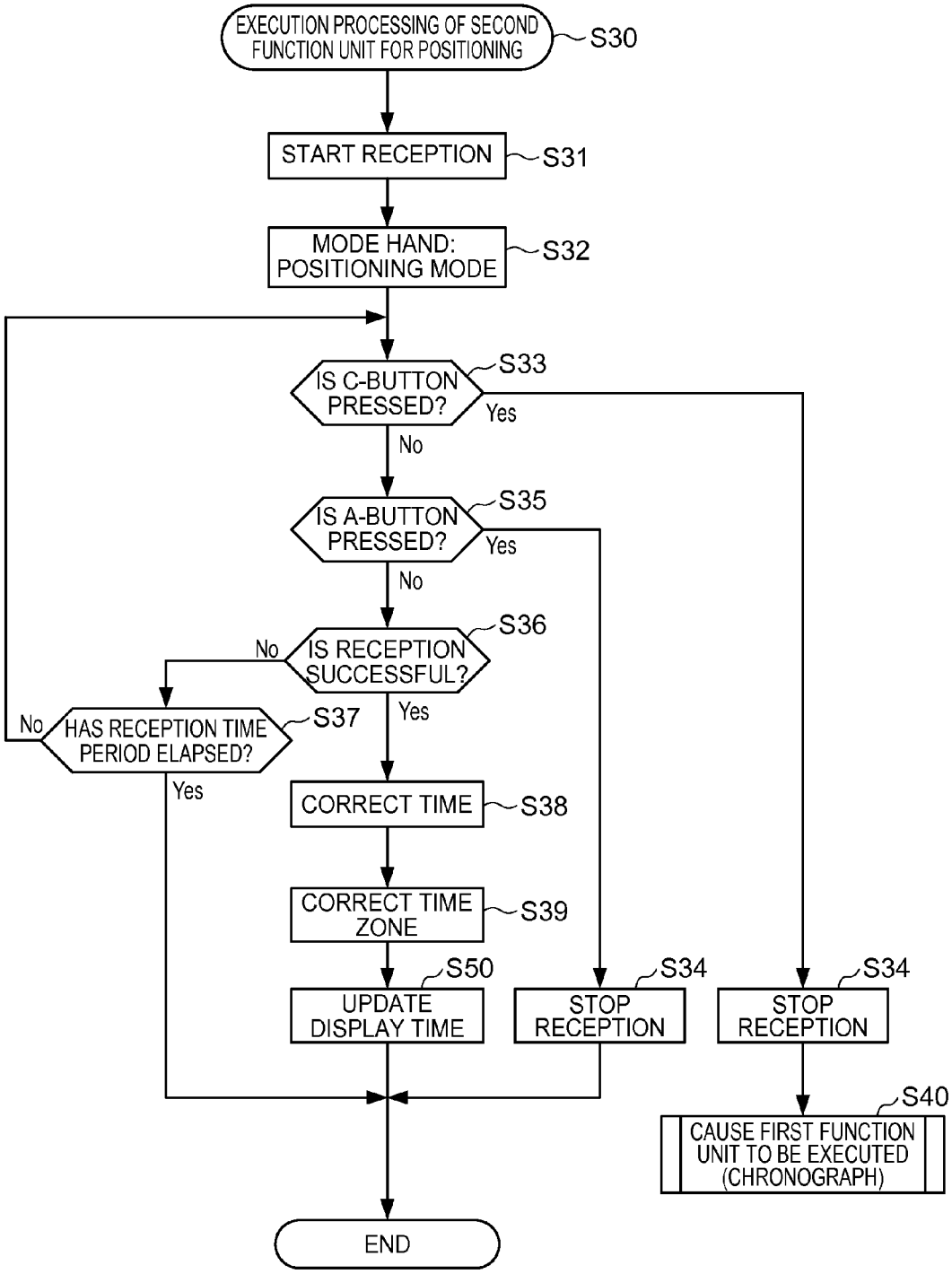
FIG. 8 is a flowchart illustrating an execution procedure in a second function unit execution process illustrated in FIG. 6.

FIG. 8 is a flowchart illustrating the execution processing S30 of the second function unit for positioning (positioning reception processing).

If the B-button 62 of the second operation unit 157B is pressed in the second setting time period so as to start the execution processing S30 of the second function unit for positioning 320, as illustrated in FIG. 8, the second function unit for positioning 320 starts the reception in the positioning mode (S31). In addition, the second function unit for positioning 320 causes the indicating hand (mode hand) 91 to move to a position indicating the positioning mode, that is, a position indicating "FIX" displayed in the reception state display region 93B of the scale display unit 93 (S32).

The second function unit for positioning 320 determines whether or not the C-button 63 of the first operation unit 157A is pressed (S33). If it is determined as Yes in S33, the second function unit for positioning 320 stops the reception similar to the second function unit for time measurement 310 (S34), and starts the execution processing S40 of the first function unit 330.

If it is determined as No in S33, the second function unit for positioning 320 determines whether or not the A-button 61 of the second operation unit 157B is pressed (S35). If it is determined as Yes in S35, the second function unit for positioning 320 stops the reception (S34), and ends the execution processing S30 of the second function unit for positioning. That is, even when the A-button 61 is pressed during the reception in the positioning mode, similar to during the reception in the time measurement mode, the second function unit for positioning 320 cancels and stops the reception processing. Therefore, the A-button 61 is also used to serve as a button for instructing the stopping of the execution of the second function unit for time measurement 310 and the second function unit for positioning 320.

Then, if it is determined as No in S35, the second function unit for positioning 320 determines whether or not the reception in the positioning mode is successful (S36). If it is determined as No in S36, the second function unit for positioning 320 determines whether a predetermined reception time period (for example, two minutes) has elapsed (S37). If it is determined as No in S37, the second function unit for positioning 320 returns to S33, and continues the processing.

In contrast, if it is determined as Yes in S37, that is, when the reception of the satellite signal is not successful even through two minutes have elapsed, the second function unit for positioning 320 determines that the electronic timepiece 10 is arranged under an environment where the satellite signal cannot be received although at least three GPS satellites 8 are captured, and ends the execution processing S30 of the second function unit for positioning.

If the reception is successful and it is determined as Yes in S36, the second function unit for positioning 320 performs time correction processing by using the acquired time information (S38), corrects the time zone based on the calculated position information (S39), and updates the current time (local time) of the corrected time zone by moving the indicating hands 22, 23, and 81 (S50).

If it is determined as Yes in S37, that is, when the reception is in failure and when the display time updating is completed in S50, and if it is determined as Yes in S35, that is, when the instruction is made to stop the reception, the second function unit for positioning 320 ends the execution processing S30 of the second function unit for positioning, and returns to the normal time display mode S1, as illustrated in FIGS. 5 and 6.

Reception Result Display

If the B-button 62 of the second operation unit 157B is pressed for less than the first setting time period (for example, three seconds) so as to perform the reception result display processing S17, the control device 300 displays the previous reception result. Specifically, the control device 300 causes the indicating hand (mode hand) 91 to move to a position indicating "TIME" if the previous reception mode is the time measurement mode, and causes the indicating hand (mode hand) 91 to move to a position indicating "FIX" if the previous reception mode is the positioning mode. In addition, the control device 300 causes the indicating hand (small indicating hand) 81 to move to a position indicating "Y" in the second small window 80 if the previous reception result is successful, and causes the indicating hand (small indicating hand) 81 to move to a position indicating "N" in the second small window if the previous reception result is in failure. The reception result display ends if a predetermined time period (for example, five seconds) has elapsed, and the control device 300 returns to the normal time display mode S1. In addition, the reception result display may be ended by pressing the B-button 62 again, or by pressing a button (for example, the D button 64) set for display cancellation.

Setting of Reception On/OFF

If reception on/off switch processing S18 is performed by pressing the A-button 61 of the second operation unit 157B for a setting time period (for example, three seconds or more), the control device 300 alternately switches between respective modes of reception permission (ON) and reception prohibition (OFF). Specifically, in the case of a reception prohibition mode (off-mode and flight mode), the control device 300 causes the indicating hand (mode hand) 91 to move to a position indicating "OFF" displayed in the reception state display region 93B of the scale display unit 93. That is, the control device 300 causes the indicating hand 91 to move to a position indicating "OFF" between "F" and "TIME" in the scale display unit 93.

In contrast, in case of a reception permission mode (ON), the control device 300 causes the indicating hand 91 to move to a position indicating the battery voltage level (any one of "F, M, and E"), similar to the normal time display mode.

Then, when the mode is set to the reception prohibition mode (OFF-mode), the control device 300 prohibits the reception processing (both the automatic reception and the manual reception) of the second function unit for time measurement 310 and the second function unit for positioning 320. That is, even if the B-button 62 of the second operation unit 157B is pressed for the first setting time period or for the second setting time period, the second function unit for time measurement 310 or the second function unit for positioning 320 does not start the processing, and the control device 300 causes the indicating hand 91 to move to the position of "OFF". Therefore, when a user is on a flight, it is possible to prohibit the reception operation of the satellite signal from starting. Even if the reception operation is performed, the indicating hand 91 indicates the position of "OFF". Accordingly, the user can easily understand that the mode is set to the reception prohibition mode.

If a predetermined time period (for example, five seconds) has elapsed, the reception prohibition mode (OFF) display ends, and returns to the normal time display mode S1. In addition, the reception prohibition mode (OFF) display may end by pressing the A-button 61 again or by pressing a button (for example, the D-button 64) set for display cancellation.

Execution Processing of First Function Unit

Figure 9:
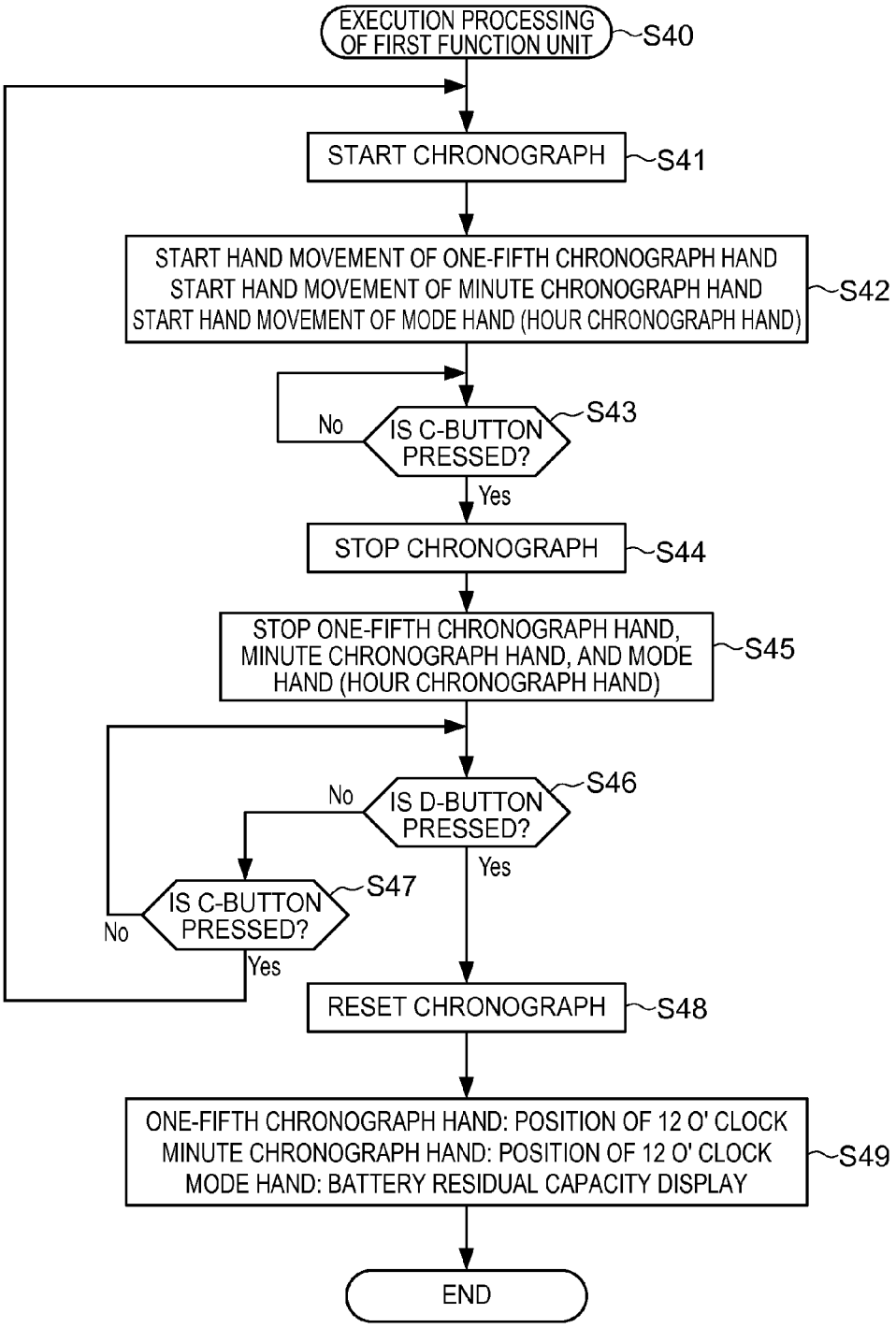
FIG. 9 is a flowchart illustrating an execution procedure in a third function unit execution process illustrated in FIG. 6.

FIG. 9 is a flowchart illustrating execution processing (chronograph function) S40 of the first function unit.

If the execution processing S40 of the first function unit 330 starts by pressing the C-button 63 of the first operation unit 157A, as illustrated in FIG. 9, the first function unit 330 starts the chronograph function (S41).

Then, the first function unit 330 starts a hand movement of the indicating hand (one-fifth second chronograph hand) 21, the indicating hand (minute chronograph hand) 71, and the indicating hand (hour chronograph hand) 91 (S42). Specifically, the indicating hand 21 starts to move clockwise from the position of 12 o'clock (position of zero second). In addition, the indicating hand 91 moves to an initial position (position of 0 o'clock which represents zero hour). The indicating hand 71 is located at the position of 60 minutes which represents zero minutes in the normal time display mode. Accordingly, the indicating hand 71 starts to move as it is.

The indicating hand 21 moves one round each time 60 seconds elapse, and the indicating hand 71 moves by one scale (one minute) each time the indicating hand 21 moves one round, that is, every minute. Furthermore, the indicating hand 71 moves one round each time 60 minutes elapse. The indicating hand 91 moves by one scale (one hour) each time the indicating hand 71 moves one round, that is, every hour.

The indicating hand 91 moves to the position of the maximum which is six hours. Therefore, the execution processing (chronograph processing) S40 of the first function unit can be measured for the maximum which is six hours.

During the chronograph operation, the first function unit 330 determines whether or not the C-button 63 of the first operation unit 157A is pressed (S43), and stops the chronograph operation when the C-button 63 is pressed (S44). Then, the respective indicating hands 21, 71, and 91 are also stopped (S45).

While the chronograph operation is stopped, the first function unit 330 determines whether or not the D-button 64 of the first operation unit 157A is pressed (S46). If it is determined as No in S46, the first function unit 330 determines whether or not the C-button 63 is pressed (S47).

If it is determined as No in S47, the first function unit 330 returns to S46, and continues the processing.

If it is determined as Yes in S47, that is, when the C-button 63 is pressed again, the first function unit 330 returns to S41, and starts the chronograph operation again.

While the chronograph operation is stopped, if the D-button 64 is pressed and it is determined as Yes in S46, the first function unit 330 resets (stops) the chronograph operation (S48). Therefore, the D-button 64 serves as a button for instructing to stop the execution of the first function unit 330. Then, the first function unit 330 causes the indicating hands 21 and 71 to return to the position of 0 o'clock which is the initial position. Similar to the normal time display mode, the indicating hand 91 returns to battery residual capacity display (S49).

Then, the first function unit 330 ends the execution processing S40 of the first function unit, and returns to the normal time display mode S1, as illustrated in FIGS. 5 and 6.

Confirmation and Change of Time Zone

If the crown 50 is brought into a one stage pulled state, it is possible to confirm the time zone which is set currently. The control device 300 causes the indicating hand 21 to move to a position indicating the name of the city and the time difference display in the time zone which is set currently.

If the crown 50 is rotated forward (clockwise) in this state, the control device 300 sets the time difference of the time zone to "+1", and causes the indicating hand 21 to move clockwise. If the crown 50 is rotated backward (counterclockwise), the control device 300 sets the time difference of the time zone to "−1", and causes the indicating hand 21 to move counterclockwise.

In accordance with the change of the time zone, the control device 300 causes the indicating hands 22 and 23 to change the indicating position to the time of the time zone indicated by the indicating hand 21.

Setting of DST ON/OFF

Then, in the state where the crown 50 is pulled out one stage, the indicating hand 91 indicates DST ON/OFF in the summer time display region 93D. If the B-button 62 of the first operation unit 157A is pressed for three seconds or more in this state, the control device 300 performs DST ON/OFF switch processing S19. The control device 300 switches between respective modes of the DST ON/OFF.

Then, if the crown 50 is pressed into a zero stage position, the DST ON/OFF switch processing S19 ends, and the control device 300 returns to the normal time display mode S1.

Operation Effect of Embodiment

According to the electronic timepiece 10 in the above-described embodiment of the invention, the following effects can be obtained.

According to the embodiment, one indicating hand 91 indicates the scale in the measured time display region 93A when the chronograph function serving as the first function is executed, indicates any one of "TIME", "FIX", and "OFF" in the reception state display region 93B when the reception function (positioning reception function and time measurement reception function) serving as the second function is executed, and indicates any scale of "E, M, and F" in the voltage state display region 93C when the power supply voltage detection function is executed (for example, when the normal time display is performed). Therefore, by merely viewing the respective display regions 93A to 93C indicated by one indicating hand, a user can recognize whether or not the chronograph function, the reception function of the satellite signal, and the power supply voltage detection function are currently being executed. In addition, by merely viewing the scale (symbol) indicated by indicating hand 91, the user can grasp whether the time measurement reception is performed or the positioning reception is performed between the time measured by the chronograph function and the reception function, whether or not the reception of the satellite signal is prohibited, and the battery residual capacity of the secondary battery 130.

Since the battery residual capacity of the secondary battery 130 can be grasped, the user can easily recognize that it is necessary to charge the secondary battery 130.

In addition to this effect, since the summer time display region 93D is provided, either symbol of "ON or OFF" in the summer time display region 93D is indicated by one indicating hand 91. Accordingly, the user can recognize whether or not the DST is in the ON-state.

Furthermore, the respective display regions 93A to 93D are disposed in the scale display unit 93 of the third small window 90. Accordingly, the drive mechanism 140 is driven so as to drive one indicating hand 91, thereby enabling the indicating hand 91 to indicate all of the display regions 93A to 93D. Therefore, for example, as compared to a case where the above-described content is displayed by two indicating hands, it is possible to reduce the power consumption.

Therefore, since one indicating hand 91 indicates anyone region among the respective display regions 93A to 93D, the user can recognize the function which is currently being executed. Furthermore, the user views the scale indicated by the indicating hand 91, thereby enabling the user to recognize the further detailed state of the respective functions being executed. In this manner, the user can handle the electronic timepiece 10 having the multiple functions with better operability, and thus it is possible to improve usability.

In the embodiment, the measured time display region 93A is arranged in the right half region of the scale display unit 93, and the display regions 93B to 93D other than the measured time display region 93A are arranged on the left half region of the scale display unit 93. Accordingly, the user can clearly distinguish the measured time display region 93A from the display regions 93B to 93D other than the measured time display region 93A. Therefore, if one indicating hand 91 indicates the right half region of the scale display unit 93, the user can immediately recognize that the chronograph function is executed, and thus, it is possible to improve usability.

The measured time display region 93A is disposed in the overall right half region. Accordingly, the user can easily recognize the scale of the chronograph. In this regard, it is also possible to improve usability.

Furthermore, in the left half region of the scale display unit 93, the reception state display region 93B and the summer time display region 93D are disposed so as to interpose the voltage state display region 93C. Accordingly, if the reception function of the satellite signal is executed in a state where the power supply voltage detection function is executed (state of displaying the normal time), the indicating hand 91 is driven from a state of indicating the scale in the voltage state display region 93C to a state of indicating the scale in the reception state display region 93B. In contrast, if an operation for setting the DST ON/OFF is performed in the normal time display state, the indicating hand 91 is driven to a state of indicating the scale in the summer time display region 93D. That is, when the normal time display is performed, the reception state display region 93B and the summer time display region 93D are disposed so as to interpose the voltage state display region 93C indicated by the indicating hand 91 therebetween. Accordingly, when these functions are executed, the distance for driving the indicating hand 91 using the drive mechanism 140 is shortened. As a result, it is possible to reduce the power consumption.

In the voltage state display region 93C, the display of "E" which indicates that the voltage state of the secondary battery 130 is lowest is arranged in the direction of approximately 7 o'clock, and the display of "F" which indicates that the voltage state of the secondary battery 130 is highest is arranged in the direction of approximately 9 o'clock (direction slightly closer to 10 o'clock than 9 o'clock). As the indicating hand 91 progressively moves clockwise, the display symbols are arrayed side by side in the order of "E, M, and F" so that the voltage state becomes higher. A user is likely to recognize the residual capacity of the secondary battery 130. Furthermore, if the indicating hand 91 indicates upward from the virtual line connecting 3 o'clock and 9 o'clock, the user can intuitively recognize that the battery residual capacity of the secondary battery 130 is sufficient.

Furthermore, in the reception state display region 93B, the symbol "OFF" for not receiving the satellite signal (no time for receiving the satellite signal) is arranged in the direction of approximately 10 o'clock, and the symbol "FIX" which indicates that the time for receiving the satellite signal is longest is arranged in the approximate direction of 11 o'clock. As the indicating hand 91 progressively moves clockwise, the display symbols are arrayed side by side in the order of "OFF, TIME, and FIX" so that the time for receiving the satellite signal becomes longer. Accordingly, the user can intuitively recognize that the time for receiving the satellite signal becomes longer as the indicating hand 91 is separated from the voltage state display region 93C which has been indicated by the indicating hand 91 when the normal time display is performed.

In the embodiment, the C-button 63 and the D-button of the first operation unit 157A which executes the chronograph function are disposed separately from the A-button 61 and the B-button 62 of the second operation unit 157B which executes the satellite signal reception function. Accordingly, if the C-button 63 and the D-button 64 are operated, the chronograph function can be directly executed. If the A-button 61 and the B-button 62 are operated, the time measurement reception function and the positioning reception function can be directly executed.

The respective operation units 157A and 157B are arranged at a position close to the corresponding display regions 93A and 93B. Accordingly, the user can intuitively grasp that the C-button 63 and the D-button 64 may be operated in order to execute the chronograph function, and that the A-button 61 and the B-button 62 may be operated in order to execute the time measurement reception function and the positioning reception function.

The scale for displaying the measured time measured by the first function unit 330 is disposed in the measured time display region 93A. Accordingly, if the user operates the C-button 63 and the D-button 64 which are disposed at the position close to the measured time display region 93A, the user can easily recognize that the chronograph function is executed. In addition, if the indicating hand indicates the measured time display region 93A, the user can easily recognize that the function currently being executed is the chronograph function. In addition, the user can recognize the measured time by viewing the position of the scale indicated by the indicating hand.

Therefore, if the user confirms only the indicated scale of the indicating hand 91, the user can grasp the executed chronograph function and the measured time.

Furthermore, the scales (marks "TIME", "FIX", and "OFF") for displaying the reception mode of the satellite signal received from the second function unit for time measurement 310 and the second function unit for positioning 320 are disposed in the reception state display region 93B. Accordingly, if the user operates the A-button 61 and the B-button 62 which are disposed at the position close to the reception state display region 93B, the user can easily recognize that the satellite signal reception function is executed. In addition, if the indicating hand indicates the reception state display region 93B, the user can easily recognize that the currently executed function is the satellite signal reception function. In addition, the user can easily recognize the reception mode by viewing the position of the scale indicated by the indicating hand 91.

The scale display unit 93 is disposed in the small window 90 disposed in the dial 11, and the hour hand 23 and the minute hand 22 serve as a center hand in which the indicating hand axle 25 is located at the center of the dial 11. Accordingly, the user can easily recognize the normal time (current time). When the chronograph function, or the time measurement reception function and the positioning reception function are executed, the user can recognize the function currently being executed by merely viewing the small window 90.

Moreover, the small window 90 is arranged on the side of 6 o'clock in the dial 11, that is, at the lateral center of the dial 11. Accordingly, the user can have an idea that the right half region of the small window 90 relates to the right half part of the timepiece and the left half region of the small window 90 relates to the left half part of the timepiece. Therefore, the user can easily grasp that the measured time display region 93A disposed on the right side of the small window 90 relates to the first operation unit 157A and the reception state display region 93B disposed on the left side of the small window 90 relates to the second operation unit 157B. In this regard, it is also possible to improve usability.

Furthermore, the first operation unit 157A and the second operation unit 157B include the multiple buttons. Accordingly, multiple operations such as execution, suspension, or cancellation of each function can be performed using the multiple buttons. That is, without using a button of another operation unit, the first function can be operated by using only the button of the first operation unit 157A, and the second function can be operated by using only the button of the second operation unit 157B. Therefore, it is possible to improve the operability of the respective operation units 157A and 157B, that is, usability.

When the first function unit 330 and the second function unit 301 are not executed, the indicating hand 91 indicates the voltage state display region (third display region) 93C. Accordingly, the user can recognize the residual capacity of the secondary battery 130, and thus, can easily determine whether or not charging is needed.

The voltage state display region 93C of the scale display unit 93 in which the marks "F, M, and E" indicating the battery residual capacity are provided is disposed in the left half region based on the virtual line connecting 12 o'clock and 6 o'clock (not disposed in the right half region based on the virtual line). Accordingly, the measured time display region 93A can be disposed in the overall right half region. Therefore, the user can easily recognize the scale of the chronograph. In this regard, it is also possible to improve usability.

Modification Example

The invention is not limited to the first embodiment. The invention can be modified and improved within a scope which can achieve an advantage of some aspects of the invention.

Figure 10A:
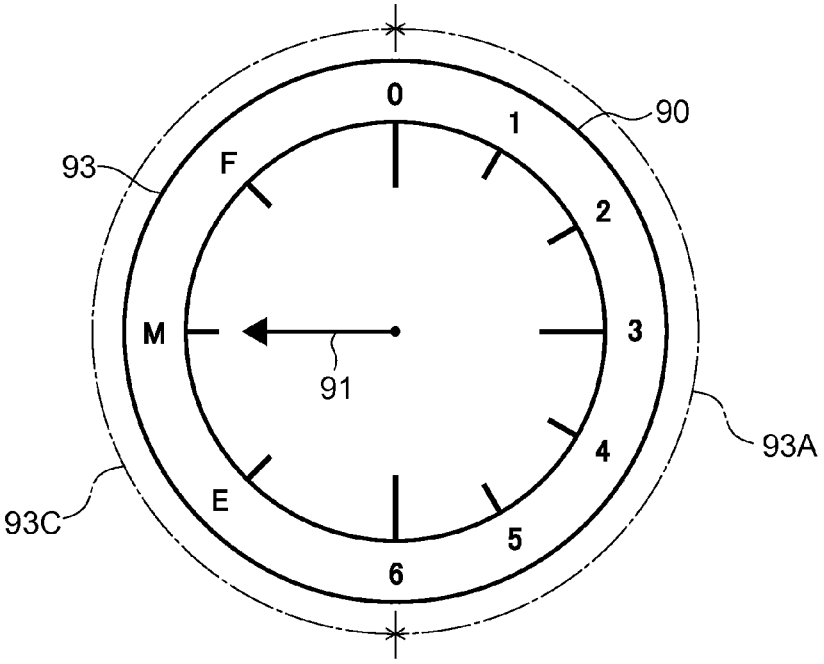
FIGS. 10A and 10B are schematic views illustrating a third small window according to a modification example of the first embodiment of the invention.

In the electronic timepiece 10 according to the above-described embodiment, three display regions such as the reception state display region 93B for displaying the reception state (reception mode), the voltage state display region 93C for displaying the voltage state (battery residual capacity), and the summer time display region 93D for displaying the setting of the DST are set in the left half part of the scale display unit 93 of the third small window 90. However, as illustrated in FIG. 10A, only the voltage state display region 93C for displaying the voltage state of the secondary battery 130 may be set. In FIG. 10A, the symbols "F", "M", and "E" which indicate the voltage state are displayed on the voltage state display region 93C which is the left half region based on the virtual line connecting 0 o'clock and 6 o'clock in the scale display unit 93.

In this modification example, the measured time display region 93A in the right half part of the scale display unit 93 serves as a scale in a case where the indicating hand functions as the hour chronograph hand, and the configuration is the same as that in the above-described embodiment. The reception state display region 93B for displaying the reception state of the satellite signal is not provided in the scale display unit 93. Accordingly, the second function unit 301 and the A-button 61 and the B-button 62 of the second operation unit 157B may not be provided.

In this modification example, during the normal time display, the indicating hand 91 indicates any symbol in the voltage state display region 93C, for example, the symbol "M". If the C-button 63 of the first operation unit 157A is pressed down, the mode is switched over to the chronograph function similarly to in the above-described embodiment, and the indicating hand 91 indicates "0" on the side of 12 o'clock.

In this modification example, when functioning as an indicator hand, the indicating hand 91 indicates only the voltage state of the secondary battery 130. Accordingly, it is possible to set the distance between the scales respectively indicating three voltage states to be wider. Accordingly, the user can easily confirm which scale is indicated by the indicating hand 91. In this regard, it is also possible to improve usability.

Instead of the marks "F, M, and E" indicating the voltage state, marks "H (High)", "M (Middle)", and "L (Low)" may be used, or marks "L2 (Level 2)", "L1 (Level 1)", and "CHARGE" may be used. In addition, without being limited to three stages, the marks indicating the voltage state may be displayed at any desirable stages. Furthermore, a crescent sickle-shaped symbol in which a proximal end in the direction of 9 o'clock is thick and a distal end in the direction of 7 o'clock is thin may be disposed along the outer circumference in a range in the direction from 7 o'clock to 9 o'clock in the third small window 90. This symbol may be used as a power indicator of the secondary battery 130. For example, depending on the battery residual capacity, the indicating hand 91 may indicate any one of the proximal end, the distal end, and the middle. In the following respective modification examples, similarly, the marks "F, M, and E" may be appropriately modified into any one of the above-described configurations.

Figure 10B:
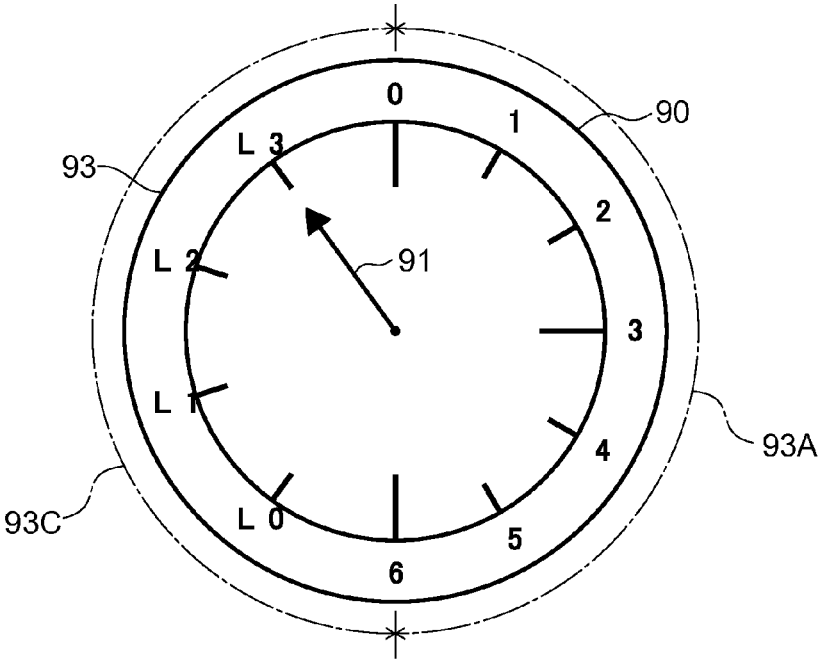

For example, as illustrated in FIG. 10B, the marks (symbols) displayed in the voltage state display region 93C are modified. That is, instead of the marks "E, M, and F" indicating the battery residual capacity, the battery residual capacity (voltage state) is displayed using marks "L0, L1, L2, and L3" by replacing a three stage display with a four stage display. In addition, in the modification example, the symbols are only different from those in the above-described embodiment. Accordingly, if the C-button 63 of the first operation unit 157A is operated, the indicating hand 91 is driven similarly to in the modification example illustrated in FIG. 10A, and the chronograph function is executed.

According to this modification example, the voltage level of the battery (battery residual capacity) is displayed using four stages L0 to L3. Accordingly, as compared to the modification example illustrated in FIG. 10A, the user can more accurately recognize the battery residual capacity. Therefore, it is possible to improve usability.

Figure 11A:
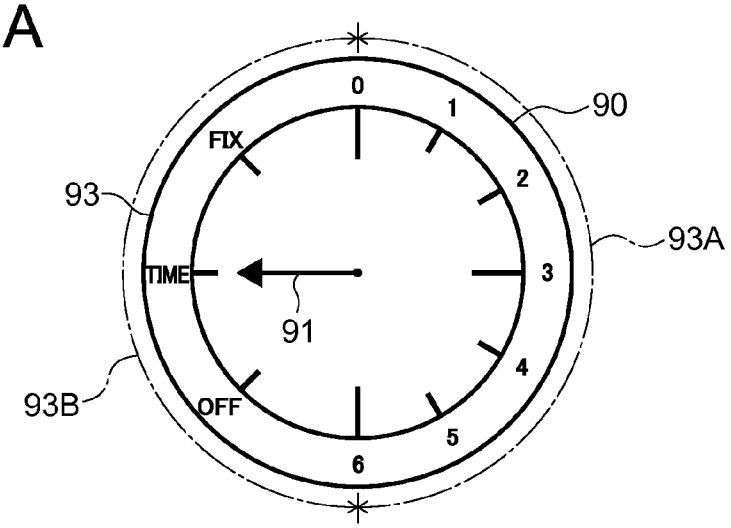
FIGS. 11A to 11C are schematic views illustrating the third small window according to another modification example.

As illustrated in FIG. 11A, only the reception state display region 93B for displaying the reception mode may be set. In FIG. 11A, marks "OFF", "TIME", and "FIX" for indicating the reception mode are displayed on the reception state display region 93B which is the left half region based on the virtual line connecting 0 o'clock and 6 o'clock in the scale display unit 93.

Instead of the marks "FIX, TIME, and OFF" in the reception mode, marks "4+", "1", and an airplane mark may be used. In the following respective modification examples, the marks "FIX, TIME, and OFF" may be similarly modified.

The measured time display region 93A in the right half part of the scale display unit 93 is a scale in a case where the indicating hand functions as the hour chronograph hand, and the configuration is the same as that in the above-described embodiment.

In this modification example, during the normal time display, the indicating hand 91 indicates the mark "OFF". If the B-button 62 of the second operation unit 157B is pressed down, the second function unit 301 performs the reception processing of the satellite signal, and the indicating hand 91 indicates either the mark "TIME" or the mark "FIX". If the C-button 63 of the first operation unit 157A is pressed down, the mode is switched over to the chronograph function similar to the above-described embodiment, and the indicating hand 91 indicates the mark "0" on the side of 12 o'clock.

In this modification example, the indicating hand 91 indicates only the reception mode when functioning as the mode hand. Therefore, it is possible to set the distance between the scales respectively indicating three reception modes to be wider. Accordingly, a user can easily confirm which scale is indicated by the indicating hand 91. In this regard, it is also possible to improve usability.

Figure 11B:
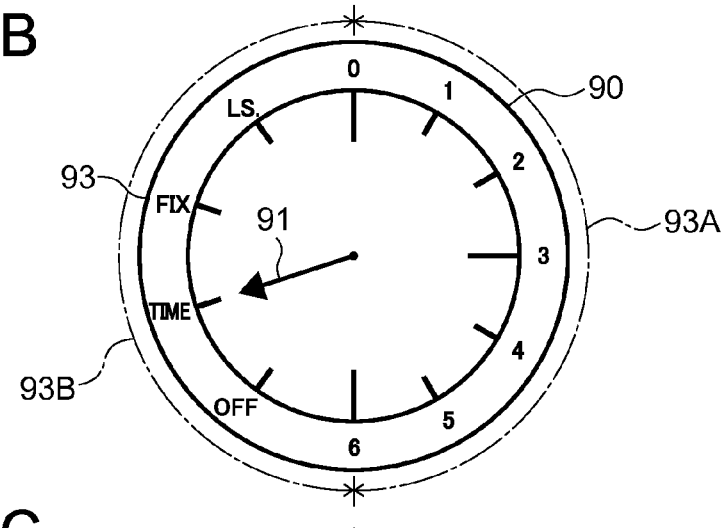

As illustrated in FIG. 11B, a leap second reception mode may be added to the reception mode displayed on the reception state display region 93B. In FIG. 11B, in addition to the marks "OFF", "TIME", and "FIX" for indicating the reception mode, a mark "LS." is displayed. The measured time display region 93A serves as a scale when the indicating hand functions as the hour chronograph hand, and the configuration is the same as that in the above-described embodiment.

In this modification example, since display for the leap second reception mode is added, the user can confirm that the electronic timepiece 10 is performing the leap second reception processing. In general, the leap second is updated on July $1^{st}$ or January $1^{st}$. Therefore, during the three months immediately before the leap second updating date, specifically, during the period of April $1^{st}$ to June $30^{th}$ and October $1^{st}$ to December $31^{st}$, it is preferable to perform the leap second reception processing and to confirm whether or not the leap second is updated. For this reason, the control device 300 performs leap second acquisition processing during the above-described period and when leap second information is not yet acquired. In this case, the indicating hand 91 is driven by the drive mechanism 140 so as to indicate the mark "LS.", and indicates the mark "TIME" if the leap second information is completely acquired.

Even in this modification example, during the normal time display, the indicating hand 91 indicates the mark "OFF". If the B-button 62 of the second operation unit 157B is pressed down, the second function unit 301 performs the reception processing of the satellite signal, and the indicating hand 91 indicates any one of the marks among "TIME", "FIX", and "LS.". If the C-button 63 of the first operation unit 157A is pressed down, the mode is switched over to the chronograph function similarly to in the above-described embodiment, and the indicating hand 91 indicates the mark "0" on the side of 12 o'clock.

In this modification example, the mark "LS." for indicating the leap second reception mode is added to the reception mode. Accordingly, the user can confirm whether or not the electronic timepiece 10 is receiving the leap second information. In this regard, it is also possible to improve usability.

Figure 11C:
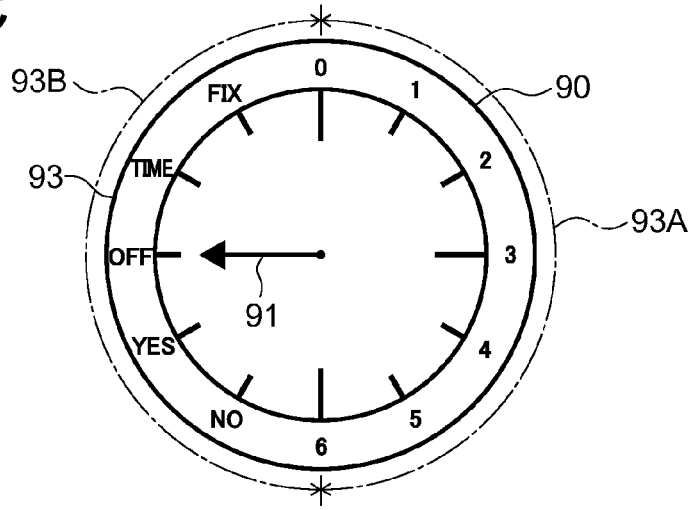

As illustrated in FIG. 11C, a scale for indicating the reception result in addition to the reception mode may be added to the reception state display region 93B for displaying the reception state. That is, the marks "OFF", "TIME", and "FIX" for indicating the reception mode, and marks "YES" and "NO" for indicating the reception result are displayed on the reception state display region 93B. The measured time display region 93A is a scale when the indicating hand functions as the hour chronograph hand, and the configuration is the same as that in the above-described embodiment.

Even in this modification example, during the normal time display, the indicating hand 91 indicates the mark "OFF". If the B-button 62 of the second operation unit 157B is pressed down, the second function unit 301 performs the reception processing of the satellite signal, and the indicating hand 91 indicates either the mark "TIME" or the mark "FIX". If the C-button 63 of the first operation unit 157A is pressed down, the mode is switched over to the chronograph function similarly to in the above-described embodiment, and the indicating hand 91 indicates the mark "0" on the side of 12 o'clock.

Then, in the reception result display processing S17, the indicating hand 91 indicates the previous reception mode. After a fixed time period elapses, or when the B-button 62 is pressed again, the indicating hand 91 shows the previous reception result by indicating a success (YES) or a failure (NO) in the reception state display region 93B.

In this example, the scales for indicating the reception mode and the reception result are set in the reception state display region 93B. Accordingly, the user can confirm the reception mode and the reception result by confirming only the indicated scale of one indicating hand 91. Therefore, as compared to a case where the indicating hand for indicating the reception mode is disposed separately from the indicating hand for indicating the reception result, the user is likely to confirm the indicated content. In this regard, it is also possible to improve usability.

Figure 12A:
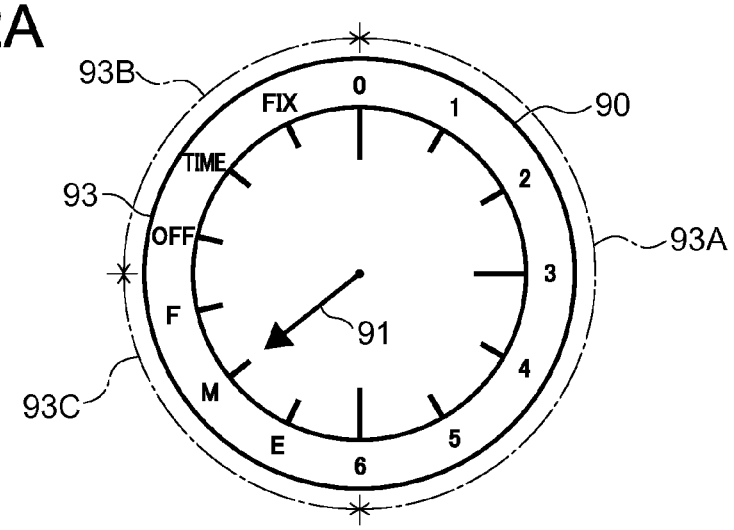
FIGS. 12A to 12C are schematic views illustrating the third small window according to another modification example.
Figure 12B:
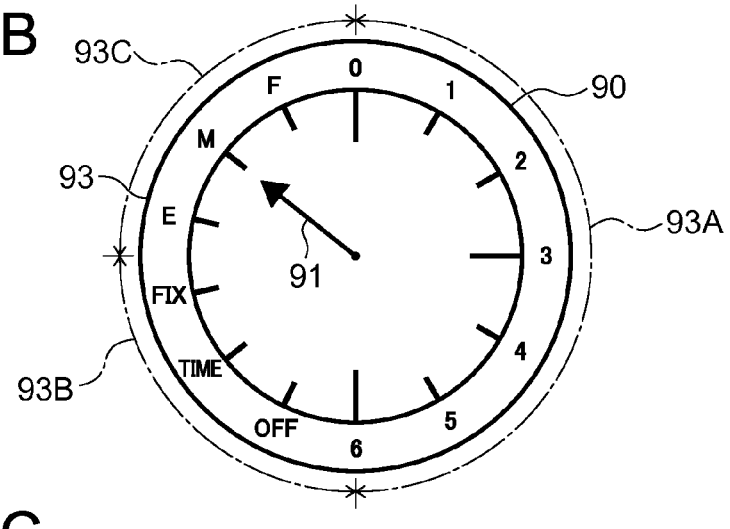
Figure 12C:
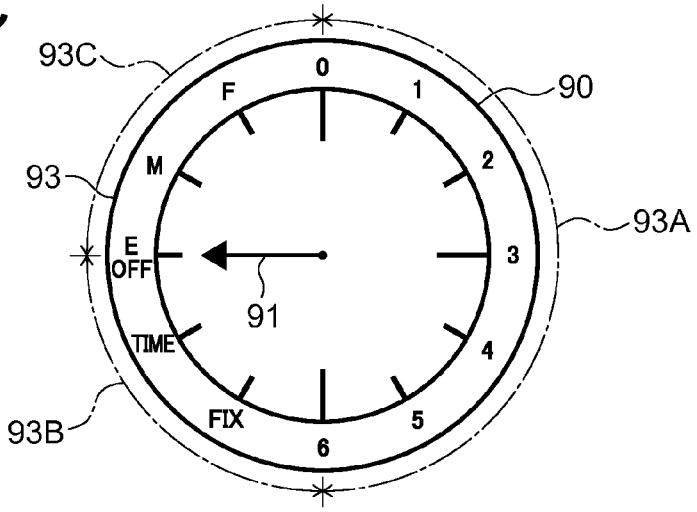

Furthermore, as illustrated in FIGS. 12A to 12C, two display regions such as the reception state display region 93B and the voltage state display region 93C may be set in the left half region of the scale display unit 93. Similar to the above-described embodiment, the reception state display region 93B displays the reception mode (OFF, TIME, and FIX), and the voltage state display region 93C displays the battery residual capacity (E, M, and F). In FIGS. 11A to 11C, the display marks are arrayed in a sequentially different manner. In FIG. 12A, the marks "E, M, F, OFF, TIME, and FIX" are arrayed clockwise from the lower side in the left half region of the scale display unit 93. In FIG. 12B, the marks "OFF, TIME, FIX, E, M, F" are arrayed clockwise from the lower side in the left half region of the scale display unit 93. In addition, in FIG. 12C, the marks "FIX, TIME, OFF, E, M, F" are arrayed clockwise from the lower side in the left half region of the scale display unit 93. The mark "OFF" means the reception prohibition mode. The mark "E' means a control mode for prohibiting the reception processing due to insufficient battery residual capacity. Both cases are the same in that the reception processing cannot be started. Accordingly, in FIG. 12C, the marks "OFF" and "E" are displayed at the same position.

In these modification examples, during the normal time display, the indicating hand 91 indicates the battery residual capacity in the voltage state display region 93C. If the B-button 62 of the second operation unit 157B is pressed down, the second function unit 301 performs the reception processing of the satellite signal, and the indicating hand 91 indicates either the mark "TIME" or the mark "FIX". If the C-button 63 of the first operation unit 157A is pressed down, the mode is switched over to the chronograph function similar to the above-described embodiment, and the indicating hand 91 indicates the mark "0" on the side of 12 o'clock.

According to these display examples, as compared to the above-described embodiment, the display for setting the DST, that is, the summer time display region 93D is not disposed in the scale display unit 93. Accordingly, the user is likely to confirm the indicated scale of the indicating hand 91, and thus, it is possible to improve usability.

Figure 13:
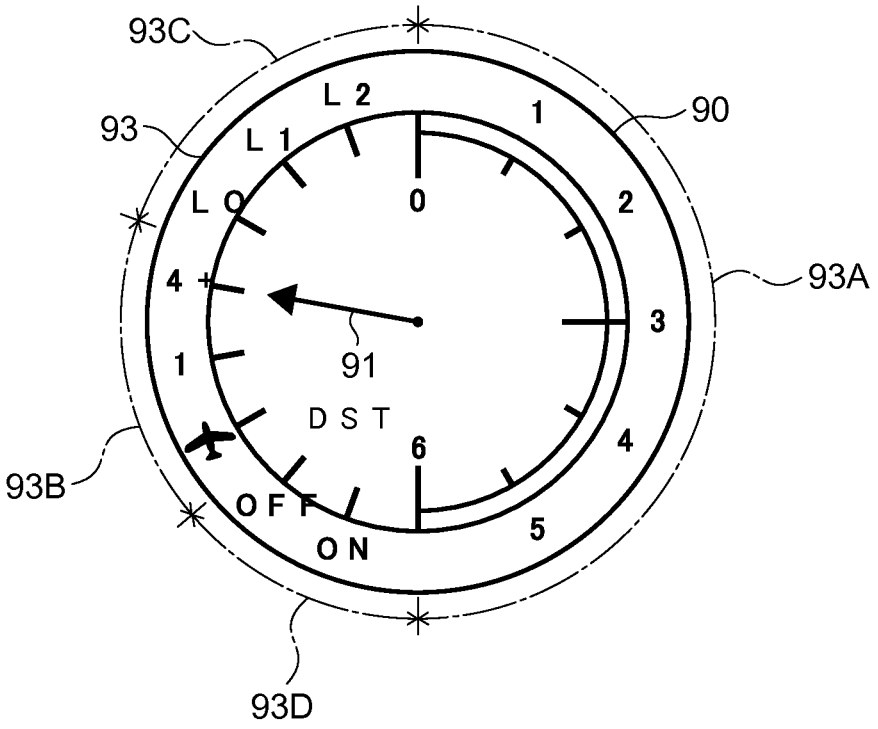
FIG. 13 is a schematic view illustrating the third small window according to another modification example.

In FIG. 13, a display position of the reception state display region 93B and the voltage state display region 93C is changed in the electronic timepiece 10 according to the above-described embodiment, and further the marks (symbols) displayed in the reception state display region 93B, the voltage state display region 93C, and the summer time display region 93D are changed. That is, instead of the marks "E, M, and F" of the battery residual capacity, marks "L0, L1, and L2" are displayed, and instead of the marks "FIX, TIME, and OFF" of the reception mode, marks "4+", "1", and an airplane mark are displayed. In addition, in the modification example, the displayed symbols are only different from those in the above-described embodiment. Accordingly, if the various buttons 61 to 64 are operated, the indicating hand 91 is driven similarly to in the above-described embodiment.

According to this modification example, the battery residual capacity (battery voltage) is displayed using the marks L0 to L2 which mean each level, and the reception mode is displayed using the positioning mode for receiving four or more satellite signals, the time measurement mode in which one satellite signal is sufficiently used, and the flight mode for prohibiting the reception. Accordingly, in some cases, the user is likely to understand the marks. Therefore, in those cases, it is possible to improve usability.

Figure 14A:
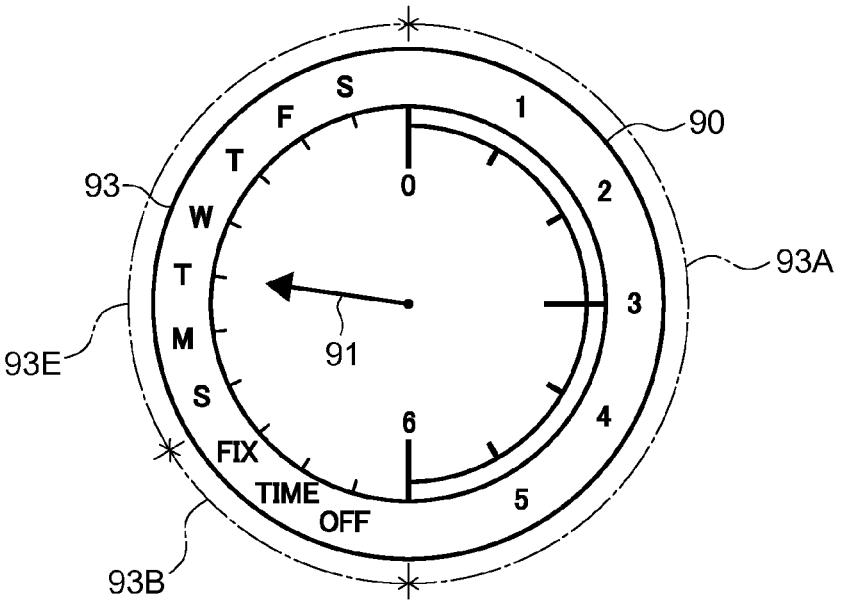
FIGS. 14A and 14B are schematic views illustrating the third small window according to another modification example.

As illustrated in FIG. 14A, two display regions such as the reception state display region 93B and a day display region (fifth display region) 93E may be set in the left half region of the scale display unit 93. Similarly to in the above-described embodiment, the reception state display region 93B displays the reception mode (OFF, TIME, and FIX). The day display region 93E displays the day of the week. In FIG. 14A, marks "S, M, T, W, T, F, and S" are displayed clockwise from below of the left half part of the day display region 93E, and respectively indicate "Sunday, Monday, Tuesday, Wednesday, Thursday, Friday, and Saturday".

The measured time display region 93A in the right half part of the scale display unit 93 is a scale when the indicating hand functions as the hour chronograph hand, and the configuration is the same as that in the above-described embodiment.

In this modification example, during the normal time display, the indicating hand 91 indicates any one of the marks "S, M, T, W, T, F, and S" in the day display region 93E. If the B-button 62 of the second operation unit 157B is pressed down, the second function unit 301 performs the reception processing of the satellite signal, and the indicating hand 91 indicates either the mark "TIME" or the mark "FIX". If the C-button 63 of the first operation unit 157A is pressed down, the mode is switched over to the chronograph function similarly to in the above-described embodiment, and the indicating hand 91 indicates the mark "0" on the side of 12 o'clock.

According to this display example, the indicating hand 91 can indicate the day. Therefore, it is possible to improve usability.

Figure 14B:
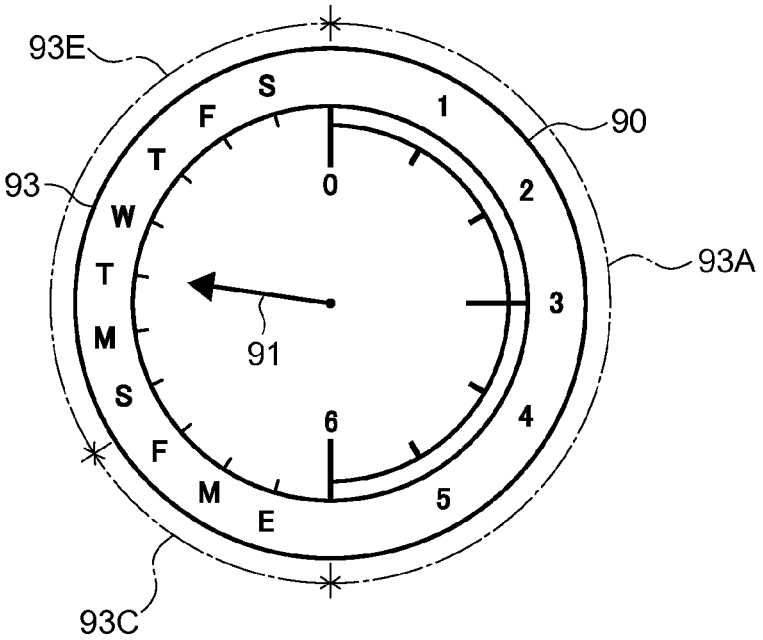

As illustrated in FIG. 14A, instead of the reception state display region 93B for displaying the reception state, the voltage state display region 93C for displaying the battery residual capacity may be provided. In FIG. 14B, similar to FIG. 14A, the marks "S, M, T, W, T, F, and S" are displayed on the day display region 93E, and the marks "E, M, and F" for indicating the battery residual capacity are displayed on the voltage state display region 93C.

The measured time display region 93A in the right half part of the scale display unit 93 is a scale when the indicating hand functions as the hour chronograph hand, and the configuration is the same as that in the above-described embodiment.

In this modification example, during the normal time display, the indicating hand 91 indicates the battery residual capacity in the voltage state display region 93C. If the B-button 62 of the second operation unit 157B is pressed down, the indicating hand 91 indicates any one of the marks "S, M, T, W, T, F, and S" in the day display region 93E. If the C-button 63 of the first operation unit 157A is pressed down, the mode is switched over to the chronograph function similarly to in the above-described embodiment, and the indicating hand 91 indicates the mark "0" on the side of 12 o'clock.

According to this display example, the indicating hand 91 can indicate the day. Therefore, it is possible to improve usability.

In the modification example, during the normal time display, the indicating hand 91 may indicate the day display region 93E, and may indicate the voltage state display region 93C, when the B-button 62 is pressed down.

Figure 15:
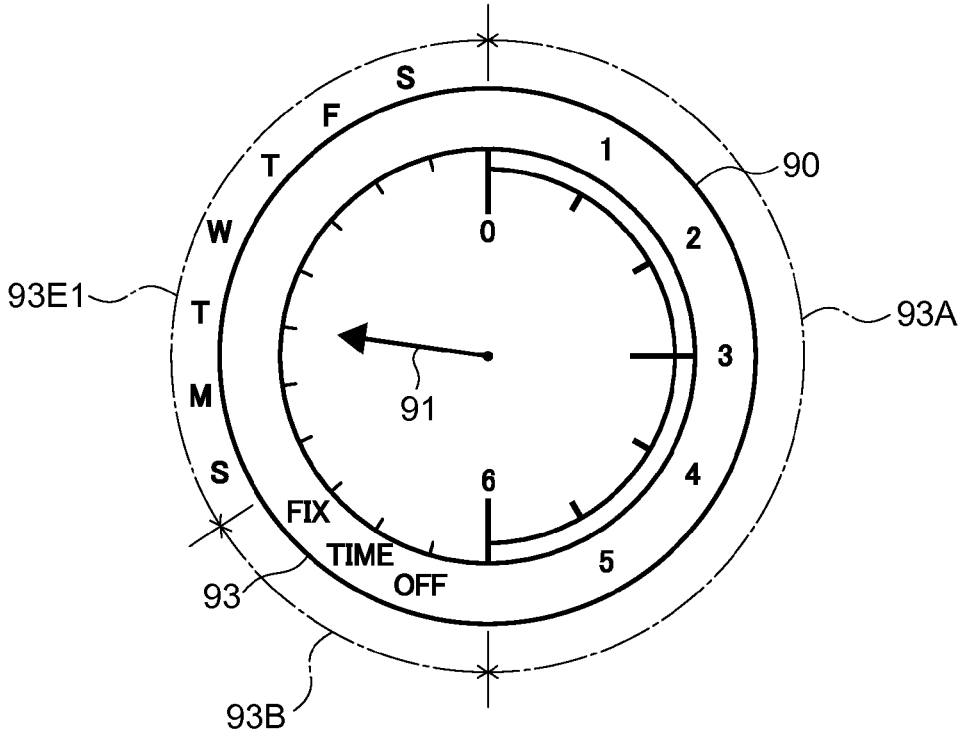
FIG. 15 is a schematic view illustrating the third small window according to another modification example.

As illustrated in FIG. 15, the reception state display region 93B may be disposed in the left half region of the scale display unit 93, and a day display region 93E1 may be disposed on the outer periphery (on a radius which is different from the scale in the reception mode) in the left half region of the scale display unit 93. In FIG. 15, similar to FIG. 14A, the reception state display region 93B displays the reception mode (OFF, TIME, and FIX). Then, the day display region 93E1 displays the marks "S, M, T, W, T, F, and S".

The measured time display region 93A in the right half part of the scale display unit 93 is a scale when the indicating hand functions as the hour chronograph hand, and the configuration is the same as that in the above-described embodiment.

In this modification example, during the normal time display, the indicating hand 91 indicates any one of the marks "S, M, T, W, T, F, and S" in the day display region 93E1. If the B-button 62 of the second operation unit 157B is pressed down, the second function unit 301 performs the reception processing of the satellite signal, and the indicating hand 91 indicates either the mark "TIME" or the mark "FIX". If the C-button 63 of the first operation unit 157A is pressed down, the mode is switched over to the chronograph function similarly to in the above-described embodiment, and the indicating hand 91 indicates the mark "0" on the side of 12 o'clock.

According to this display example, as compared to the above-described display example in FIG. 14A, the day display region 93E1 is disposed on the outer periphery of the scale display unit 93, that is, on the dial 11. Therefore, it is possible to set the distance between the indicating scales to be wider. Accordingly, the user can easily confirm which scale is indicated by the indicating hand 91, and thus, it is possible to improve usability.

Figure 16:
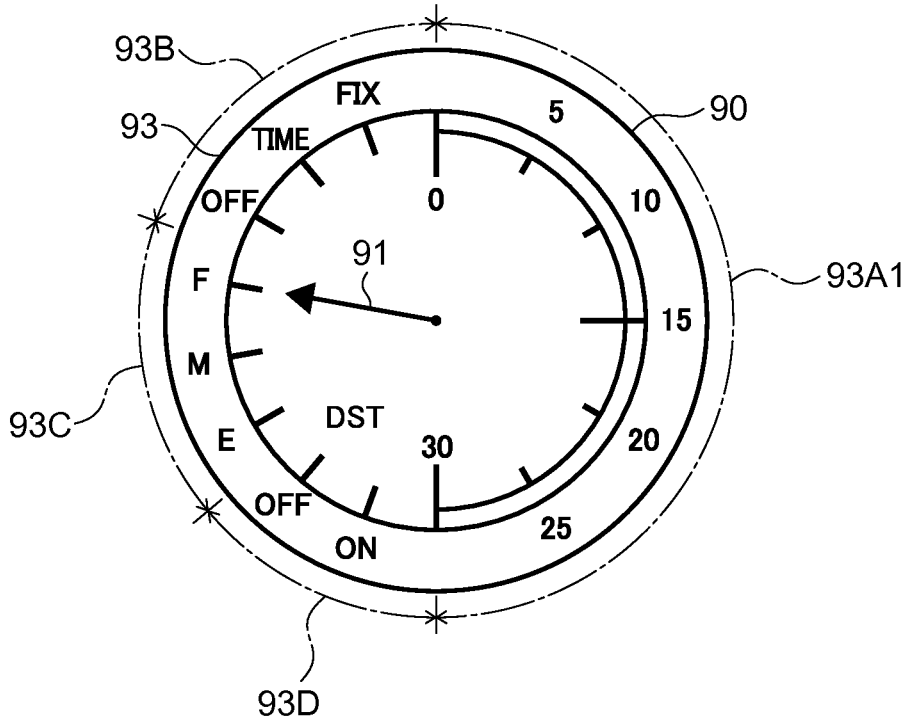
FIG. 16 is a schematic view illustrating the third small window according to another modification example.

As illustrated in FIG. 16, a measured time display region 93A1 for indicating measured time of a countdown timer may be disposed in the right half region of the scale display unit 93. The respective display regions 93B, 93C, and 93D which are located in the left half region of the scale display unit 93 are the same as those in the above-described embodiment. In this modification example, the first function unit 330 executes a countdown timer function. That is, the first function unit 330 can function as the countdown timer for the maximum of 30 minutes by setting the measurement time. Therefore, the indicating hand 91 moves counterclockwise by six degrees per every minute, thereby enabling the first function unit 330 to count the time until the indicating hand 91 reaches the position of zero minutes.

The modification example is different from the above-described embodiment only in that the chronograph function is changed to the countdown timer function. Accordingly, if the various buttons 61 to 64 are operated, the indicating hand 91 is driven similarly to in the above-described embodiment.

In this example, the first function unit 330 is enabled to function as the countdown timer. Accordingly, when the remaining time is measured, the function is very conveniently used. In this example, the measurement time is set to the maximum of 30 minutes, but is not limited thereto. For example, the first function unit 330 may function as the countdown timer working for the maximum of six hours by causing the configuration of the scale display unit 93 to be the same as that in the right half part in FIG. 2. According to this configuration, the indicating hand 91 moves counterclockwise by an amount of minus one scale per every hour. Accordingly, the first function unit 330 can be used as the countdown timer for a longer time period. In this regard, it is also possible to improve usability.

A measurement value which is located in the right half part of the scale display unit 93 and is indicated by the indicating hand 91 is not limited to the chronograph time and the time of the countdown timer. For example, detected measurement values may be indicated by the indicating hand 91 by disposing various sensors (for example, barometers, altimeters, depth gauges, thermometers, accelerometers, azimuth meters, hygrometers, and pedometers) in the electronic timepiece 10. In addition, numeric values (for example, calorie consumption) calculated based on the measurement value detected by the above-described various sensors may be indicated by the indicating hand 91.

In short, the second function unit for time measurement 310 and the second function unit for positioning 320 execute the time measurement reception function and the positioning reception function. However, the first function unit 330 may be configured to be capable of executing the other function. Furthermore, multiple functions other than the reception function may be set. For example, as in the above-described embodiment or the modification examples, in addition to the first function unit 330 for executing the chronograph function, a fourth function unit having a battery residual capacity display function or a measurement function such as thermometers, altimeters, and pulse rate meters may be provided. Furthermore, another function may be provided as a fifth function unit.

In the above-described embodiment, the A-button 61 and the B-button 62 of the second operation unit 157B and the C-button 63 and the D-button 64 of the first operation unit 157A may be disposed on the laterally opposite side of the exterior case 30. In this case, the measured time display region 93A of the scale display unit 93 may be disposed on the left side based on the virtual line connecting 12 o'clock and 6 o'clock, and the reception state display region 93B may be disposed on the right side based on the virtual line. That is, the measured time display region 93A of the scale display unit 93 and the C-button 63 and the D-button 64 of the first operation unit 157A, and the reception state display region 93B of the scale display unit 93 and the A-button 61 and the B-button 62 of the second operation unit 157B may be respectively disposed in the same direction based on the virtual line. Furthermore, the measured time display region 93A may be disposed on the upper side based on the virtual line connecting 9 o'clock and 3 o'clock, and the reception state display region 93B may be disposed on the lower side. Similarly even in this case, the C-button 63 and the D-button 64 of the first operation unit 157A are disposed on the upper side of the exterior case 30, and the A-button 61 and the B-button 62 of the second operation unit 157B are disposed on the lower side of the exterior case 30. In addition, in view of the relationship therebetween, the disposition may be vertically inverted.

However, if operability of the chronograph function is considered, since a user generally uses a timepiece by wearing the timepiece on his or her left arm, it is most preferable to adopt the arrangement of the respective display regions according to the above-described embodiment.

As the operation unit, an independent button may be provided for each function unit. For example, the A-button 61 may serve as a first button, the B-button 62 may serve as a second button, and the C-button 63 may serve as a third button. If the A-button 61 is pressed, the second function unit for time measurement 310 may be operated. If the B-button 62 is pressed, the second function unit for positioning 320 may be operated. If the C-button 63 is pressed, the first function unit 330 may be operated.

As the operation unit, each function unit may be selected by changing a time period for pressing one button. For example, a configuration may be adopted so that the second function unit for time measurement 310 is operated if the B-button 62 is pressed for a first setting time period (for example, three seconds or more and less than six seconds), and so that the second function unit for positioning 320 is operated if the B-button 62 is pressed for a second setting time period (for example, six seconds or more). In short, each operation unit for executing each function may be associated with the display region for displaying the content of each function.

The number of buttons may be set in view of the number of function units and design of the electronic timepiece 10.

In the above-described embodiment, the scale display unit 93 disposed on the outer periphery of the third small window 90 is configured to have an annular shape, but the shape is not limited thereto. For example, a rectangular shape may be employed, a fan shape may be employed, or a rod shape may be employed. Furthermore, the scale display unit 93 may not be disposed on the outer periphery of the third small window 90. For example, the scale display unit may be disposed on the outer periphery of the dial 11, or may be disposed in the bezel 32. In this case, the scale display unit may be indicated by the indicating hand 21.

A configuration may be adopted so that the respective display regions 93A to 93D can be indicated by the same indicating hand 91. Accordingly, without being limited to a configuration in which the respective display regions 93A to 93D are arranged on the same circumference, a distance (radius) from the rotation axis of the indicating hand 91 to the respective display regions 93A to 93D may be different.

In the above-described embodiment, the reception state display region 93B is configured to have the symbols for displaying the time measurement reception mode, the positioning reception mode, and the reception prohibition mode of the satellite signal, but the configuration is not limited thereto. For example, the captured satellite number may be displayed thereon. That is, as long as the symbol displays the information related to the reception of the satellite signal, any content and the symbol for displaying the content may be displayed.

In the above-described embodiment, the position of the respective small windows 70, 80, and 90 is not limited thereto. The respective small windows 70, 80, and 90 may be respectively disposed at different positions.

A case where the indicating hand 91 indicates the voltage state display region 93C is not limited to a case where the normal time display mode is selected (during the normal time display). For example, in a case where the indicating hand 91 indicates a state other than the voltage state (during the time measurement reception processing, the positioning reception processing, and the execution of the chronograph function, and during the display of the summer time ON and OFF), the indicating hand 91 indicates the respective display regions 93A, 93B, and 93D. Consequently, the indicating hand 91 cannot indicate the voltage state display region 93C. However, in the other cases (for example, in a case where the time setting is performed by operating the crown 50), the indicating hand 91 may be configured to indicate the voltage state display region 93C. In addition, in a case where a user performs an operation for giving an instruction to display the voltage, the indicating hand 91 may also indicate the voltage state display region 93C.

The control device 300 may execute the power supply voltage detection function during the time measurement reception processing, the positioning reception processing, and the execution of the chronograph function. For example, in this case, the indicating hand 91 may not indicate the voltage state display region 93C. The indicating hand 91 may indicate the various display regions 93A and 93B corresponding to each function.

As an example of the position information satellite, the GPS satellite 8 has been described, but is not limited thereto. For example, as the position information satellite, other satellites such as Galileo (EU), GLONASS (Russia), and Beidou (China) which use the global public navigation satellite system (GNSS) can be employed. In addition, geostationary satellites using a satellite based augmentation system (SBAS) or satellites such as quasi-zenith satellites which can search for a specific territory can also be employed.

Second Embodiment

Next, a second embodiment of the invention will be described with reference to the drawings.

An electronic timepiece 10*a* according to the second embodiment is different from the electronic timepiece 10 according to the first embodiment in that a dial and an indicating hand are partially different, but the other configurations are the same as each other. Description of the configurations which are the same as those in the electronic timepiece 10 will be omitted. In addition, the same reference numerals are given to the configurations which are the same as those in the electronic timepiece 10.

The electronic timepiece 10*a* according to the embodiment has a world time function and a chronograph function. For example, the world time function is to display the current time by receiving an external signal transmitted from a navigation satellite such as the GPS (GPS satellite) and calculating position information and time information of the current location. The chronograph function has a so-called stopwatch function which integrates (e.g. determines an elapsed time starting from a user-specified time) and displays the time (i.e. the elapsed time).

Figure 17:
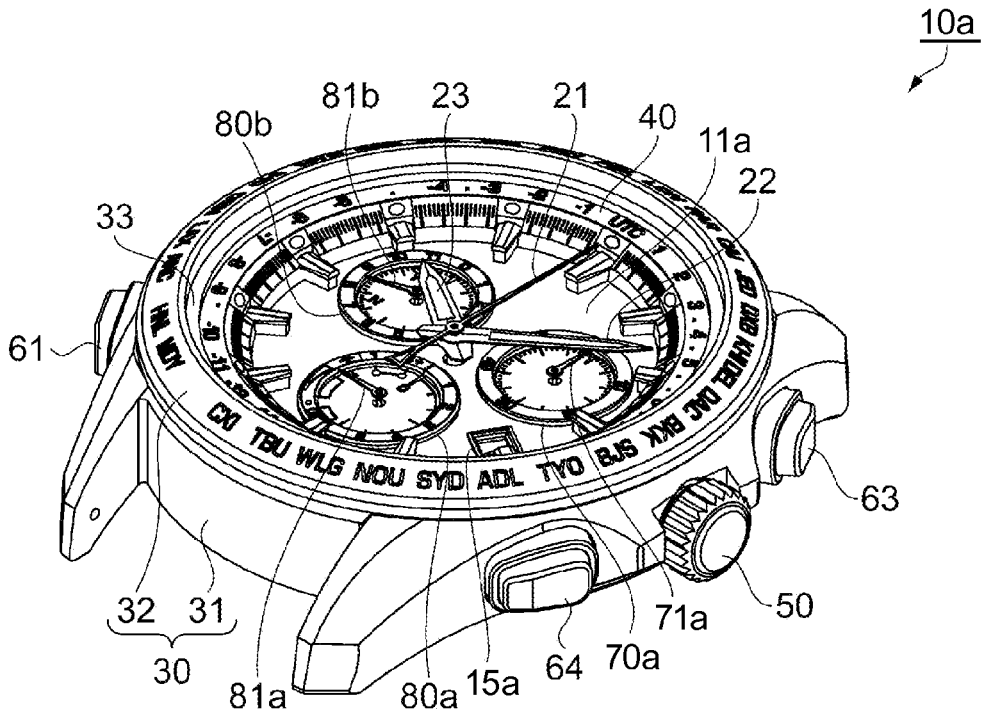
FIG. 17 is a perspective view illustrating an overall electronic timepiece according to a second embodiment of the invention.

A schematic configuration of the electronic timepiece 10*a* will be described. FIG. 17 is a perspective view illustrating appearance of the electronic timepiece. FIGS. 18A to 18F are six different views illustrating the appearance of the electronic timepiece. FIG. 19 is a partial cross-sectional view illustrating the schematic configuration of the electronic timepiece.

Figures 18A, 18B, 18C, 18D, 18E, 18F:
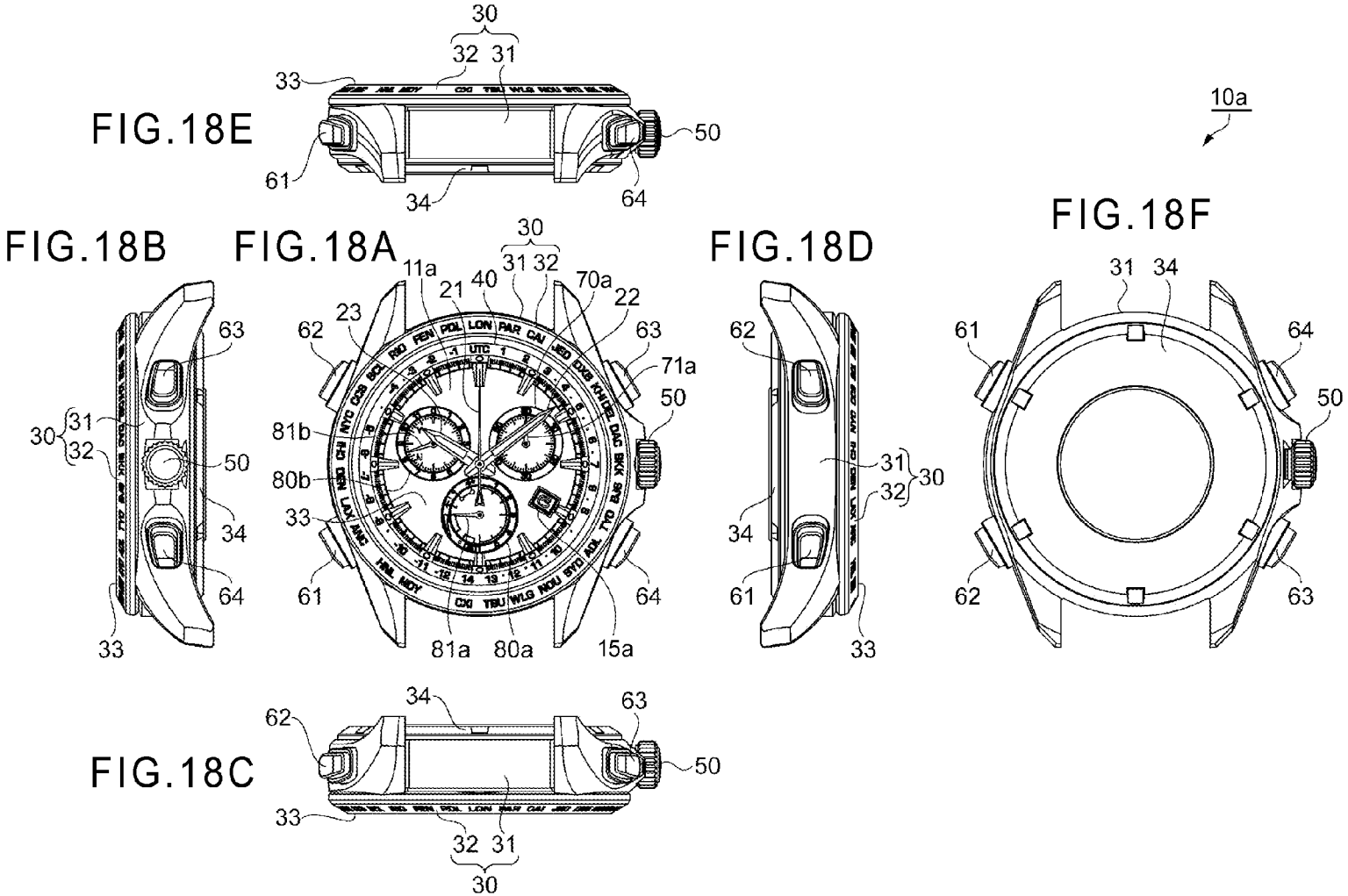
FIG. 18A is a plan view when the electronic timepiece according to the second embodiment is viewed from the front surface side.
FIG. 18B is a side view when the electronic timepiece according to the second embodiment is viewed in a direction from 3 o'clock to 9 o'clock.
FIG. 18C is a side view when the electronic timepiece according to the second embodiment is viewed in a direction from 12 o'clock to 6 o'clock.
FIG. 18D is a side view when the electronic timepiece according to the second embodiment is viewed in a direction from 9 o'clock to 3 o'clock.
FIG. 18E is a side view when the electronic timepiece according to the second embodiment is viewed in a direction from 6 o'clock to 12 o'clock.
FIG. 18F is a plan view when the electronic timepiece according to the second embodiment is viewed from a rear surface side.
Figure 19:
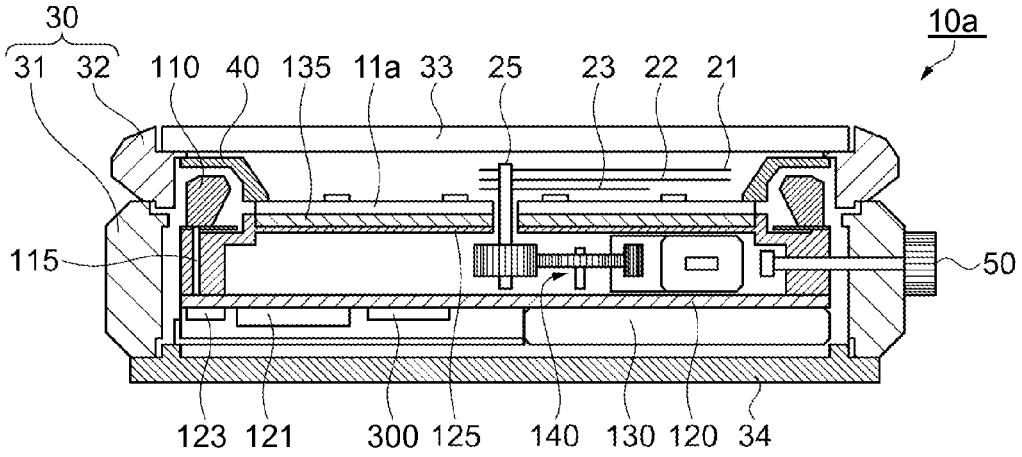
FIG. 19 is a partial cross-sectional view of the electronic timepiece according to the second embodiment.

FIG. 18A is a plan view when the electronic timepiece is viewed from a front surface side. FIG. 18B is a side view when the electronic timepiece is viewed in the direction from 3 o'clock to 9 o'clock. FIG. 18C is a side view when the electronic timepiece is viewed in the direction from 12 o'clock to 6 o'clock. FIG. 18D is a side view when the electronic timepiece is viewed in the direction from 9 o'clock to 3 o'clock. FIG. 18E is a side view when the electronic timepiece is viewed in the direction from 6 o'clock to 12 o'clock. FIG. 18F is a plan view when the electronic timepiece is viewed from a rear surface side.

A dial 11*a* of the electronic timepiece 10*a* includes first small timepieces (or sub-displays or segmented displays) 80*a* and 80*b* including an information display unit for displaying multiple information items related to at least one of the world time function and the chronograph function, a second small timepiece 70*a* including integration value display 72 related to the chronograph function, and calendar display 15*a*. The dial 11*a*, the indicating hands 21, 22, and 23, the first small timepieces 80*a* and 80*b*, the second small timepiece 70*a*, and the calendar display 15*a* are visible through the cover glass 33.

In the electronic timepiece 10*a*, when one round of the scale disposed on the outer periphery of the dial 11*a* is displayed by 12 hours, alphabet letters "UTC" marked in the dial ring 40 are located at the position of 12 o'clock, and the first small timepiece 80*a* is disposed in the direction of 6 o'clock from the center of the dial 11*a*. The circular first small timepiece 80*a* including the information display unit in which multiple information items are displayed on the outer peripheral section, and an indicating hand 81*a* for indicating the information display unit is arranged at a position overlapping a straight line connecting the position of 12 o'clock and the position of 6 o'clock in the dial 11*a*.

The first small timepiece 80*b* is disposed in the direction of 10 o'clock from the center of the dial 11*a*. The circular first small timepiece 80*b* including the information display unit in which multiple information items are displayed on the outer peripheral section, and an indicating hand 81*b* for indicating the information display unit is arranged at a position overlapping a straight line connecting the position of 3 o'clock and the position of 9 o'clock in the dial 11*a*.

The second small timepiece 70*a* is disposed in the direction of 2 o'clock from the center of the dial 11*a*. The circular second small timepiece 70*a* including the information display unit in which multiple information items are displayed on the outer peripheral section, and an indicating hand 71*a* for indicating the information display unit is arranged at a position overlapping a straight line connecting the position of 3 o'clock and the position of 9 o'clock in the dial 11*a*.

The calendar display 15*a* is disposed in the direction of 4 o'clock from the center of the dial 11*a*. The rectangular calendar display 15*a* for displaying the information such as the calendar date (date, month, and year) and the day is arranged in the center along a straight line connecting the center and the position of 4 o'clock in the dial 11.

In the electronic timepiece 10*a* according to the embodiment, even using limited space, the first small timepieces 80*a* and 80*b*, the second small timepiece 70*a*, and the calendar display 15*a* are arranged at a well-balanced position in terms of design. Accordingly, multiple information items can be visibly displayed on the dial 11*a* by improving the design. In addition, since a user generally wears a wrist timepiece on his or her left arm in many cases, the calendar display 15*a* is disposed in the direction of 4 o'clock. Accordingly, visibility of the calendar display 15*a* can be improved for many users.

In the above-described electronic timepiece 10*a*, the embodiment has been described in which the first small timepieces 80*a* and 80*b*, the second small timepiece 70*a*, and the calendar display 15*a* are disposed in the dial 11*a*. However, in addition to this configuration, the electronic timepiece 10*a* may be configured so that at least the first small timepieces 80*a* and 80*b* are disposed in the dial 11*a*.

In addition, the electronic timepiece 10*a* may be configured so that at least the first small timepieces 80*a* and 80*b*, and the second small timepiece 70*a* are disposed in the dial 11*a*.

In any case, even using limited space, the first small timepieces 80*a* and 80*b*, and/or the second small timepiece 70*a* can be arranged at a well-balanced position in terms of design. Accordingly, multiple information items can be visibly displayed on the dial 11*a*.

The dial 11*a*, the solar panel 135, and the main plate 125 have holes through which the indicating hand axle 25, and indicating hand axles (not illustrated) of the indicating hand 81*a* of the first small timepiece 80*a*, the indicating hand 81*b* of the first small timepiece 80*b*, and the indicating hand 71*a* of the second small timepiece 70*a* penetrate, and have an opening section of the calendar display 15*a*.

The indicating hand 81*a* of the first small timepiece 80*a*, the indicating hand 81*b* of the first small timepiece 80*b*, and the indicating hand 71*a* of the second small timepiece 70*a* are driven by the drive mechanism 140.

The circuit board 120 includes a balun 123 in addition to the reception unit 121 and the control device 300. The balun 123 is balance-unbalance transducer, and converts a balanced signal transmitted from the antenna body 110 operated by balanced power supply into an unbalanced signal which can be handled by the reception unit 121.

In the embodiment, the electronic timepiece 10*a* employs the power generation using the solar panel 135 and the secondary battery 130 as a drive source. However, a primary battery system, or the other charging system may be employed. It is possible to simplify a mechanism inside the exterior case 30 by employing the primary battery system as the drive source. In addition, the electronic timepiece 10*a* according to the invention can be used even in a place having light illumination insufficient for employing the secondary battery charged using a charging system such as electromagnetic induction as the drive source, or even in a place where battery replacement is difficult.

Figure 20:
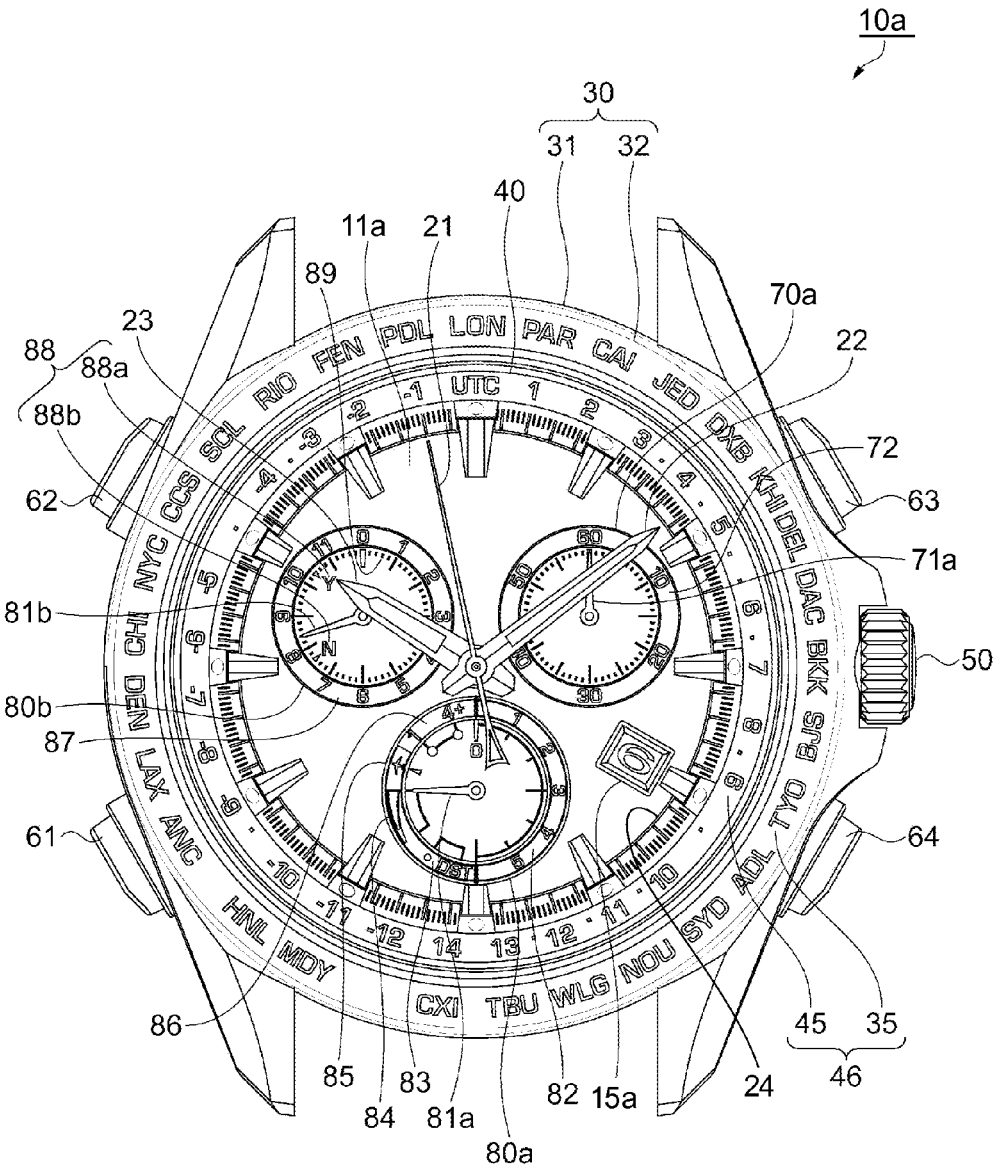
FIG. 20 is a schematic plan view illustrating the appearance of the electronic timepiece according to the second embodiment.

Next, a display function of the information display unit of the electronic timepiece 10*a* will be described. FIG. 20 is a schematic plan view illustrating the appearance of the electronic timepiece.

In the electronic timepiece 10*a* according to the embodiment, the dial 11*a* includes a time display unit (time display) for displaying the current time (internal time) obtained by the world time function, and an integration display unit (integration display) for displaying the time integrated by the chronograph function.

The time display unit is a general term for the time-hour display indicating the "hour", the time-minute display indicating the "minute", and the time-second display indicating the "second".

The integration display unit is a general term for the integrated hour display indicating the "hour", the integrated minute display indicating the "minute", and the integrated second display indicating the "second".

As illustrated in FIG. 20, the dial 11*a* includes time-minute display 24 having a marked scale (minute scale) dividing the outer periphery into 60 portions, and time-hour display having a marked scale (hour scale) dividing the outer periphery into 12 portions. The indicating hand 22 indicates the "minute" of the local time (internal time) obtained by the world time function using the time-minute display. In addition, the indicating hand 23 indicates the "hour" of the local time (internal time) obtained by the world time function using the time-hour display. The outermost periphery of the dial 11*a* includes integrated second display having a marked one-fifth scale which further divides the 60 portion-divided scale into five portions. The indicating hand 21 indicates the "second" of the time integrated by the chronograph function using the integrated second display. The chronograph function can be used by operating the C-button 63 and the D-button 64.

Next, the information display unit of the circular first small timepiece 80*a* disposed in the dial 11*a* will be described. In the following description of the range of the outer periphery, although a "direction of n o'clock" (n is an arbitrary natural number) will be used, this direction represents a direction when the outer periphery is viewed from the circular center in a case where the mark "0" displayed in the first small timepiece 80*a* is set to 12 o'clock and the outer periphery is displayed by 12 hours. In addition, although the "range in the direction from n o'clock to m o'clock" (n and m are arbitrary natural numbers) will be used, this range is a range displayed by turning clockwise around the center of the first small timepiece 80*a*.

The first small timepiece 80*a* includes an integrated hour display 82, a charged capacity display 84, a summer time display 83 related to the world time function, a reception prohibition display 85, a reception permission display (also used as the charged capacity display 84), and a reception mode display 86.

The integrated hour display 82 is disposed in the range in the direction from 12 o'clock to 6 o'clock on the outer periphery of the first small timepiece 80*a*. A scale dividing the range into six portions and numbers from "0" to "5" are marked in the integrated hour display 82. The indicating hand 81*a* indicates the "hour" of the time integrated by the chronograph function using the integrated hour display 82.

The summer time display 83 is disposed in the range in the direction from 6 o'clock to 7 o'clock on the outer periphery of the first small timepiece 80*a*. Alphabet letters "DST" and a mark "O" are marked in the summer time display 83. The daylight saving time (DST) means the summer time, and the alphabet letters and the symbol represent the setting of the summer time (DST: summer time ON, O: summer time OFF).

A user operates the crown 50 and the B-button 62, and aligns the indicating hand 81*a* with the alphabet letters "DST" or the mark "O". In this manner, the user can set the summer time ON/OFF in the electronic timepiece 10*a*.

The charged capacity display 84 is disposed in the range in the direction from 7 o'clock to 9 o'clock on the outer periphery of the first small timepiece 80*a*. In the charged capacity display 84, a power indicator of the secondary battery 130 is marked using a crescent sickle-shaped symbol in which a proximal end in the direction of 9 o'clock is thick and a distal end in the direction of 7 o'clock is thin along the outer circumference. Depending on the battery residual capacity, the indicating hand 81*a* indicates any one of the proximal end, the middle, and the distal end.

The reception prohibition display 85 is disposed in the range in the direction from 9 o'clock to 10 o'clock on the outer periphery of the first small timepiece 80*a*. The reception prohibition display 85 includes an airplane-shaped symbol marked thereon, and displays the reception prohibition setting of the satellite signal. During takeoff and landing of aircraft, reception of the satellite signal is prohibited by the Aviation Law. Accordingly, this setting is called a flight mode. A user operates the A-button 61, moves a tip indicated by the indicating hand 81*a*, and selects the reception prohibition display 85 (flight mode). In this manner, it is possible to cause the electronic timepiece 10*a* to stop the reception of the satellite signal.

The reception permission display is disposed so as to be also used as the above-described charged capacity display 84. The user operates the A-button 61, and moves the tip indicated by the indicating hand 81*a* from the reception prohibition display 85 (flight mode) to the charged capacity display 84. In this manner, it is possible to allow the electronic timepiece 10*a* to receive the satellite signal. In the embodiment, description is made so that the reception permission display is also used as the charged capacity display 84, but the reception permission display and the charged capacity display 84 may be respectively provided.

The reception mode display 86 is disposed in the range in the direction from 10 o'clock to 12 o'clock on the outer periphery of the first small timepiece 80*a*. Number "1" and "4+" and a symbol are marked in the reception mode display 86, and these numbers and symbol represent the reception mode of the satellite signal. The number "1" means that the GPS time information is received and the internal time is corrected, and the number "4+" means that the GPS time information and the orbit information are received and the internal time and the time zone (to be described later) are corrected. A user operates the B-button 62 so that the indicating hand 81*a* indicates either the number "1" or the number "4+". In this manner, the electronic timepiece 10*a* displays the reception mode of the satellite signal received immediately before.

In the above-described electronic timepiece 10*a*, an embodiment has been described in which the integrated hour display 82, the charged capacity display 84, the summer time display 83, the reception prohibition display 85, the reception permission display, and the reception mode display 86 are disposed in the first small timepiece 80*a*. However, instead of this configuration, a configuration may be adopted in which the information display unit for displaying multiple information items including at least the above-described integrated hour display 82 and the charged capacity display 84 of the secondary battery is disposed in the first small timepiece 80*a*.

Alternatively, a configuration may be adopted in which the information display unit for displaying multiple information items including at least the above-described integrated hour display 82 and the summer time display 83 related to the world time function is disposed in the first small timepiece 80*a*, or a configuration may be adopted in which the information display unit for displaying multiple information items including at least the above-described integrated hour display 82 and the reception prohibition display 85 of the satellite signal is disposed in the first small timepiece 80*a*.

Furthermore, a configuration may be adopted in which the information display unit for displaying multiple information items including at least the above-described integrated hour display 82 and the reception permission display of the satellite signal is disposed in the first small timepiece 80*a*, or a configuration may be adopted in which the information display unit for displaying multiple information items including at least the above-described integrated hour display 82 and the reception mode display 86 of the satellite signal is disposed in the first small timepiece 80*a*.

In addition, the first small timepiece 80*a* may display the integration display unit (any one of the integrated hour display 82, the integrated minute display 72, and the integrated second display) and at least one of the summer time display 83, the charged capacity display 84, the reception prohibition display 85, the reception mode display 86, the reception result display 88, the captured satellite number display 87, the time-second display 89, the time-minute display, the time-hour display, the day display, and the calendar display.

The dial 11*a* may display the integration display unit (any one of the integrated hour display 82, the integrated minute display 72, and the integrated second display) and at least one of the summer time display 83, the charged capacity display 84, the reception prohibition display 85, the reception mode display 86, the reception result display 88, the captured satellite number display 87, the time-second display 89, the time-minute display, the time-hour display, the day display, and the calendar display.

Next, the information display unit of the circular first small timepiece 80*b* disposed in the dial 11*a* will be described.

The captured satellite number display 87, the time-second display 89 of the local time, and the reception result display 88 of the satellite signal are disposed in the first small timepiece 80*b*.

The captured satellite number display 87 is disposed on the outer periphery of the first small timepiece 80*b*. A scale dividing the outer periphery into 12 portions and numbers from "zero" to "11" are marked in the captured satellite number display 87. When a user operates the B-button 62 and causes the electronic timepiece 10*a* to manually receive the satellite signal, the indicating hand 81*b* indicates the captured satellite number displaying the number of the GPS satellites 8 from which the satellite signal can be received, by indicating any number from the numbers "zero" to "11". In this manner, the captured satellite number is displayed.

The time-second display 89 is disposed on the outer periphery of the first small timepiece 80*b*. A scale dividing the outer periphery into 60 portions is disposed in the time-second display 89. The indicating hand 81*b* indicates the "second" of the local time (internal time) by suing the time-second display 89.

The reception result display 88 is marked and disposed at a position where alphabet "Y" display 88*a* in a range from 45 seconds to 60 seconds in the time-second display 89 of the first small timepiece 80*b* and alphabet "N" display 88*b* in a range from 30 seconds to 45 seconds are line-symmetric to a straight line connecting 15 seconds and 45 seconds, and do not overlap a long scale dividing the outer periphery of the first small timepiece 80*b* into 12 portions. In this manner, the scale dividing the outer periphery of the first small timepiece 80*b* into 12 portions, the scale dividing the same into 60 portions, and the reception result display 88 can be arranged within the first small timepiece 80*b* having a small area by using well-balanced layout while readability is ensured. The alphabet letters "Y" display 88*a* and "N" display 88*b* represent setting for the reception result of the satellite signal (Y: reception successful, N: reception in failure) and the automatic reception of the satellite signal (Y: automatic reception ON, N: automatic reception OFF).

A user operates the B-button 62 so that the indicating hand 81*b* indicates either the "Y" display 88*a* or the "N" display 88*b*, thereby displaying the reception result of the satellite signal. In addition, the user operates the A-button 61 and the B-button 62 so that the indicating hand 81*b* is aligned with either the "Y" display 88*a* or the "N" display 88*b*, thereby enabling the user to set the automatic reception ON/OFF of the satellite signal.

In the embodiment, the "Y" display 88*a* is disposed at the position of 52 seconds, and the "N" display 88*b* is disposed at the position of 38 seconds, but the configuration is not limited thereto. It is preferable to dispose the marks of the "Y" display 88*a* and the "N" display 88*b* at a visible position, depending on a position of providing the small timepiece including the reception result display 88.

In the above-described electronic timepiece 10*a*, an embodiment has been described in which the captured satellite number display 87, the time-second display 89 of the local time, and the reception result display 88 of the satellite signal are disposed in the first small timepiece 80*b*. However, instead of this configuration, a configuration may be adopted in which the information display unit for displaying multiple information items including at least the above-described captured satellite number display 87 and the time-second display of the local time is disposed in the first small timepiece 80*b*.

Alternatively, a configuration may be adopted in which the information display unit for displaying multiple information items including at least the above-described captured satellite number display 87 and the reception result display 88 of the satellite signal is disposed in the first small timepiece 80*b*, or a configuration may be adopted in which the information display unit for displaying multiple information items including at least the above-described time-second display 89 and the above-described reception result display 88 is disposed in the first small timepiece 80*b*.

Next, the integrated minute display 72 of the circular second small timepiece 70*a* disposed in the dial 11*a* will be described.

The integrated minute display 72 is disposed in the second small timepiece 70*a*. The integrated minute display 72 displays a scale which is disposed on the outer periphery of the second small timepiece 70*a* and divides the outer periphery into 60 portions, and an integrated minute related to the world time function in which 10-digit numbers from "10" to "60" are marked. The indicating hand 71*a* indicates the "minute" of the time integrated by the chronograph function using the integrated minute display 72. According to the chronograph function, it is possible to measure the time up to 59 seconds, 59 minutes, and five hours by using the indicating hands 21, 71*a*, and 81*a*.

Next, the rectangular calendar display 15*a* disposed in the dial 11*a* will be described.

The calendar display 15*a* is disposed in an opening section which is rectangularly open in dial 11*a*, and numbers are visible through the opening section. The numbers represent the "date" in the date, the month, and the year.

In the embodiment, a configuration has been described in which the first small timepiece 80*a* is disposed at the position in the direction of 6 o'clock from the center of the dial 11*a* and overlapping the straight line connecting the position of 12 o'clock and the position of 6 o'clock, and in which the first small timepiece 80*b* is disposed at the position in the direction of 10 o'clock from the center of the dial 11*a* and overlapping the straight line connecting the position of 3 o'clock and the position of 9 o'clock. However, combination of the information items included in the information display unit of the respective first small timepieces 80*a* and 80*b* and position where the respective first small timepieces 80*a* and 80*b* are provided are not limited this configuration.

In the dial 11*a*, any one of the first small timepieces 80*a* and 80*b* or the second small timepiece 70*a* can be disposed at the position overlapping any straight line of the straight line connecting the center of the dial 11*a* and the position of 3 o'clock, the straight line connecting the center of the dial 11*a* and the position of 6 o'clock, the straight line connecting the center of the dial 11*a* and the position of 9 o'clock, and the straight line connecting the center of the dial 11*a* and the position of 12 o'clock. Hereinafter, a specific application example of the position where the first small timepieces 80*a* and 80*b* are provided and various display items included in the information display unit of the respective small timepieces (first small timepieces 80*a* and 80*b*) will be described.

Position

The dial 11*a* according to the embodiment can include the first small timepiece 80*a* disposed at the position overlapping the above-described predetermined straight line, and the first small timepiece 80*b* disposed at the position overlapping the straight line which is adjacent to each other clockwise around the center of the dial 11*a* from the first small timepiece 80*a*.

Display

Example 1

The first small timepiece 80*a* includes the information display unit including the integrated hour display 82 and the summer time display 83, and the first small timepiece 80*b* includes the information display unit including the captured satellite number display 87 and the reception result display 88.

Example 2

The first small timepiece 80*a* includes the information display unit including the integrated hour display 82 and the summer time display 83, and the first small timepiece 80*b* includes the information display unit including the captured satellite number display 87 and the time-second display 89.

Example 3

The first small timepiece 80*a* includes the information display unit including the integrated hour display 82 and the summer time display 83, and the first small timepiece 80*b* includes the information display unit including the time-second display 89 and the reception result display 88.

Example 4

The first small timepiece 80*a* includes the information display unit including the integrated hour display 82 and the charged capacity display 84, and the first small timepiece 80*b* includes the information display unit including the captured satellite number display 87 and the reception result display 88.

Example 5

The first small timepiece 80*a* includes the information display unit including the integrated hour display 82 and the charged capacity display 84, and the first small timepiece 80*b* includes the information display unit including the captured satellite number display 87 and the time-second display 89.

Example 6

The first small timepiece 80*a* includes the information display unit including the integrated hour display 82 and the charged capacity display 84, and the first small timepiece 80*b* includes the information display unit including the time-second display 89 and the reception result display 88.

Example 7

The first small timepiece 80*a* includes the information display unit including the integrated hour display 82 and the reception prohibition display 85, and the first small timepiece 80*b* includes the information display unit including the captured satellite number display 87 and the reception result display 88.

Example 8

The first small timepiece 80*a* includes the information display unit including the integrated hour display 82 and the reception prohibition display 85, and the first small timepiece 80*b* includes the information display unit including the captured satellite number display 87 and the time-second display 89.

Example 9

The first small timepiece 80*a* includes the information display unit including the integrated hour display 82 and the reception prohibition display 85, and the first small timepiece 80*b* includes the information display unit including the time-second display 89 and the reception result display 88.

Example 10

The first small timepiece 80*a* includes the information display unit including the integrated hour display 82 and the reception mode display 86, and the first small timepiece 80*b* includes the information display unit including the captured satellite number display 87 and the reception result display 88.

Example 11

The first small timepiece 80*a* includes the information display unit including the integrated hour display 82 and the reception mode display 86, and the first small timepiece 80*b* includes the information display unit including the captured satellite number display 87 and the time-second display 89.

Example 12

The first small timepiece 80*a* includes the information display unit including the integrated hour display 82 and the reception mode display 86, and the first small timepiece 80*b* includes the information display unit including the time-second display 89 and the reception result display 88.

Similar to the electronic timepiece 10 according to the first embodiment, city information 35 having a marked code representing a representative city name in a time zone corresponding to a time difference marked in the dial ring 40 is marked in the bezel 32. A three-letter code is used by abbreviating the representative city name to three alphabet letters. "LON" represents London, "PAR" represents Paris, "CAI" represents Cairo, "JED" represents Jeddah, "DXB" represents Dubai, "KHI" represents Karachi, "DEL" represents Delhi, "DAC" represents Dacca, "BKK" represent Bangkok, "BJS" represents Beijing, "TYO" represents Tokyo, "ADL" represents Adelaide, "SYD" represents Sydney, "NOU" represents Nemea, "WLG" represents Wellington, "TBU" represents Nuku'alofa, "CXI" represents Christmas Island, "MDY" represents Midway Island, "HNL" represents Honolulu, "ANC" represents Anchorage, "LAX" represents Los Angeles, "DEN" represents Denver, "CHI" represents Chicago, "NYC" represents New York, "CCS" represents Caracas, "SCL" represents San Diego, "RIO" represents Rio de Janeiro, "FEN" represents Fernando de Noronha Islands, and "PDL" represents the Azores, respectively. For example, the code of "TYO" represents Tokyo. The number "9" of the time difference information 45 which is jointly marked in the dial ring 40 corresponding to this code enables a user to easily understand that Tokyo uses the standard time of UTC+9 hours.

Due to the limited display space and in order to improve the visibility, marks for representative city names corresponding to the time difference in the time difference information 45 are partially omitted. In addition, a marking method of the representative city names is an example, and another method may be used for the marking.

The time zone of the local time (internal time) indicated by the indicating hands 22, 23, and 81*b* can be confirmed through the time zone display 46 which the indicating hand 21 indicates by operating the crown 50. For example, the time zone display of "TYO" and "9" enables a user to understand that he or she lives in a time zone of +9 hours in which Tokyo is the representative city.

The control device 300 detects an operation signal in response to an operation of the respective buttons 61 to 64 or the crown 50, and performs integration of the time. The control device 300 performs a drive control of the drive mechanism 140 as indicated by the integrated time. In this manner, in the electronic timepiece 10*a*, the integrated time is indicated by the indicating hands 21, 71*a*, and 81*a* (refer to FIG. 20).

The control device 300 detects the operation signal, and controls the drive mechanism 140 to be driven as indicated by the setting information (symbols marked in the information display unit) of the electronic timepiece 10*a* which is stored in the storage device 150. In this manner, in the electronic timepiece 10*a*, at least one indicating hand of the indicating hands 21, 81*a*, and 81*b* (refer to FIG. 20) indicates the setting information of the electronic timepiece 10*a* which corresponds to the operation signal. For example, if the control device 300 detects the operation signal of the crown 50 (refer to FIG. 17), the indicating hand 81*a* indicates the setting information of the summer time which is stored in the storage device 150 in the electronic timepiece 10*a*. Specifically, the indicating hand 81*a* indicates the mark of "DST" (refer to FIG. 20) in the summer time display 83 in case of the summer time: ON, and indicates the mark of "0" (refer to FIG. 20) in the summer time display 83 in case of the summer time: OFF.

The control device 300 detects the operation signal, and causes the storage device 150 to store the selected setting information. The control device 300 controls the drive mechanism 140 to be driven in response to the operation signal. In this manner, anyone indicating hand of the indicating hands 21, 81*a*, and 81*b* (refer to FIG. 20) indicates the setting information marked by the symbol in the information display unit, thereby selecting the setting information. Then, the control device 300 detects the operation signal, and causes the storage device 150 to store the selected setting information. For example, if the control device 300 detects the operation signal of the B-button 62, the indicating hand 81*a* indicating the symbol of "O" in the summer time display 83 indicates the symbol of "DST", thereby selecting the summer time: ON. Then, if the control device 300 detects the operation signal of the crown 50, the control device 300 causes the storage device 150 to store the setting of the summer time: ON.

The operation of the A-button 61, the B-button 62, the C-button 63, the D-button 64, and the crown 50 which have been described in the embodiment is an example, and the operation may be performed using an input device which is different from those described.

In the embodiment, the radio wave transmitted from the GPS satellite 8 is used as the external signal, but the external signal is not limited thereto. For example, in addition to the global navigation satellite system (GNSS) such as the Galileo and the global navigation satellite system (GLONASS), the standard radio wave of each territory in broadcasting of governments or international organizations can be used as the external signal. In addition, the radio wave (external signal) transmitted by a communication function unit such as the Bluetooth (registered trademark) from a mobile phone or a smartphone which has accurate time or position information may be used so that the electronic timepiece 10*a* receives the information. In addition, the invention does not depend on various methods and systems. However, in case of a quartz timepiece, it is possible to display accurate time for a longer period of time. In case of an analog timepiece, a user is likely to confirm multiple information items at the same time, and the timepiece becomes very fashionable.

Operation of Electronic Timepiece

Figure 21:
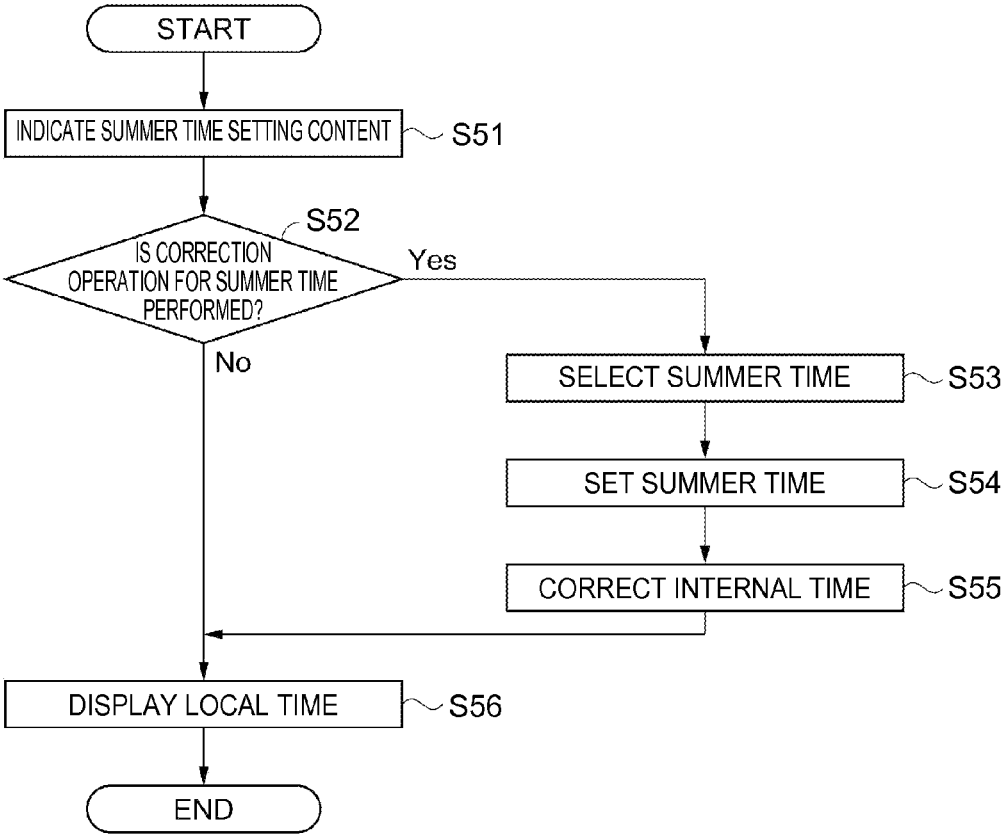
FIG. 21 is a flowchart illustrating an operation of the electronic timepiece according to the second embodiment.

Next, an operation of the electronic timepiece 10*a* will be described. FIG. 21 is a flowchart illustrating summer time setting flow of the electronic timepiece 10*a*.

The operation of the electronic timepiece 10*a* will be described with reference to FIGS. 20 and 21.

First, in Step S51, the control device 300 detects the operation of the crown 50, and drives the drive mechanism 140, thereby causing the indicating hand 81*a* (refer to FIG. 20) to indicate the summer time display 83 (refer to FIG. 20) corresponding to the currently set summer time ON/OFF. Specifically, when the summer time is set to ON, the indicating hand 81*a* indicates the symbol "DST" in the summer time display 83, and when the summer time is set to OFF, the indicating hand 81*a* indicates the symbol "O" in the summer time display 83.

In Step S52, the control device 300 determines whether or not a correction operation for the summer time setting is performed. If the correction operation is performed (S52: Yes), the process proceeds to Step S53. If the correction operation is not performed (S52: No), the process proceeds to Step S56.

In Step S53, the control device 300 detects the operation of the B-button 62, and drives the drive mechanism 140, thereby causing the indicating hand 81*a* to move between the alphabet letters and the symbol inside the summer time display 83 (refer to FIG. 20) so as to select a correct summer time condition. Specifically, when the summer time is set to ON from OFF, the indicating hand 81*a* indicating the symbol of "O" in the summer time display 83 moves to the alphabet letters of "DST", and selects the summer time: ON. When the summer time is set to OFF from ON, the indicating hand 81*a* indicating the alphabet letters of "DST" in the summer time display 83 moves to the symbol of "O", and selects the summer time: OFF.

In Step S54, the control device 300 causes the storage device 150 to store the summer time setting corresponding to the selection in Step S53. Specifically, when "DST" in the summer time display 83 is selected, the control device 300 causes the storage device 150 to store the setting of the summer time: ON. When "O" in the summer time display 83 is selected, the control device 300 causes the storage device 150 to store the setting of the summer time: OFF.

In Step S55, the control device 300 corrects the internal time using the manually set time zone.

In Step S56, the control device 300 detects the operation of the crown 50, and drives the drive mechanism 140, thereby displaying the local time (internal time).

As described above, according to the electronic timepiece 10*a* of the embodiment, the following advantageous effects can be obtained.

The electronic timepiece 10*a* is a wrist timepiece including multiple functions including the world time function which receives the satellite signal from the GPS satellite 8 and calculates the position information and the time information of the current location so as to display the local time, and the chronograph function which displays the integrated minute of the time. The dial 11*a* of the electronic timepiece 10*a* includes the multiple first small timepieces 80*a* and 80*b* including the information display unit for combinedly displaying multiple information items related to the world time function and the chronograph function. The multiple first small timepieces 80*a* and 80*b* are disposed at the position overlapping any straight line of either the straight line connecting the position of 3 o'clock and the position of 9 o'clock in the dial 11*a* or the straight line connecting the position of 12 o'clock and the position of 6 o'clock in the dial 11*a*. In addition, the dial 11*a* includes the calendar display 15*a* in the direction of 4 o'clock from the center of the dial 11*a*. In this manner, multiple information items can be displayed by improving aesthetic appearance and the visibility of the electronic timepiece 10*a*. Therefore, it is possible to provide the electronic timepiece 10*a* in which the aesthetic appearance in design is compatible with the multiple function display.

In the electronic timepiece 10*a*, the integrated hour display 82 (integration display unit) for displaying the "hour" of the integrated minute related to the chronograph function is provided together with the summer time display 83 related to the world time function, the charged capacity display 84, the reception prohibition display 85 of the satellite signal, and the reception mode display 86. In this manner, the electronic timepiece 10*a* is configured so that multiple information items can be visibly disposed in the limited space, and can include the world time function and the chronograph function. Furthermore, since the display items are disposed in the small timepiece, it is possible to allow the aesthetic appearance in design to be compatible with the visibility of the display items. In some cases, a time-different country or a competition for competing the required time across a territorial boundary needs a record of the accurate local time at the start point and the end point of the competition and the required time. Even in this case, the electronic timepiece 10*a* according to the embodiment displays the local time using the world time function, and displays the required time using the chronograph function. Accordingly, without using multiple measurement instruments, it is possible to measure both of these. Therefore, it is possible to provide the electronic timepiece 10*a* including the world time function and the chronograph function which can obtain the local time and the required time using one measurement instrument.

The electronic timepiece 10*a* is a wrist timepiece including multiple functions including the world time function which receives the satellite signal from the GPS satellite 8 and calculates the position information and the time information of the current location so as to display the local time, and the chronograph function which integrates and displays the time. The dial 11*a* of the electronic timepiece 10*a* includes the circular first small timepiece 80*b* which visibly displays the multiple functions included in the electronic timepiece 10*a*. The outer periphery of the first small timepiece 80*b* has the scale dividing the outer periphery into 12 portions, the captured satellite number display 87 for displaying the numbers from "0" to "11" which indicate the captured satellite number, and the time-second display 89 having the marked scale dividing the outer periphery into 60 portions. The inner periphery of the first small timepiece 80*b* includes the reception result display 88 of the satellite signal. In the electronic timepiece 10*a*, the display items for the multiple functions are disposed by using the first small timepiece 80*b*. In this manner, it is possible to improve the visibility of the display items and the aesthetic appearance of the timepiece which is obtained by design using the small timepiece. In addition, the first small timepiece 80*b* of the electronic timepiece 10*a* is provided at the position overlapping the straight line connecting the center of the dial 11*a* and the position of 9 o'clock. In this manner, the integrated minute display 72 (second small timepiece 70*a*) which is frequently used and the calendar display 15*a* can be arranged in a very visible region on the side of 3 o'clock in the straight line connecting the position of 12 o'clock and the position of 6 o'clock in the dial 11*a*. Therefore, it is possible to provide the electronic timepiece 10*a* which can display the multiple functions by allowing the visibility and the aesthetic appearance to be compatible with each other.

The invention is not limited to the second embodiment, and various modifications and improvements can be added to the above-described second embodiment. The modification examples are as follows.

Modification Example

Figure 22:
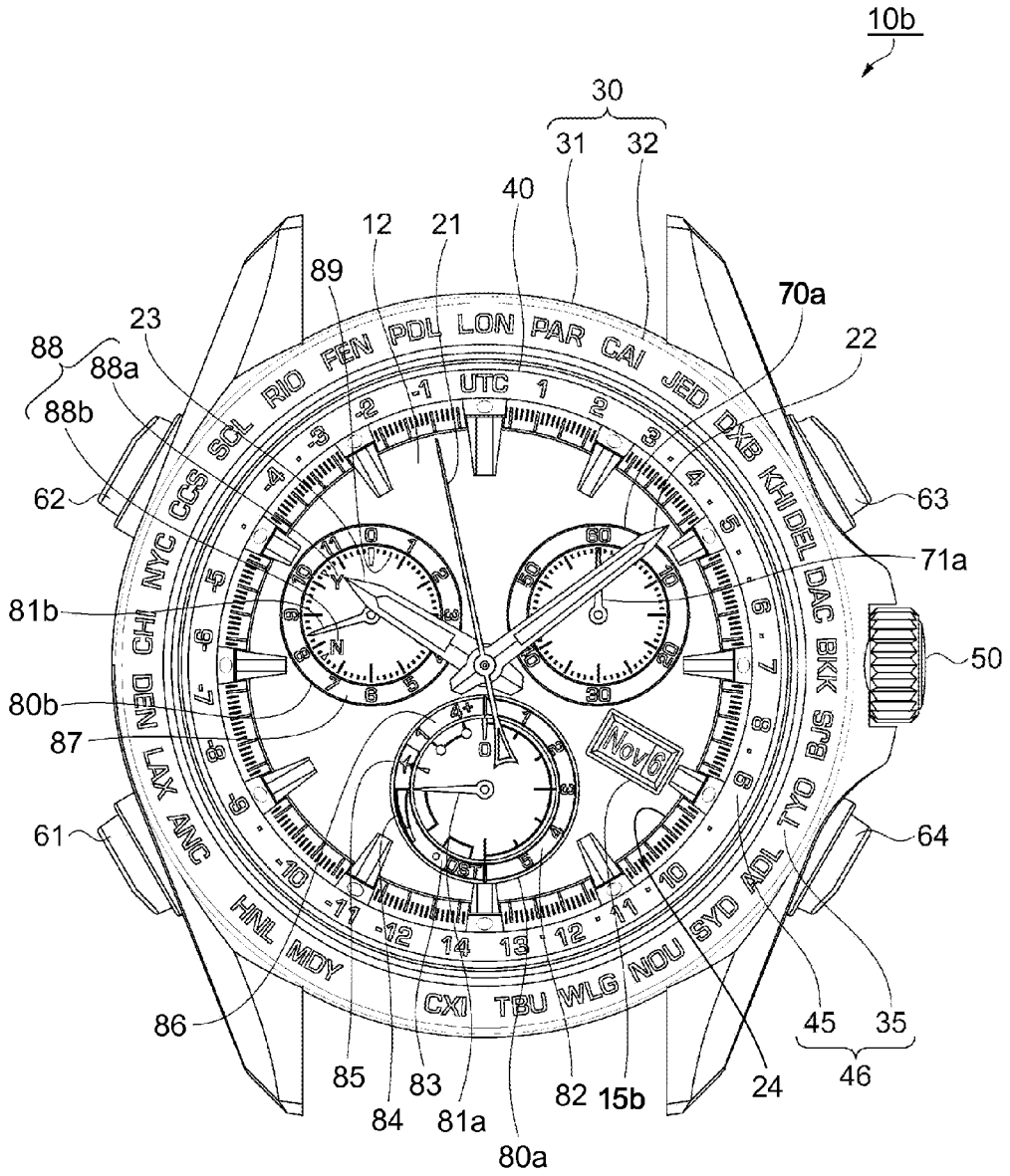
FIG. 22 is a schematic plan view illustrating the appearance of the electronic timepiece according to a modification example of the second embodiment.

FIG. 22 is a schematic plan view illustrating appearance of the electronic timepiece according to a modification example.

In the above-described embodiment, a configuration has been described in which the electronic timepiece 10*a* (refer to FIG. 20) includes the calendar display 15*a*, and in which the calendar display 15*a* displays the date in the Christian era. However, the invention is not limited this configuration.

Hereinafter, an electronic timepiece 10*b* according to the modification example will be described. The same reference numerals are given to configuration elements which are the same as those in the embodiments, and description thereof will be omitted.

The electronic timepiece 10*b* includes the exterior case 30, the cover glass 33, and the case back 34. The exterior case 30 is configured so that the bezel 32 formed of ceramic is fitted to the cylindrical case 31 formed of metal. A disc-shaped dial 12 is disposed on the inner peripheral side of the bezel 32 via the annular dial ring 40 formed of plastic. The dial 12 includes the indicating hands 21, 22, and 23.

The dial 12 includes the second small timepiece 70*a* including the indicating hand 71*a*, the first small timepiece 80*b* including the indicating hand 81*b*, the first small timepiece 80*a* including the indicating hand 81*a*, and calendar display 15*b*.

The calendar display 15*b* is disposed in the direction of 4 o'clock from the center of the dial 12. The calendar display 15*b* is disposed in an opening section which is rectangularly open in the dial 12, and alphabet letters and numbers are visible through the opening section. The alphabet letters and the numbers indicate the "month" and the "date" in the Christian era. The alphabet letters "Nov" and the number "6" illustrated in FIG. 22 indicate 6 November. It is preferable that the electronic timepiece 10*b* include display for the "year" in the Christian era. In addition, the invention does not depend on various methods and systems. However, in case of a quartz timepiece, it is possible to display accurate time for a longer period of time. In case of an analog timepiece, a user is likely to confirm multiple information items at the same time, and the timepiece becomes very fashionable.

As described above, according to the electronic timepiece 10*b* of the modification example, the following advantageous effects can be obtained in addition to the advantageous effects according to the embodiment.

The electronic timepiece 10*b* includes the calendar display 15*b* for displaying information including the "month" and the "date" in the Christian era. In this manner, it is possible to easily record the date and the local time which are displayed on the electronic timepiece 10*b*. In addition, an implementation period of the summer time is independently determined by countries or territories. Accordingly, this record enables a user to know whether or not the recorded local time includes the time difference caused by the summer time.

In the embodiment, the electronic timepiece 10*a* has been described in which the first small timepiece 80*b* disposed in the direction of 10 o'clock from the center of the dial lla includes the captured satellite number display 87, the reception result display 88, and the time-second display 89. However, the invention is not limited to this configuration. Hereinafter, display items will be described which can be included in the small timepiece disposed in the direction of 10 o'clock.

The small timepiece can include at least two display items of the captured satellite number display 87, the reception result display 88, and the time-second display 89.

The small timepiece can include at least one display item of the captured satellite number display 87, the reception result display 88, and the time-second display 89.

The small timepiece can include at least two display items of the captured satellite number display 87, the reception result display 88, and the time-second display 89, and can include the integration display (at least one of the integrated hour display, the integrated minute display, and the integrated second display).

The small timepiece can include the captured satellite number display 87 and at least one display item of the reception result display 88, and the time-second display 89, and can include the integration display (at least one of the integrated hour display, the integrated minute display, and the integrated second display).

The small timepiece can include at least two display items of the captured satellite number display 87, the reception result display 88, and the time-second display 89, and can include at least one display item of the summer time display, the reception mode display, the charged capacity display, and the day display.

The small timepiece can include the captured satellite number display 87 and at least one display item of the reception result display 88, and the time-second display 89, and can include at least one display item of the summer time display, the reception mode display, the charged capacity display, and the day display.

The small timepiece can include at least two display items of the captured satellite number display 87, the reception result display 88, and the time-second display 89, can include the integration display (at least one of the integrated hour display, the integrated minute display, and the integrated second display), and can include at least one display item of the summer time display, the reception mode display, the charged capacity display, and the day display.

The small timepiece can include the captured satellite number display 87 and at least one display item of the reception result display 88, and the time-second display 89, can include the integration display (at least one of the integrated hour display, the integrated minute display, and the integrated second display), and can include at least one display item of the summer time display, the reception mode display, the charged capacity display, and the day display.

Figure 23A:
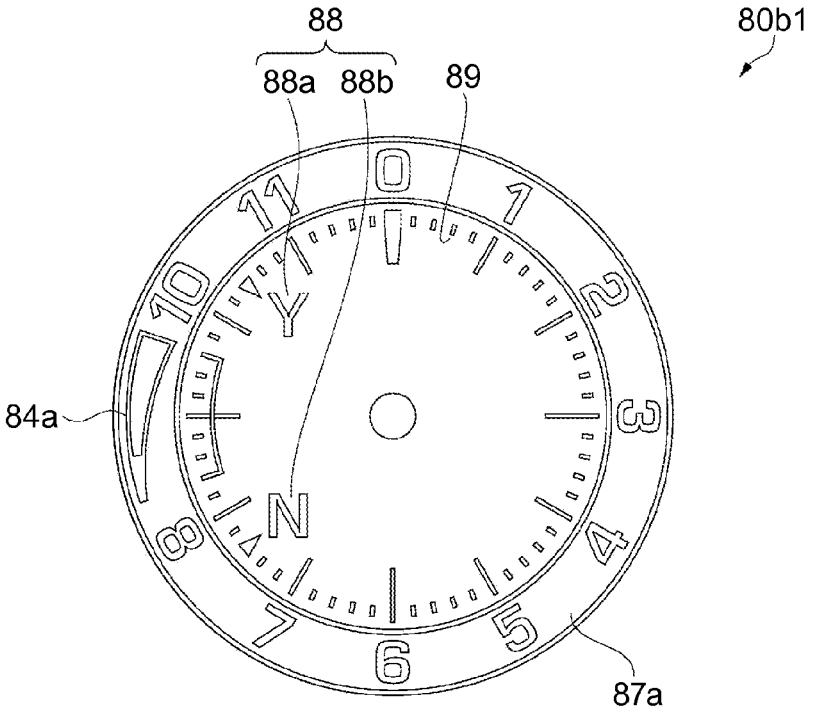
FIG. 23A is a schematic plan view illustrating a segmented display of the electronic timepiece according to another modification example of the second embodiment.
Figure 23B:
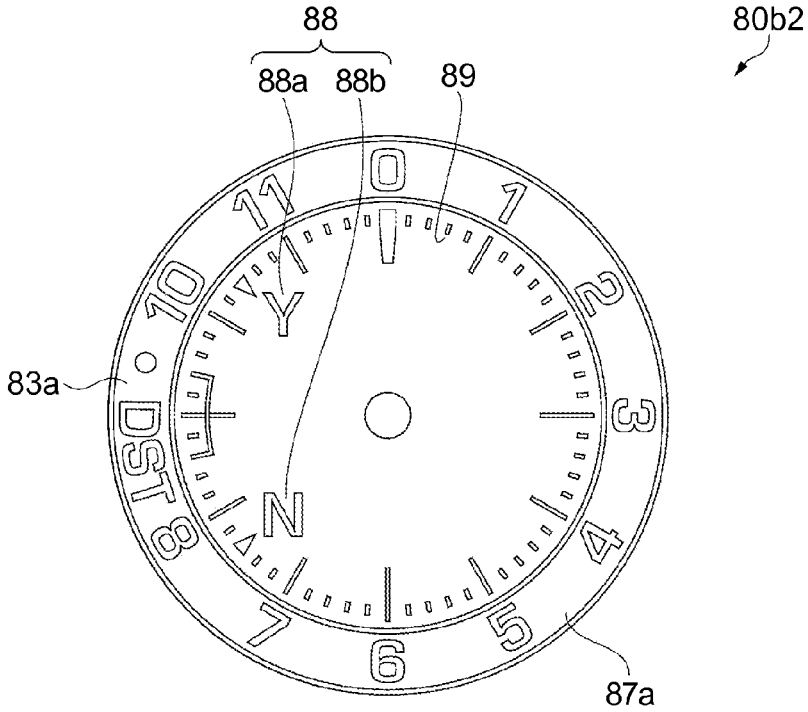
FIG. 23B is a schematic plan view illustrating the segmented display of the electronic timepiece according to another modification example of the second embodiment.

FIGS. 23A and 23B are schematic plan views illustrating the small timepiece of the electronic timepiece. A specific embodiment in which display items can be included in the small timepiece disposed in the direction of 10 o'clock from the center of the dial 11*a* will be described with reference to FIGS. 23A and 23B.

FIG. 23A is the schematic plan view of a small timepiece 80*b*1. Illustration of the indicating hand will be omitted.

The small timepiece 80*b*1 can include captured satellite number display 87*a*, the reception result display 88, the time-second display 89, and charged capacity display 84*a*. In the captured satellite number display 87*a*, a mark for the number of "9" is omitted within the numbers from "0" to "11" which indicate the captured number of GPS satellites 8. The charged capacity display 84*a* is provided at a position where the mark of "9" which indicates the captured number of GPS satellites 8 is omitted. The charged capacity display 84*a* is disposed by shifting the charged capacity display 84 included in the above-described first small timepiece 80*a* to the small timepiece 80*b*1 in the direction of 10 o'clock.

FIG. 23B is the schematic plan view of a small timepiece 80*b*2. Illustration of the indicating hand will be omitted.

The small timepiece 80*b*2 includes the captured satellite number display 87*a*, the reception result display 88, the time-second display 89, and summer time display 83*a*. The summer time display 83*a* is provided at the position where the mark of "9" which indicates the captured number of GPS satellites 8 is omitted. The summer time display 83*a* is disposed by shifting the summer time display 83 included in the above-described first small timepiece 80*a* to the small timepiece 80*b*2 in the direction of 10 o'clock.

What is claimed is:

1. A timepiece comprising:

a measured time display region that displays information related to a time measurement function, the measured time display region having a time scale corresponding to time measurements of the time measurement function;

a signal reception state display region that displays information related to a satellite signal reception function, the signal reception state display region having a reception state scale corresponding to signal reception states of the satellite signal reception function;

a voltage state display region that displays information related to a power supply voltage detection function, the voltage state display region having a voltage state scale corresponding to voltage state detections of the power supply voltage detection function; and one indicating hand that indicates a specific time on the time scale of the measured time display region, a specific reception state on the reception state scale of the signal reception state display region, and a specific voltage state on the voltage state scale of the voltage state display region;

wherein the one indicating hand indicates the specific time on the time scale when the time measurement function is executed, indicates the specific reception state on the reception state scale when the satellite signal reception function is executed, and indicates the specific voltage state on the voltage state scale when the power supply voltage detection function is executed.

2. A timepiece comprising:

a first display region that displays first information related to a first function;

a second display region that displays second information related to a second function;

a first operation unit that is arranged at a position closer to the first display region than to the second display region, and that performs an operation related to the first function;

a second operation unit that is arranged at a position closer to the second display region than to the first display region, and that performs an operation related to the second function; and an indicating hand that indicates specific first information on the first display region when the first function is executed, and indicates specific second information on the second display region when the second function is executed.

3. The timepiece according to claim 2, wherein:

the first function is a time measurement function executed based on an operation of the first operation unit;

the first display region is a measured time display region having a time scale corresponding to time measurements of the time measurement function;

the specific first information is a specific time measurement; and the indicating hand indicates the specific time measurement on the time scale when the first function is executed.

4. The timepiece according to claim 2, wherein:

the second operation unit includes a signal reception unit that receives a satellite signal;

the second function is a satellite signal reception function executed based on an operation of the second operation unit;

the second display region is a reception state display region having a reception state scale corresponding to reception states of the satellite signal reception function;

the specific second information is a specific reception state; and the indicating hand indicates the specific reception state on the time scale when the second function is executed.

5. The timepiece according to claim 2, further comprising:

a timepiece case;

an annular display region on the timepiece case in a plan view, wherein:

the first display region is arranged in a right half region of the annular display region in the plan view;

the second display region is arranged in a left half region of the annular display region in the plan view;

the first operation unit is arranged on the right side of the timepiece case in the plan view; and the second operation unit is arranged on the left side of the timepiece case in the plan view.

* * * * *